United States Patent [19]

Desai et al.

[11] 4,354,613

[45] Oct. 19, 1982

[54] MICROPROCESSOR BASED VENDING APPARATUS

[75] Inventors: Mahendrakumar D. Desai, Colonia; Thomas E. Shuren, Stanhope, both of N.J.

[73] Assignee: Trafalgar Industries, Inc., New York, N.Y.

[21] Appl. No.: 149,951

[22] Filed: May 15, 1980

[51] Int. Cl.[3] ..... G07F 11/16

[52] U.S. Cl. ..... 221/4; 221/129; 194/2; 235/92 AC; 364/479

[58] Field of Search ..... 221/2, 4, 5, 123, 124, 221/125, 129; 194/2, 10, 1 N; 364/478, 479; 235/92 AC, 92 EA

[56] References Cited

U.S. PATENT DOCUMENTS

| | | | |
|---|---|---|---|
| 3,820,642 | 6/1974 | Levasseur | 194/1 N |
| 3,841,456 | 10/1974 | Levasseur | 194/1 N |
| 3,894,220 | 7/1975 | Levasseur | 194/1 N X |
| 4,034,839 | 7/1977 | Lee | 194/10 |
| 4,040,510 | 8/1977 | Peters et al. | 194/2 |
| 4,216,461 | 8/1980 | Werth et al. | 194/1 N X |
| 4,225,056 | 9/1980 | Flubacker | 194/2 X |
| 4,231,105 | 10/1980 | Schuller et al. | 194/10 X |
| 4,233,660 | 11/1980 | Fagan | 194/1 N X |
| 4,267,942 | 5/1981 | Wick et al. | 221/2 |
| 4,316,532 | 2/1982 | Levasseur | 194/2 X |

*Primary Examiner*—Joseph J. Rolla

*Attorney, Agent, or Firm*—Lerner, David, Littenberg & Samuel

[57] ABSTRACT

Microprocessor-based vending apparatus incorporating a plurality of separately driven individual dispensing assemblies is disclosed. The dispensing assemblies are scanned to determine their state and any malfunctioning assembly disabled to prevent attempted selection by a user without shutting down the entire vending machine. The state of the malfunctioning dispensing apparatus is retained in memory so that the state of each dispensing assembly may be selectively displayed through activation of a display switch causing the microprocessor to sequentially identify and display those dispensing devices which malfunctioned. The microprocessor performs all change-making functions normally performed in vending machines to greatly reduce the complexity and expense of the coin-accepting apparatus. Additionally, data is stored representing the quantity of each coin denomination present and change-making capability is disabled when coin denominations are reduced to a predetermined count. Cash flow data is stored in memory and may be displayed upon request. All functions of the vending apparatus are continuously monitored to assure proper operation and alarm conditions to identify malfunctions are developed. The status of all such functions are stored in memory for subsequent display or data transfer. Data transfer may be to an off-line printer, an off-line memory, optically coupled data transducers or the like. The off-line memory has a transceiver which is automatically energized by the vending machine transceiver to initiate data transfer.

29 Claims, 17 Drawing Figures

MICROPROCESSOR BASED VENDING APPARATUS

BACKGROUND OF THE INVENTION

The present invention relates to vending apparatus and, more particularly, to microprocessor-based vending apparatus capable of providing a significant increase in the amount and complexity of vending operations without any increase in the size of the vending apparatus and in the total number of conventional components employed in the vending apparatus and in fact leading to a significant reduction in the total number of components employed in conventional vending apparatus.

Although it may not be obvious to the casual observer, the conentional vending machine, which is employed for vending liquids and/or packaged food products, such as candy, for example, are capable of performing some rather complex functions, such as accepting a coin; examining the accepted coin to ascertain its authenticity; recognizing the denomination of the coin and rejecting if it is insufficient for the particular purchase requested or, alternatively, returning the precise amount of change in the event that the denomination exceeds the cost of the desired purchase; and dispensing the particular item requested. In some cases, the dispensing operation may also include a properly-sequenced group of activities including dispensing precisely one fresh cup and dispensing precise amounts of both liquid and solid ingredients into said cup to provide the desired liquid beverage having quantities of ingredients to suit the taste of the user. Conventionally, these operations have been accomplished through the use of either mechanical or electromechanical devices which, although rather ingenious in their own right, are large, cumbersome, and of questionable reliability in that they are subject to a significant amount of wearing and thereby require regular maintenance and/or repairs.

In addition to all of the functions which conventional vending apparatus is capable of performing, there are nevertheless a number of other functions which it would be highly desirable and in some applications even imperative to integrate into vending apparatus to provide the vending apparatus with both useful and important operating capabilities. The utilization of conventional apparatus to introduce such capabilities renders the vending apparatus still more complex and cumbersome and in fact is highly impractical due to the limited space available within the vending apparatus housing.

BRIEF DESCRIPTION OF THE INVENTION

The present invention is characterized by comprising a microprocessor-based vending machine in which the vast majority of functions previously performed by separate and independent vending machine subassemblies are now concentrated within the microprocessor, thus eliminating the need to provide each such subassembly with its own electronic control, thereby significantly reducing the size and complexity of each of the required subassemblies, by reducing the components of such subassemblies to a practical minimum.

In addition to the above, the microprocessor is uniquely designed to provide a significant increase in the number of vending apparatus functions not heretofore incorporated in conventional vending apparatus and this may be achieved without significantly increasing the complexity of the microprocessor or its interfacing circuitry.

The vending apparatus, in one preferred embodiment, comprises a coin acceptor and change-dispensing unit whose control capability has been incorporated in the microprocessor; manually operable item-selection switches; and dispensing devices for dispensing a large plurality of different packaged items whose control capability is also integrated into the microprocessor which constantly monitors the selection switches to exert control over the desired dispensing device.

In addition to the above functions, the microprocessor constantly scans all of the dispensing devices to monitor their condition and disable the dispensing device identified as malfunctioning and prevent selection of such device by a vending machine user, to thereby prevent the vending machine user from becoming frustrated by repeated attempts to select a packaged item dispensed by a malfunctioning dispensing device. Although a malfunctioning dispensing device is prevented from being selected by a user, the remaining dispensing devices may be operated in the normal fashion.

All other vending machine functions are monitored on a regular basis to assure their proper operation. The microprocessor stores signals in memory representing those malfunctioning units, some of which signals are utilized to create alarms which are not cleared until the malfunctioning unit has been repaired or replaced and some of which may be displayed on demand, usually by generation of a display request.

The microprocessor also stores other pertinent data in memory representing the inventory of items to be dispensed and the number of coins of each denomination accumulated in the vending apparatus as well as other status information. All such information may be displayed on demand thereby providing a firsthand indication of vending machine status to repair personnel.

The microprocessor also controls a bidirectional transceiver which is adapted to communicate with an off-line device for receiving data from the vending machine representing vending machine status. The off-line device is portable and comprises optically coupled transmitter and receiver means. Compatible optically coupled transmitting and receiving means is provided as part of the vending machine. The optically coupled transmitting and receiving apparatus of the off-line unit is aligned with and positioned immediately adjacent to the cooperating transmitting and receiving apparatus forming part of the vending machine. The transmitting light in the vending machine is normally on. When light is received by the off-line unit, it is automatically turned on, thus conserving energy in the off-line unit without requiring separate independent manual off-on switch means. Energization of the off-line unit causes its microprocessor to step through a program which generates a request transmission signal. The request transmission signal is decoded by the vending machine microprocessor, initiating transmission of vending machine status data including detailed cash flow and inventory records. The vending machine status data is received by the off-line unit, and preferably is stored in a CMOS RAM (random access memory) or in both memory such as on a cassette controlled by the off-line microprocessor. The data stored in the off-line unit may be returned to a central location whereat the data is employed to monitor the current status of the vending machine and update records maintained therefor. The off-line unit in another embodiment may incorporate a printer for generating a hard copy of the vending machine status.

The off-line unit may also transmit data to the vending unit which data may be utilized to reset prices of items dispensed by the vending machine.

The microprocessor described herein for controlling a vending machine is adapted to operate vending machines of a packaged food, snack, or drink dispensing type.

OBJECTS OF THE INVENTION AND BRIEF DESCRIPTION OF THE FIGURES

It is therefore one object of the present invention to provide automatic vending apparatus employing a microprocessor to control all of the operations of the vending apparatus and monitor the status of all vending devices, such as coin and food-dispensing motors, for obtaining and updating status information regarding machine status and inventory and for providing visual and/or hard copy presentations of all of said status data.

Still another object of the present invention is to provide novel vending apparatus employing microprocessor-based monitoring and control means for controlling all functions performed within the vending apparatus in their proper order and for storing and continually updating data representative of the status of the vending machine.

Still another object of the present invention is to provide a novel vending machine incorporating microprocessor-based control and monitoring means further incorporating a transceiver capable of being selectively interfaced with off-line transceiver apparatus for transferring data representative of the status of the vending machine and having the further capability of enabling the off-line apparatus to exert control over the vending machine microprocessor by communication from the transceiver of the off-line apparatus to the transceiver of the vending machine.

The above, as well as other objects of the present invention, will become apparent when reading the accompanying description and drawings, in which.

Figure 1:
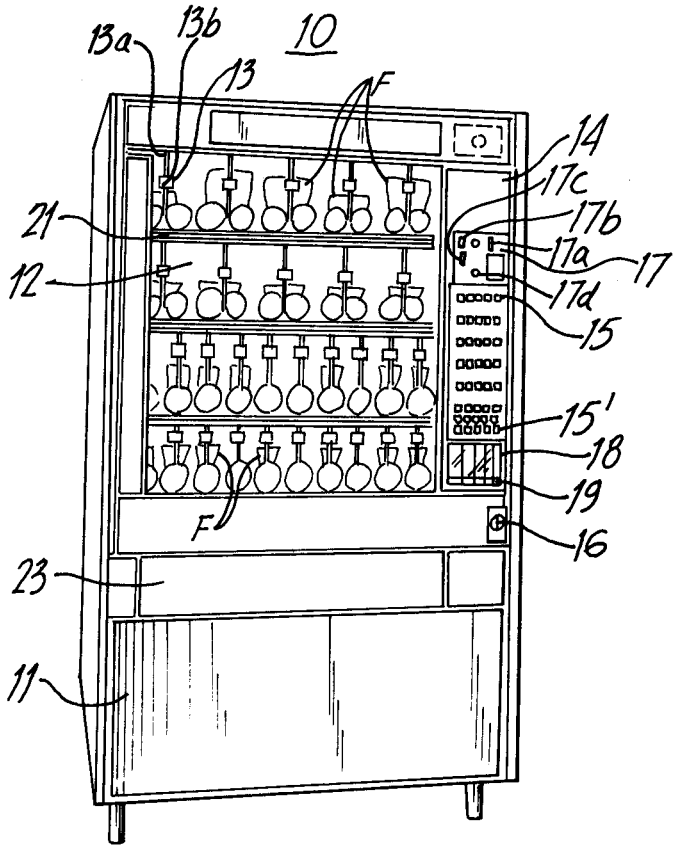
FIG. 1 shows the front panel of an exemplary snack-type vending machine embodying the principles of the present invention.
Figure 2:
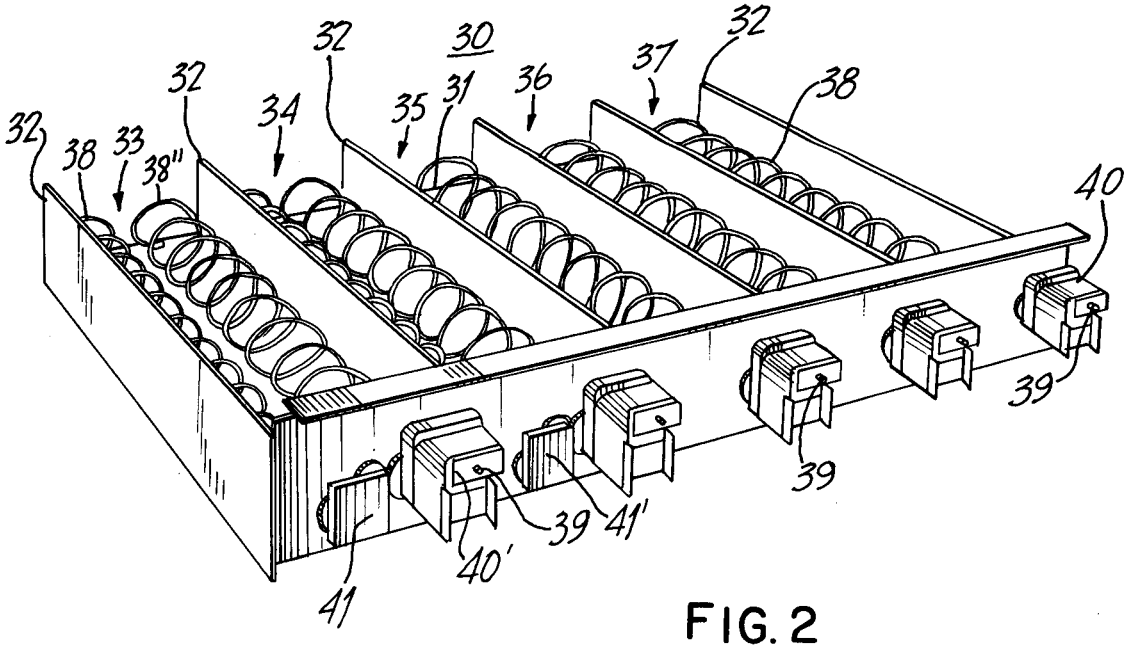
FIG. 2 is a perspective view of exemplary dispensing apparatus for the vending machine of FIG. 1.
Figure 3A:
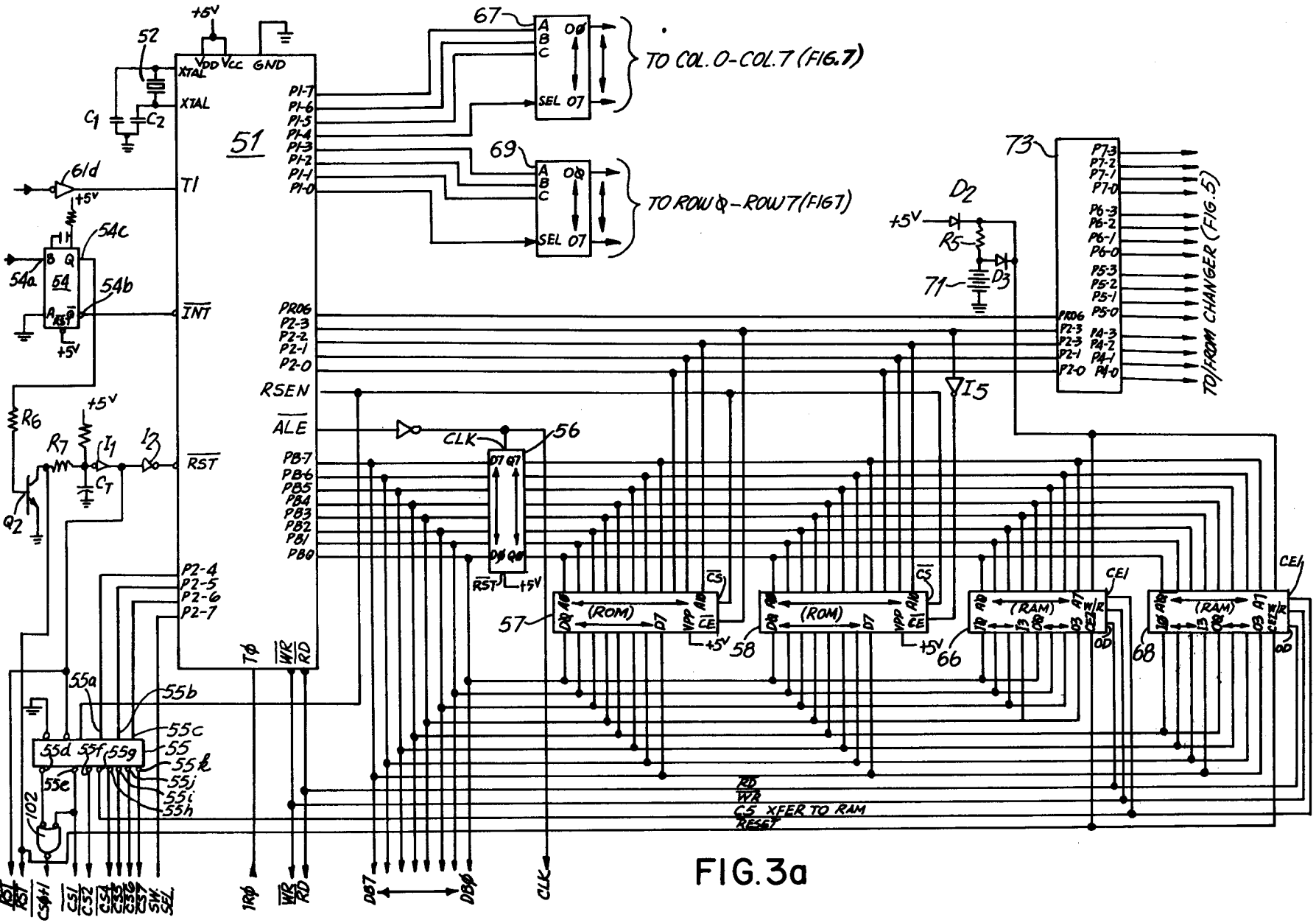
Figure 3B:
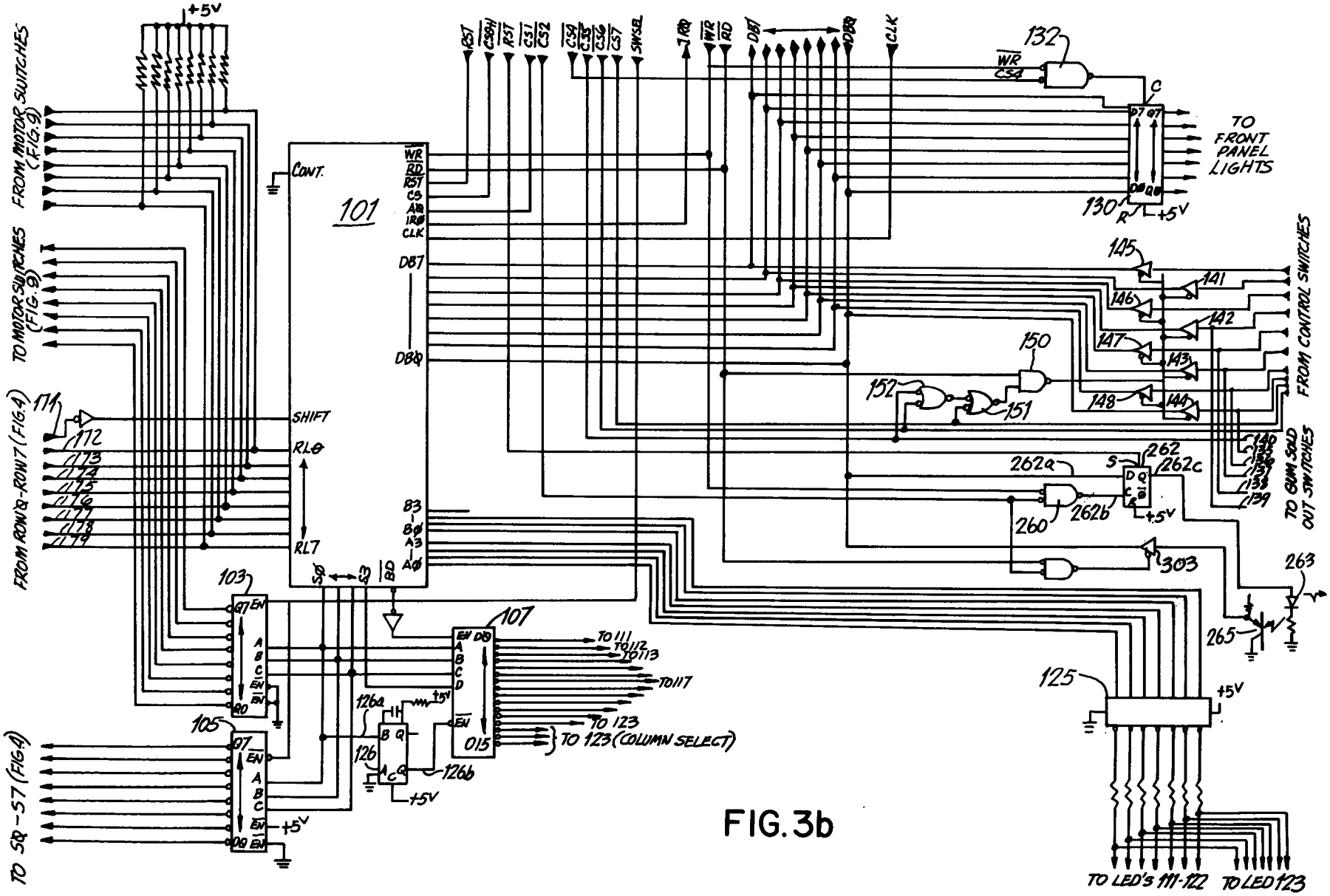

FIGS. 3*a* and 3*b* collectively comprise a simplified, exemplary schematic diagram of an electronic system for controlling and monitoring the vending machine of FIGS. 1 and 2 wherein FIG. 3*a* illustrates the upper portion of the diagram and FIG. 3*b* depicts the lower part of said diagram.

Figure 4:
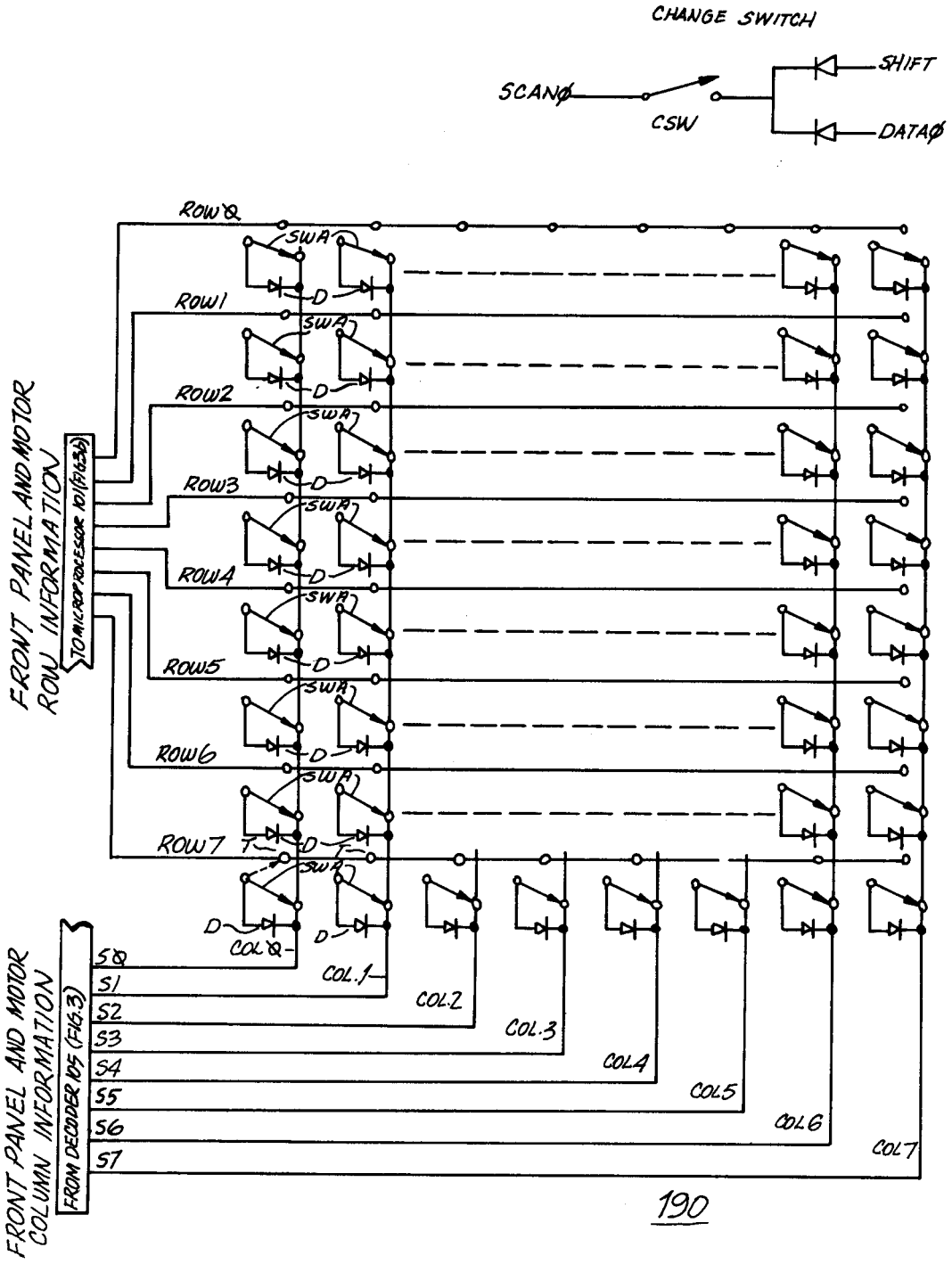

FIG. 4 is an electrical schematic diagram showing the details of the switch array whose actuators are shown in FIG. 1.

Figure 5:
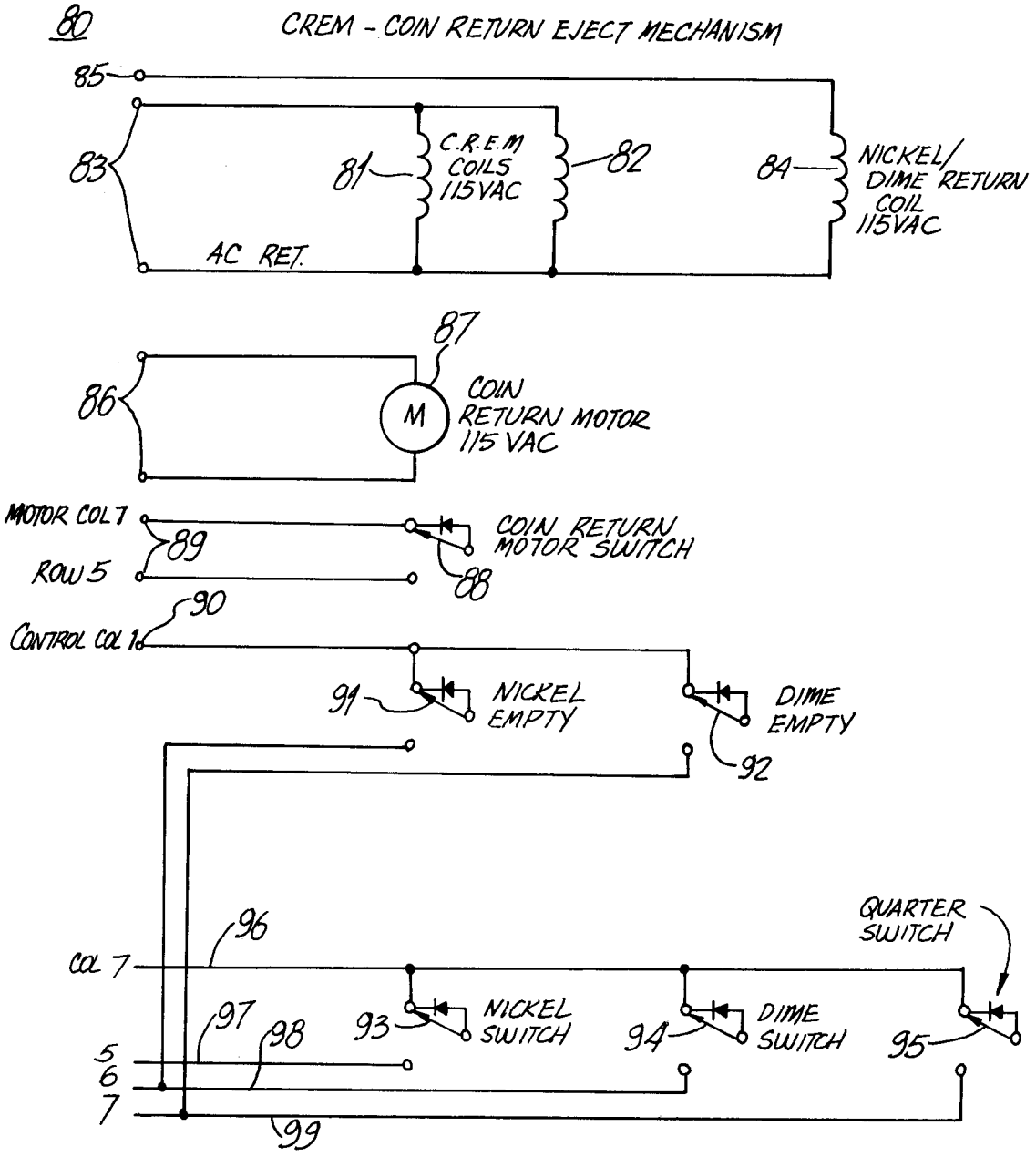

FIG. 5 is a schematic diagram of a coin acceptor/-changer mechanism controlled by the electronic system of FIGS. 3*a* and 3*b* for use in scanning the switch array of FIG. 4.

Figure 6:
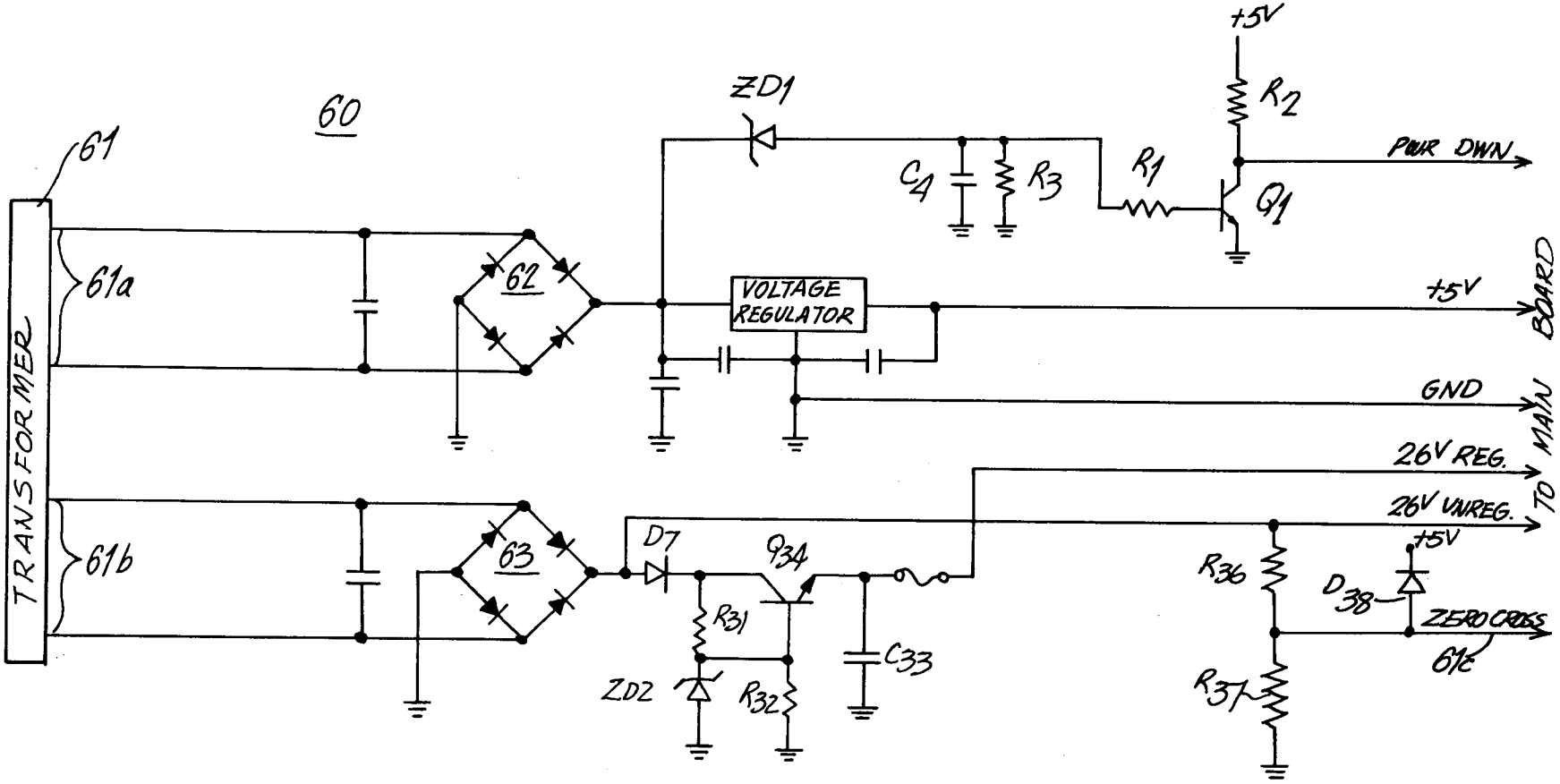

FIG. 6 is a schematic diagram of the power supply and voltage monitoring circuitry for providing power to the electronic system illustrated in FIGS. 3*a* and 3*b*.

Figure 7:
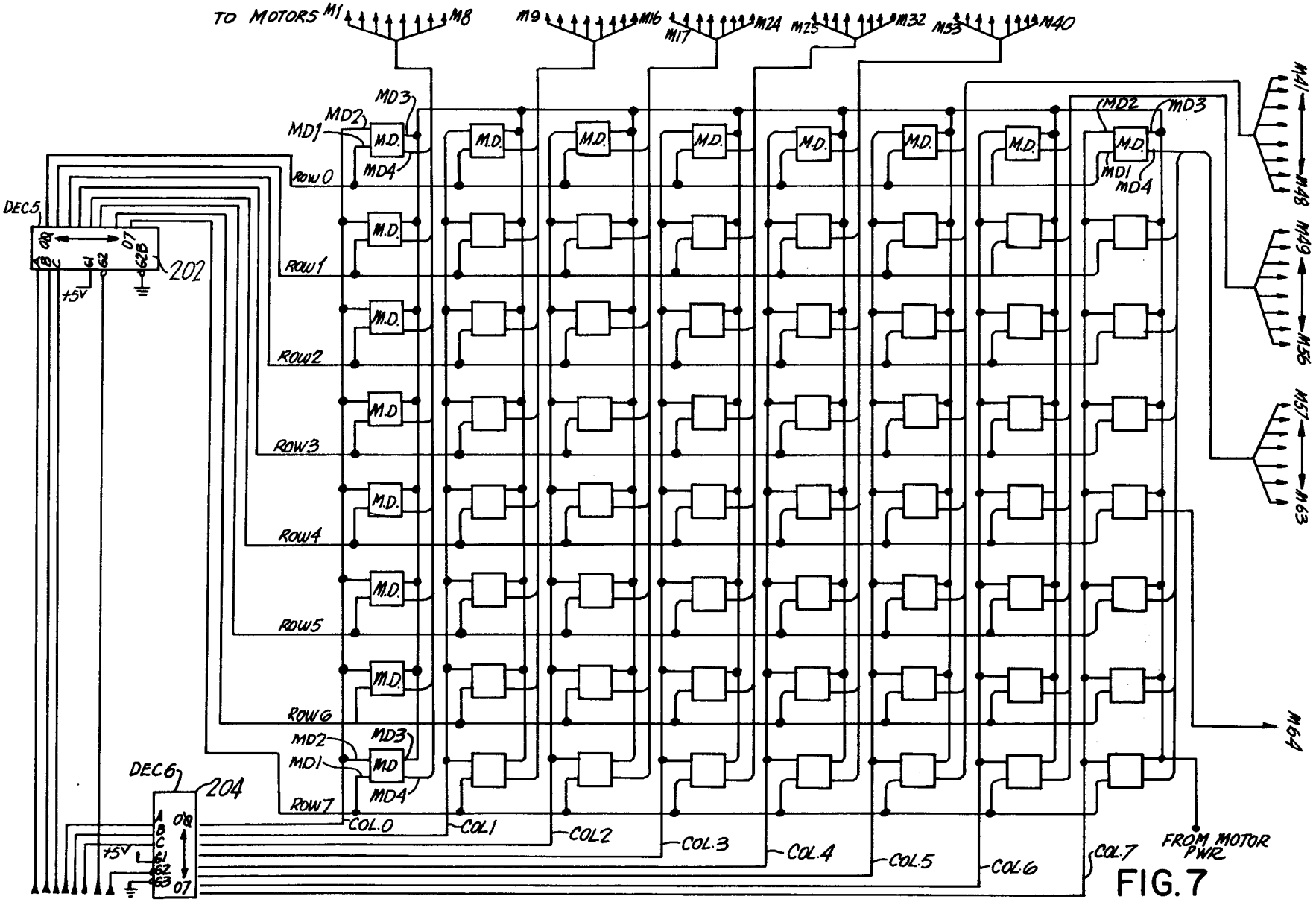

FIG. 7 is a schematic diagram of an exemplary motor drive array for the vending machine of FIG. 1.

Figure 8A:
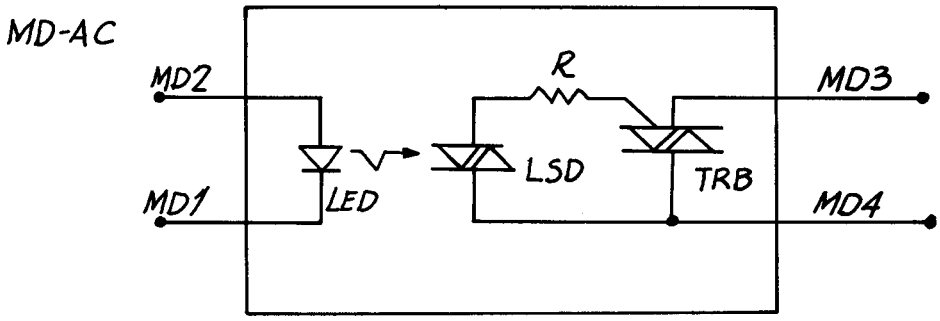
Figure 8B:
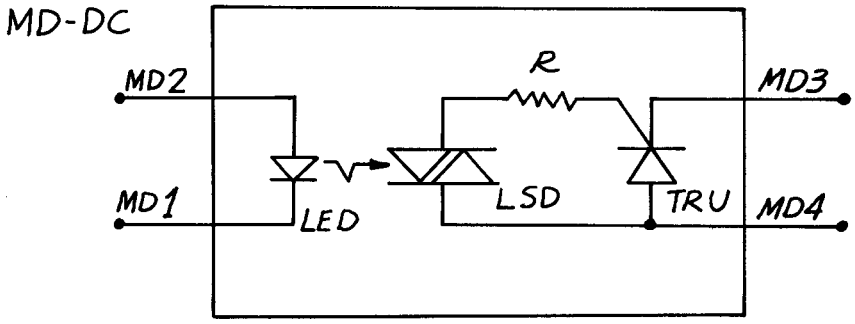

FIGS. 8*a* and 8*b* are detailed schematic diagrams illustrating two types of motor drive circuits which may be employed in the examplary array of FIG. 7 wherein FIG. 8*a* illustrates an exemplary drive circuit for operating A.C. motors and FIG. 8*b* illustrates an exemplary drive circuit for operating D.C. motors.

Figure 9:
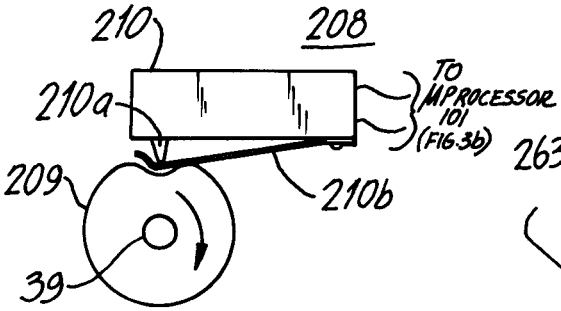

FIG. 9 is a schematic diagram showing a motor switch and cam arrangement for monitoring the operation of an associated motor.

Figure 10:
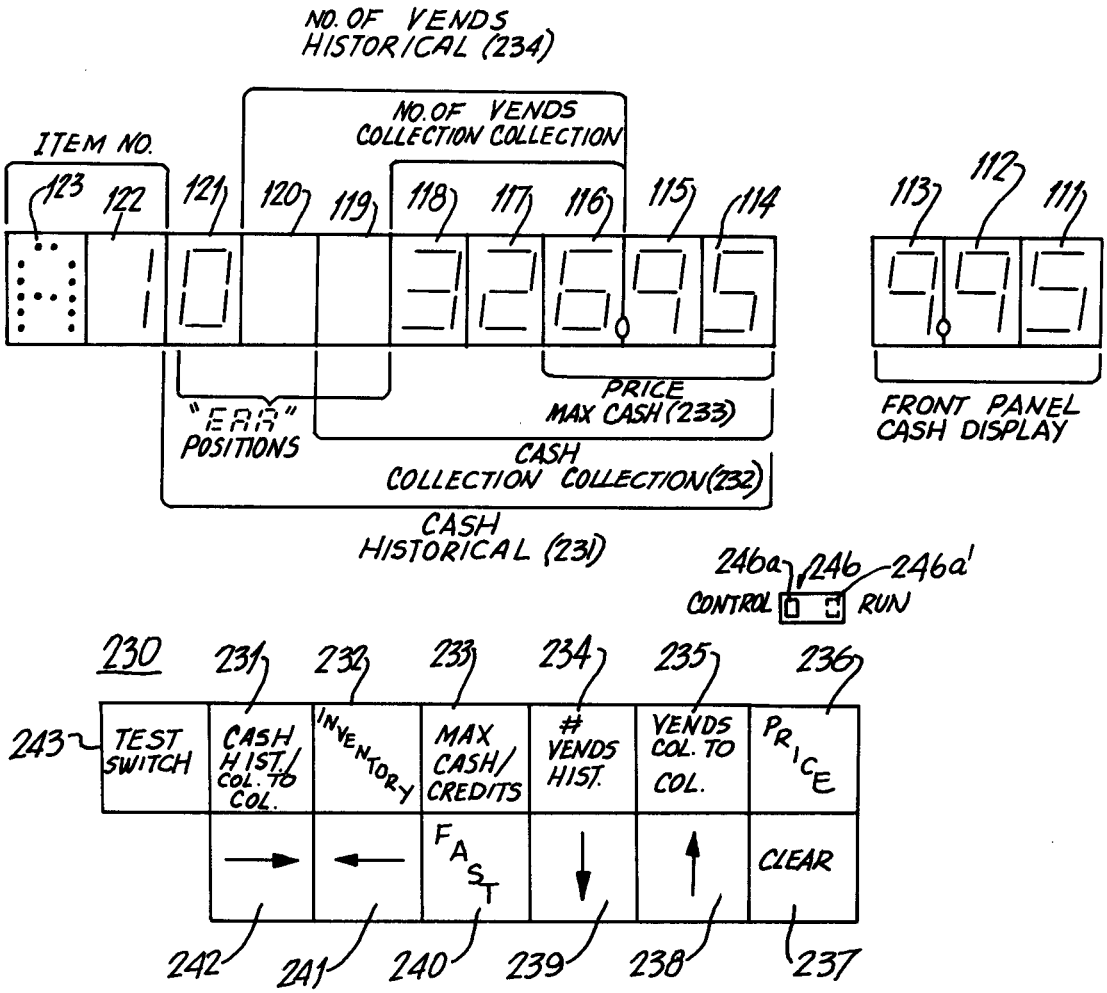

FIG. 10 shows a plan view of the visual display and cooperating display control panel for displaying status information.

Figure 11:
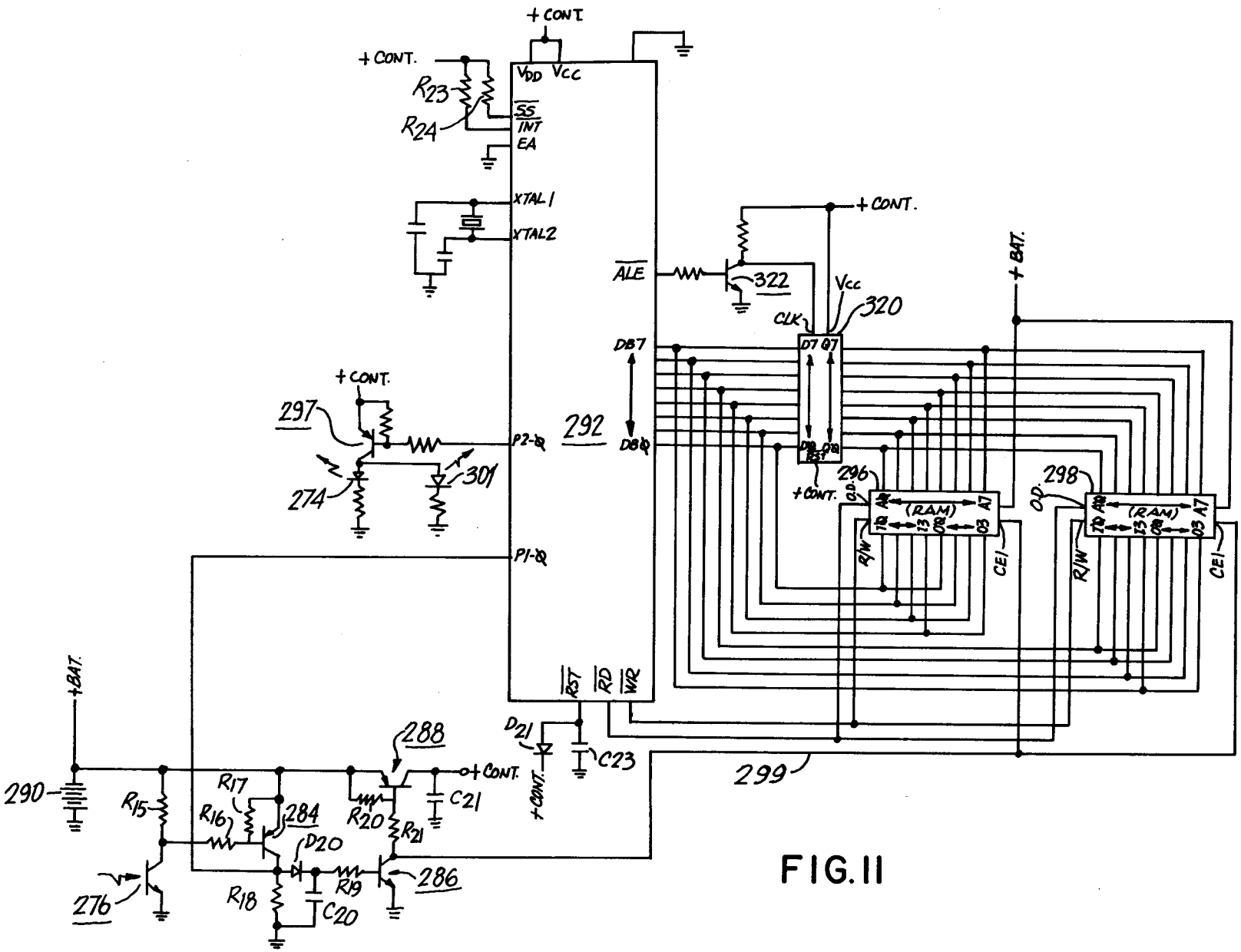

FIG. 11 is a schematic diagram showing an exemplary microprocessor-based off-line data collection device for communicating with the electronic system shown in FIGS. 3*a* and 3*b* of the vending machine for the purpose of collecting and storing status data for subsequent off-line use.

Figure 12:
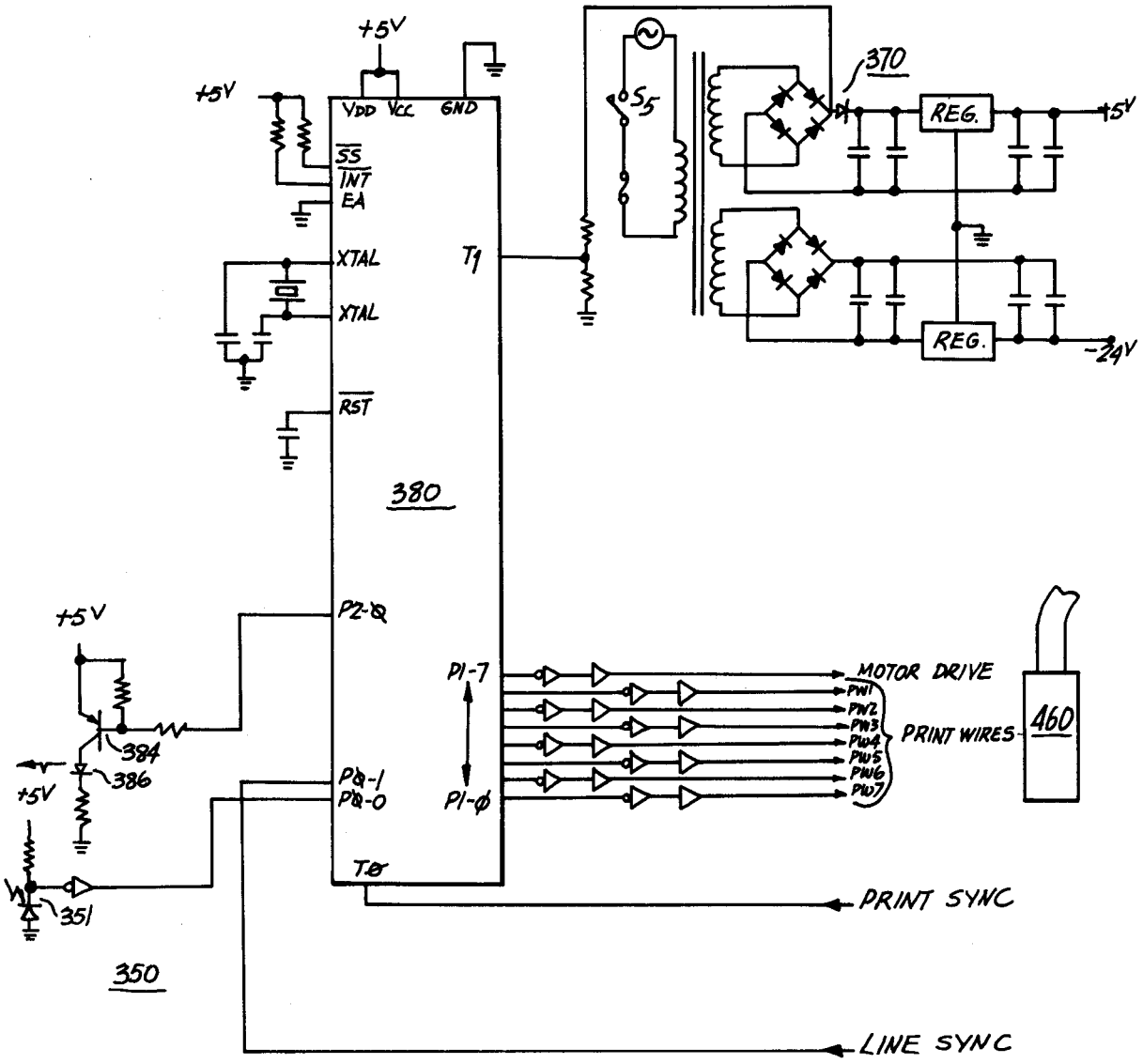

FIG. 12 is a schematic diagram showing an exemplary microprocessor-based off-line printer module for communication with the electronic system of FIGS. 3*a* and 3*b* of the vending machine for purposes of providing a hard copy printout of status information.

Figure 13:
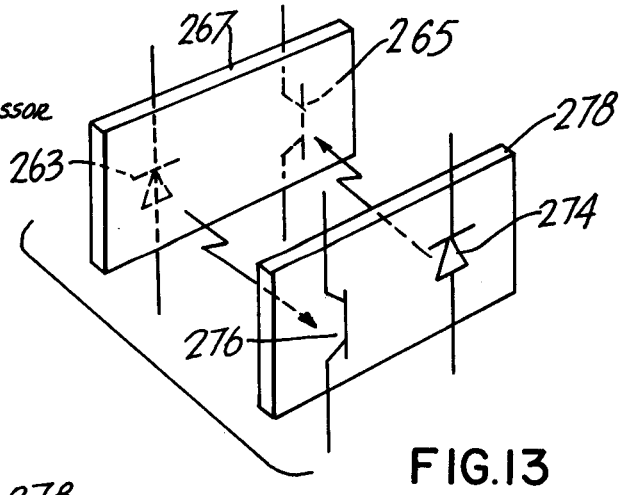

FIG. 13 is a perspective view showing the manner in which the transceiver provided in the vending machine electronic system and the off-line unit transceiver are arranged when communicating with one another.

Figure 14:
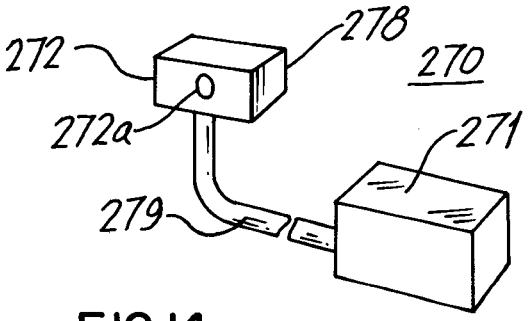

FIG. 14 is a perspective view showing exemplary structure for a remote data collection device.

Figure 15:
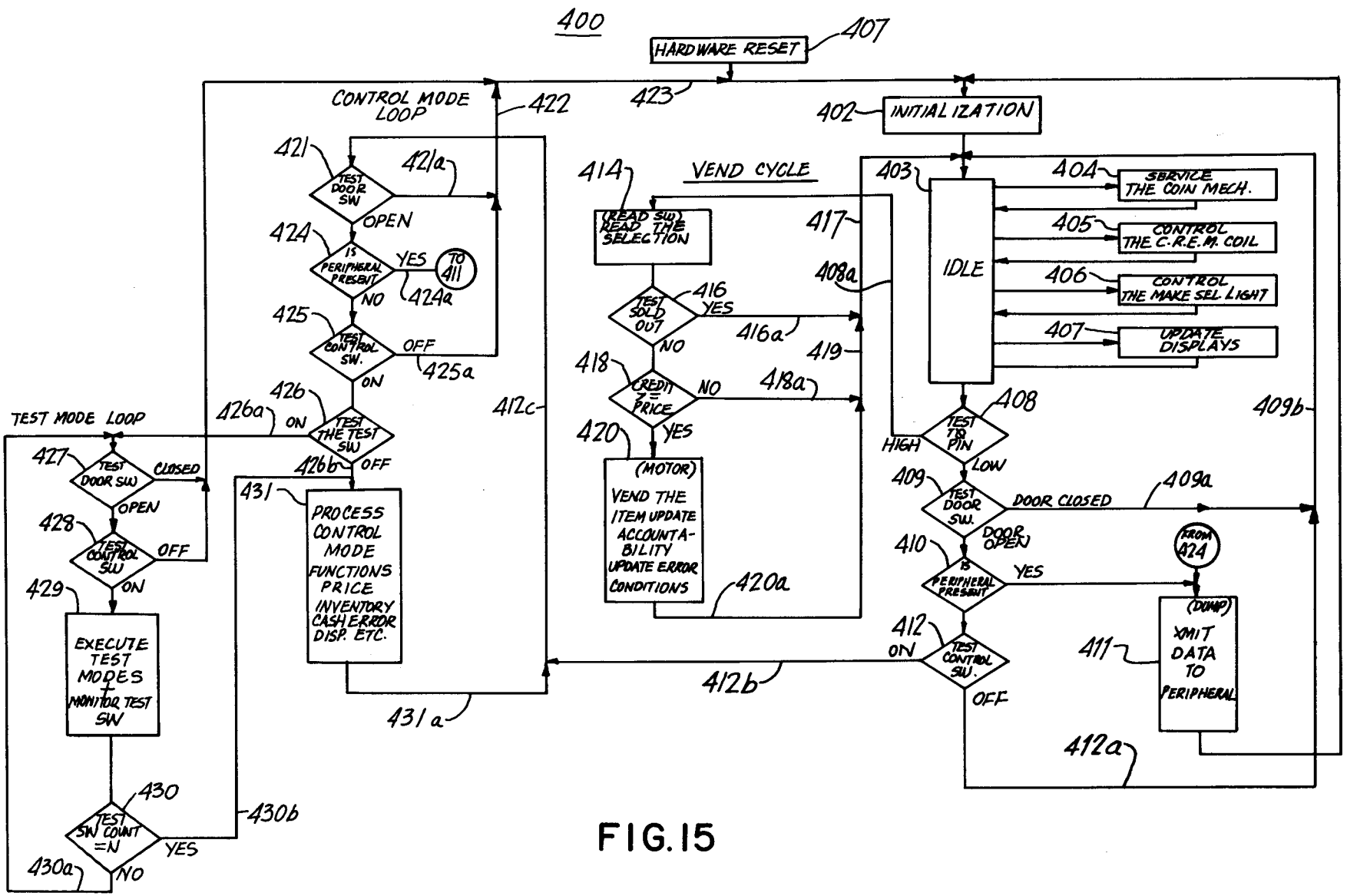

FIG. 15 is a flow diagram illustrating the operation of the present invention under program control.

DETAILED DESCRIPTION OF THE INVENTION

The microprocessor-based system of the present invention may be used to great advantage in a vending machine 10 of the type shown in FIG. 1 which is comprised of a front door 11 having a large viewing window 12 to facilitate viewing of the food items or snacks available to be dispensed. Each item position is provided with a selection and price holder assembly 13 comprised of a holder 13*a* releasably supporting a tag 13*b* having a price and an identifying number. Each of the items displayed within window 12 is adapted to be dispensed by a snack-tray assembly 20, shown best in FIG. 2.

A selection button panel 14 is provided with an array of selection buttons 15 arranged in regular rows and columns. Each button is provided with a different designating letter, each letter corresponding to a letter on one of the identifying tags 13*b*. Thus, in order to make a selection, a user will, during the select-item phase of operation, depress that button whose letter corresponds to the letter associated with the item the user wishes to purchase.

The panel is further provided with a coin-entry escutcheon 17 comprised of a coin-entry slot 17*a*, panels 17*b* and 17*c* which may be illuminated to selectively indicate when the machine is able to make change and when the machine will accept only the exact amount of the purchase, and a coin-return lever 17*d*.

The bottom row 15' of the array of push buttons 15 is positioned immediately above a small display window 18 displaying small snack items such as gum packages 19. The button above each of the gum packages may be depressed to select that brand or type of gum immediately beneath the push button 15' being operated.

As will be more fully described, the food items F are pushed forward toward window 12 and off of the front edge of the shelf upon which they are suppoted such as, for example, the shelf 21, whereupon the items fall into the open region between the forward edge of the shelf and the interior surface of the window 12 where the items F drop by gravity into a delivery bin (not shown) which is just beneath the swingable door 23 adapted to be pushed inwardly to allow the purchaser to remove the vending item.

FIG. 2 shows a typical snack-tray assembly 30 comprised of a supporting shelf 31 and a plurality of vertical dividers 32 arranged to provide a supply region for storing a plurality of each type of snack item. The compartments 33 and 34 can each be seen to be substantially double the width of the compartments 35, 36, and 37. Each of the compartments 35, 36 and 37 is provided with a single helical drive assembly comprised of an elongated helical spring-like drive member 38 secured to an operating shaft 39 at its rearward end, said shaft 39 being driven by motor 40. Although the rearward end of the shaft is shown in FIG. 2, it should be understood that shaft 39 extends forwardly where it is joined with a coupling member (not shown) for coupling shaft 39 to the rearward end of helical drive member 38. Motor 39 is selectively energized to cause rotation of helical member 38 through one full revolution. A package or snack item is positioned between each pitch of the helical member 38. The helical member 38 is driven through one full revolution, causing the forwardmost item to be moved beyond the forward edge of shelf 31 and thereby dropped into the delivery bin, as was previously described. In a similar fashion, every snack item arranged in each pitch of helix member 38 behind the dispensed item is moved forward through the distance equal to one pitch of the helical member 38. The helical members 38 may be either left or right-hand helices.

Bins 33 and 34 which accommodate snack items substantially double the width of those snack items accommodated in bins 35–37, employ both a left and a right-hand helical drive member 38' and 38'', said left and right-hand types cooperating to collectively drive the forwardmost snack item off of the forward end of shelf 31 and simultaneously therewith moving each of the remaining snack items in the forward direction through a distance equal to one pitch of the helical members 38' and 38''. Only a single motor 40' is utilized to drive the helical members 38' and 38'', there being a spiral drive gear assembly 41 to reverse the direction of rotation of helical member 38' relative to helical member 38'' in order to properly drive the snack items F in the forward direction.

It is important to continuously monitor the motors 40 of the snack tray assembly in order to be assured, on the one hand, that merchandise is properly being dispensed and, on the other hand, to be assured that no more than one item is being vended. The manner in which this is accomplished will be described in greater detail hereinbelow.

Turning to a consideration of FIGS. 3*a* and 3*b* there is shown therein the electronic means 50 for operating the vending machine 10. Electronic system 50 is comprised of a microprocessor 51 which may, for example, be an INTEL Model 8035 microprocessor or any one of the INTEL Model 8048 series.

The oscillator which establishes the timing for microprocessor 51 is comprised of precision crystal 52 and capacitors C1 and C2 arranged in electrical circuit with the precision crystal 52 which is coupled across the crystal input terminals of the microprocessor 51.

The microprocessor 51 is powered by a 5 volt regulated DC supply to be more fully described and coupled to its power input terminals.

The T1 terminal receives interrupt signals requiring servicing as will be described in more detail in connection with the programmable keyboard interface circuit 101 shown in FIG. 3*b* and which provides a signal applied to microprocessor input T1 upon operation of one of the front panel switches 15.

The power supply circuit 60 shown in FIG. 6 comprises transformer means 61 adapted to provide separate 12.6 volts and 26 volt AC output signals across outputs 61*a* and 61*b*, respectively. The AC signals are respectively full-wave rectified by the diode bridges 62 and 63. The output of bridge 62 is coupled through Zener diode ZD1 and resistor R1 to the base of transistor Q1, whose collector is coupled to +5 volts DC by resistor R2 and whose emitter is grounded. The common terminal between ZD1 and R1 is coupled to ground through the parallel circuit of resistor R3 and capacitor C4. The circuit path including Zener diode ZD1 is coupled to input 54*a* of one-shot multivibrator 54 shown in FIG. 3*a*. When the power falls below a predetermined level, transistor Q1 triggers one-shot multivibrator 54 to apply a signal through conductor 54*c* to turn on transistor Q2. This will allow capacitor $C_T$ to discharge and the resulting signal applied through inverters $I_1$ and $I_2$ to the reset input $\overline{RST}$ of the microprocessor 51 will cause the same to be reset and held reset for the 60 millisecond period of the one-shot multivibrator 54. When the one-shot multivibrator 54 is triggered, the $\overline{Q}$ output will go low. The signal from the $\overline{Q}$ output or conductor 54*b* is applied to the interrupt input $\overline{INT}$ microprocessor 51 causing the program counter of microprocessor 51 to be forced to a predetermined count which is typically the first program step of an interrupt service routine whereupon RAM memories 66 and 68 are deselected and immediately protected through the low voltage condition. The program counter incorporated in microprocessor 51 typically steps to a count representative of the fourth address location in the programmable read only memory containing the microprocessor operating programs.

One-shot multivibrator 54 is designed to reset the microprocessor 51 and hold it reset for the 60 millisecond output interval thereof when its Q output goed high and triggers transistor Q2, as coupled thereto by conductor 54*c* and resistor R6 to develop a reset signal $\overline{RST}$. The reset input $\overline{RST}$ is developed a few milliseconds after a high appears on conductor 54*c* due to the discharge of the R.C. circuit in the collector path of transistor Q2 and is applied to microprocessor 51 through the series path comprised of resistor R7 and inverters I1 and I2. The program counter of microprocessor 51 is thus reset to 0 in the event that a brown-out or power-out condition occurs and is held reset for at least 60 milliseconds. If power returns, the R.C. circuit will again charge permitting further operation after the 60 millisecond period; however, if power does not return, the R.C. circuit cannot again charge.

Microprocessor 51 has a first and a second group of I/O (input/output) ports P1-0 through P1-7 and P2-0 through P2-7, which I/O ports are utilized to transfer data out of microprocessor 51 or accept data into microprocessor 51 from devices interfaced with said ports.

Ports P2-4 through P2-6 of microprocessor 51 are coupled to a three-line to eight-line decoder circuit 55 which may, for example, be a Model 74LS138 decoder circuit. Binary signals developed by microprocessor 51 during the course of operation are applied to inputs 55*a*–55*c* of decoder 55 to selectively generate a signal at one of its eight outputs 55*d* through 55*k*, said signals being utilized to select and thereby enable only one particular integrated circuit ("chip") for interfacing with the data bus DB of microprocessor 51, said data bus having data bus lines DB0–DB7. The data bus lines DB0–DB7 are adapted to transfer eight-bit bytes to and from the microprocessor 51 in parallel fashion. For example, note that the data bus lines DB0–DB7 are coupled in common to the inputs D0–D7 of a latch circuit 56, the D0–D7 inputs of read only memories (ROMs) 57 and 58 and inputs I0–I3 and outputs O0–O3 of random access memories (RAMs) 66 and 68. Latch circuit 56 may be an integrated circuit of the 74LS273 type. ROMs 57 and 58 may be of the 2716/2316 type while RAMs 66 and 68 may be of the integrated circuit type 51L01.

ROMs 57 and 58 each have address inputs A0–A10 in order to address either the ROM 57 or ROM 58. Microprocessor 51 utilizes the data bus lines DB0–DB7 as well as the outputs P2–0, P2–1 and P2–2 of the second group P2 of I/O ports in order to develop an address code of sufficient bit length. In order to access ROMs 57 and 58, a portion of the address is applied to octal latch 56 while the remainder of the address is applied to the input terminals A8–A10 of both ROM's 57 and 58. The octal latch 56 is then latched by a clock signal applied to its clock input CLK from the $\overline{ALE}$ output terminal of microprocessor 51 to latch the address bits into octal latch 56 during the rising edge of the clock pulse. Terminal P2–3 of the second group of I/O output ports is utilized to select that one of the ROM's 57 and 58 which is to be enabled. The signal on line P2–3 is inverted by inverter I5 whereby the selection of the two ROMs 57 and 58 by microprocessor 51 is mutually exclusive. The select signal is simultaneously applied to both ROMs 57 and 58 by output terminal PSEN of microprocessor 51, causing the eight-bit byte stored at the address applied to address input terminals A0–A10 to appear at output terminals D0–D7 for transfer into microprocessor 51 through the data bus lines DB0–DB7.

RAMs 66 and 68 are selected in a similar fashion for purposes of reading out data or writing data into said RAMs. RAMs 66 and 68 together form a memory for storing 256 8 bit bytes. If desired, said memory may be an EAROM (electronically alterable ROM).

In order to write data into RAMs 66 and 68, a write pulse is developed in write line $\overline{WR}$ by microprocessor output terminal $\overline{WR}$. In addition, the RAMS 66 and 68 are selected by a "chip select" signal CS derived from output terminal 55*g* of decoder 55 (such integrated circuits being commonly referred to as "chips"). A four-bit byte is written into each group of inpus I0–I3 of RAMs 66 and 68, said data being transferred over data bus lines DB0–DB7, following the latching of the desired address into octal latch circuit 56.

Data is read out of RAMs 66 and 68 in a substantially similar fashion except that a read signal developed in read line $\overline{RD}$ by microprocessor output $\overline{RD}$ causes the RAMs 66 and 68 to transfer data from their respective outputs O0–O3 to microprocessor 51 through the data bus lines DB0–DB7.

RAMS 66 and 68 are protected against the loss of data stored therein by providing a backup battery supply 71 having its plus (+) terminal coupled to the +5 volts regulated DC source to diode D2 and further coupled to RAMs 66 and 68 by diode D3. In the event of either a brown-out or failure, the voltage level of battery supply 71 is sufficient to prevent data stored in RAMs 66 and 68 from being lost. This capability is provided in addition to a routine for deselecting the RAM which routine is initiated by a low voltage sensing circuit described hereinabove in order to prevent microprocessor 51 from accessing the RAM during an undervoltage condition.

Terminals P2–0 through P2–3 of the second I/O port P2 are also coupled to the P2–0 through P2–3 of inputs of circuit 73 which is a four line to sixteen line latched I/O port and may, for example, be an INTEL type 8243 integrated circuit. The output line coupled to the PROG output of microprocessor 51 is coupled to the PROG input of the input/output expander circuit 73 and is designed to latch the operation code and port address of the selected one of four I/O port groups P4–P7 during a high to low transition of the signal applied to the PROG input of microprocessor 51. On the low to high transition of said signal, data on port P2 is transferred to the logic block of the specified output port group P4 through P7.

The I/O port group P4–P7 of the expander circuit 73 are adapted to be connected to one of two general types of coin acceptor/changer mechanisms. One type of suitable acceptor/changer mechanism is a semi-intelligent electronic coin acceptor which through an electronic means such as sensing coils accepts or rejects a coin, determining the denomination of an accepted coin and deposits said accepted coin in the inventory tubes or the coin hopper. The coin mechanism then sends an interrupt request to the electronic system 3*a* and 3*b* via I/O expander circuit 73 indicating a coin has been accepted. When the electronic system acknowledges the interrupt and the coin mechanism sends an 8 bit serial data word which tells the electronic system the coin denomination, where the coin has been sent, i.e. the change tubes or cash box and certain other status information including the state of the low level detectors in the coin inventory tubes. The electronic system controls the change making portion of the coin mechanism as well as a "BLOCKER" line which enables or disables the coin acceptor mechanism. This information also enables a monitoring and maintenance of various cash history records and coin tube inventory records as shall be further discussed below.

The second type of coin acceptor/changer mechanism is an electromechanical version as schematically represented in FIG. 5. This type of changer mechanically accepts or rejects the coins, by size and weight, and directs the accepted coin to the appropriate coin switch 93, 94 or 95. By scanning the coin switches 93–95 through leads 96–99, at a sufficiently rapid rate, the electronic system is assured that a coin will not be missed and may maintain the same cash history records mentioned above. The C.R.E.M. coils 81 and 82 serve to disable the acceptance of all coins while inventory tube switches 91 and 92 serve to inform the electronics system that the inventory tube has reached a level known as minimum. Coil 84, motor 87 and motor SN88 are controlled by the electronic system during change making.

FIG. 3*b*, showing the remaining portion of the microprocessor based electronic system for operating and monitoring the vending machine, shows a programmable keyboard/display interface chip which may, for example, be an INTEL type 8279 integrated circuit. Device 101 is utilized in conjunction with microprocessor 51 for sequentially scanning switches of the vending machine to be assured of their proper operation. The electronic system of the present invention has been incorporated within the vending machine 10 which, in one preferred embodiment, comprises a total of 148 switches, 60 of which are selection switches; 60 of which are switches monitoring the interval during which the motors are being operated and 20 of which are miscellaneous switches.

Programmable interface device 101 is selected by the signal $\overline{CS0+1}$ derived from decoder 55 and gate 102 shown in FIG. 3*a*. Data is transferred between microprocessor 51 and programmable interface device 101 through the data bus lines DB0-DB7. The direction in which data is transferred is established by the read $\overline{RD}$ and write $\overline{WR}$ lines. Output $\overline{ALE}$ of microprocessor 51 provides clocking pulses to programmable interface device 101 to synchronize the operation and generate internal timing for the interface 101.

Interface 101 has its scan outputs S0-S3 coupled to three-line to eight-line decoders 103 and 105 and four line to sixteen line decoder 107. Outputs S0-S2 of programmable interface device 101 set up a three-bit binary code for sequentially enabling one of each of the outputs of decoders 103 and 105. Similarly, scan outputs S0-S3 set up a four-bit binary code causing each of the outputs of decoder 107 to go low in a one-at-a-time sequential manner.

Outputs O0-O7 of decoders 103 and 105 are respectively coupled to the scan lines of the selection switches shown in FIG. 4 and to the motor switches 210 to be more fully described in connection with FIG. 9. Only one of the decoders 103 and 105 is enabled at any particular time by microprocessor 51, the chip enable signal being derived from output line P2-7 of microprocessor 51 shown in FIG. 3*a* which is coupled to the switch selection line SW. SEL, which line is coupled in common to the enable input $\overline{EN}$ of decoder 103 and the inverted enable input $\overline{EN}$ of decoder 105 so that the decoders 103 and 105 are selected in a mutually exclusive fashion.

Decoder 107, which is a four-line to sixteen-line decoder, is designed to control both the internal and the external displays of the vending machine. Each of its output lines 00 through 015 is coupled to one of the LED display devices for example as shown in FIG. 10 wherein an array of thirteen such LED display devices 111-123 are provided for selectively displaying status information of the vending machine as will be more fully described hereinbelow. The LED devices 111 through 122 are of the seven segment type capable of displaying any decimal digit from decimal "0" to decimal "9". Each of the LED devices 111-123 is scanned on a one-at-a-time basis at a high repetition rate by decoder 107 so that each LED device is energized during only one-sixteenth of a full scan cycle of decoder 107.

The data necessary to display the appropriate decimal number is derived from the output ports A0-A3 and B0-B2 of the programmable interface 101, these lines being coupled through driver 125 to the displays. The information presented to driver 125 is applied in synchronism with the outputs 00-015 of decoder 107. Thus, although the outputs of driver 125 are coupled to all of the LED display devices 111-123, only one LED device will be energized at any given time in order to be illuminated in accordance with the scan rate of decoder 107. The data presented to driver 125 must be synchronized with the enabled output of decoder 107 in order to place the proper decimal number in the proper display position of the array of display devices 111-123.

The S0 output of programmable device 101 is coupled to the trigger input of a one-shot multivibrator 126. One-shot multivibrator 126 is designed to reverse the level of its $\overline{Q}$ output **126*b* to disable decoder 107 from operating if scan pulse S0 is not repeated at least as frequently as every two milliseconds. This arrangement prevents the display elements 111-123 from being burned out in the event that decoder 107** stops scanning and locks in on one output due to a fault condition within the system electronics.

The outputs 00-02 are presented to LED display devices 111-113 which are arranged upon the front panel of the vending machine for displaying the total credit of the person presently operating the machine.

Octal latch 130 has its inputs D0-D7 coupled to the data bus lines DB0-DB7. The clock input C of octal latch 130, coupled to the output of gate 132, latches the eight-bit byte presented to its input terminals in the presence of chip select signal $\overline{CS4}$ and write signal $\overline{WR}$ to selectively illuminate one or more of the front panel lights which are appropriate for illumination depending upon machine status and the phase of the program presently being performed, said panel lights being for the purpose of illuminating panels including indications, such as DEPOSIT COIN; EXACT CHANGE ONLY; MAKE ANOTHER CHOICE; and MAXIMUM CREDIT. A more detailed description of this arrangement will be set forth hereinbelow.

As was mentioned hereinabove, the vending machine is provided with a group of gum selection switches 15'. Switch means (not shown) are provided in each gum dispenser to ascertain when these gum selections have been sold out, the switch closure conditions appearing at input terminals 135-139 when line 140 which is the select line $\overline{CS5}$ is enabled to provide status data of all of the gum dispensing stations. This status data is transferred through the buffer circuits 142-144, 147 and 148, when enabled by gate 150 in order to transfer this status data to the microprocessor 51 by way of data bus lines DB0-DB7. The control switches such as, for example, those shown in FIG. 10 and which will be more fully described hereinbelow, are similarly coupled through the buffer circuits 141-148 in a multiplexed fashion depending upon which select signal is present, i.e. $\overline{CS6}$ or $\overline{CS5}$, for enabling one of the respective arrays of control buttons, as will be more fully described.

As was mentioned hereinabove, decoder 105, when selected, scans the selection switches in the selection switch pushbutton array 14 shown in FIG. 1 for the purpose of determining which of the switches has been operated. A signal is coupled to the switches on a column-by-column basis and the switches within the column which have been closed transmit signals through the lines 171-179 shown in FIG. 3*b*. The switch array 190 is shown in FIG. 4 and is comprised of the scan lines S0-S7 which are respectively coupled to the output lines 00-07 of decoder 105. Only one column line is enabled at any given instant. Each column line is coupled in common to all of the switches in one column of the front panel switch array and motor switches 190 comprised of columns COL1-COL8. Each column conductor is coupled to an associated switch arm SWA through a diode D. Each switch arm SWA is adapted to be selectively engaged with a stationary switch terminal T there being a stationary switch terminal T coupled to each of the row conductors ROW0-ROW7 in the manner shown in FIG. 4. Let it be assumed that a scanning signal is applied to scan line S0 thereby energizing the COL1 conductor. Any of the switch arms SWA electrically connected to the COL1 conductor will complete an electrical circuit through its associated row winding ROW0–ROW7 when closed. COL2 conductor is scanned next, followed by COL3 conductor, and so forth with the switch closures being presented through the row conductors ROW0–ROW7 to the lines 172–179 coupled to the read line inputs RL0–RL7 of the programmable interface circuit 101, which stores data representing the closed switch and generates interrupt request signal IRQ.

The additional change switch CSW, when closed, provides signals to the shift input of programmable interface 101 for the purpose of storing a shift input status condition, which is stored along with any switch closure conditions when a scan pulse is applied to the COL1 conductor. Diodes D are provided to prevent erroneous switch closure information from being fed back to the microprocessor 51 in the event of multiple switch closures in a single column conductor.

As was mentioned hereinabove, programmable device 101 continuously generates scan pulses S0–S3 which causes sequential development of signals at the outputs O0–O7 of either decoder 103 or 105, said outputs being respectively coupled to the row lines of the selector switches 14 (FIG. 1) and the row lines of the motor switches 210 (FIG. 9). The inputs A, B, and C and G2A of a three-line to eight-line decoder 202 (FIG. 7) are coupled to I/O ports P1-7 through P1-4 while the remaining four inputs P1-3 through P1-0 are coupled to inputs A, B, C and G2A of three-line to eight-line decoder 204.

Decoders 202 and 204 decode each three-line input coupled thereto to enable one line of its eight-line output when its enable input G2A is enabled. The output lines of decoder 202 are coupled to the row lines ROW-0–ROW7. Each row line is coupled to input MD1 of a motor drive circuit MD.

Decoder 204 has its eight output lines O0–O7 coupled to the column lines COL0–COL7, each such line being coupled to input MD2 of each motor drive unit MD coupled to the associated column line.

Each of the motor drive circuits MD is either of the type adapted to operate an AC motor or is of the type adapted to operate a DC motor. FIG. 8*a* shows a motor drive circuit MD-AC adapted for operating an AC motor while the motor drive circuit MD-DC shown in FIG. 8*b* is utilized to drive a DC motor.

Motor drive circuits MD-AC is comprised of a light emitting diode element LED, a bidirectional light sensing switch element LSD and a bidirectional triac TR. The DC type motor drive is comprised of a similar light emitting diode LED and a light sensing switch element LSD but is provided with a unidirectional SCR TRU. In order to energize the LED of the desired motor drive circuit MD-AC, signals of the proper polarity are applied to input terminals MD1 and MD2 illuminating the LED which operates the light sensitive switch element LSD to close, causing the bidirectional triac TRB to drive an AC motor.

In a similar fashion, a voltage of the proper polarity applied to inputs MD1 and MD2 of a DC control MD-DC causes the LED to illuminate and to establish a circuit path between the motor power supply circuit terminal MTR PWR and the motor associated with the motor drive circuit MD through the SCR TRU. One output terminal of the twenty-four volt motor supply is coupled in common to one terminal of every motor drive circuit MD. However, the output terminal MD4 of each motor drive circuit MD is coupled independently to its associated motor, the opposite terminal of the motor being returned to the twenty-four volt power supply. In this manner, it is possible to selectively energize any one of a maximum of 64 motors through the arrangement shown in FIG. 7.

Each motor operated by one of the motor drive circuits MD shown in FIG. 7 is provided with a sensing means 208 shown in FIG. 9 and comprised of a cam 209 and microswitch 210. Microswitch 210 is provided with a switch arm 210 and a resilient "skid" member 210*b*. As was mentioned hereinabove, in connection with FIG. 2, each of the motors 40 is provided with an output shaft 39 upon which cam 209 is mounted. Microprocessor 51, energizes one of the motor drive units dependent upon the particular food item to be dispensed, said unit being energized to enable shaft 39 to rotate through one full revolution. Correct operation of the motor so energized is ascertained during a scanning technique in which the condition of the switch 210 for each motor is scanned. The energization of the motor rotates its associated cam 209 to move skid 210*b* and hence switch arm 210*a* to close switch 210. Switch 210 remains closed during almost the entire revolution of the drive motor 40. In the event that the switch 210 of the motor which has been energized is open, this indicates a malfunction of the motor.

The switch 210 of those motors which have not been energized are also sensed during the scanning operation. The closing of a switch occurring during the time that its associated motor has not been selected to be energized, serves as an indication that the motor associated with said closed switch has jammed or otherwise malfunctioned and has done so in a position other than the normal start position of the motor.

Each time a proper vend operation is initiated and completed by the Microprocessor 51, registers therein for maintaining a count of vends of that item which have taken place both on a historical basis and in a collection-to-collection basis are incremented in the same manner as the registers maintained for keeping track of cash. In this manner, appropriate accounting registers are updated each time a vend takes place. Should a vend failure occur as indicated by the switches monitored, a "Make Another Selection" lamp is lit. Should monitoring of these switches disclose a multiple vend, the operation of the vending machine is shut down to await service.

Turning again to a consideration of FIG. 10, as was described hereinabove, the front panel cash display including LED display elements 111, 112 and 113 is arranged on the front panel of the vending machine as shown in FIG. 1. The status display comprised of display elements 114–123 is arranged at a convenient location behind door 11, as is a free play switch, not shown, for allowing free selections. Access to the interior of vending machine 10 is limited to authorized personnel holding a key to lock 16. By opening door 11, it is possible to replenish the stock of items vended, to actuate the free play switch and to closely observe the various components of the vending machine to assure proper operation. In order to greatly facilitate such periodic maintenance, the microprocessor 51 is further utilized to create displays upon the array comprised of display elements 114-123. The variety of information capable of being displayed comprises:

I. The Cash History, which is displayed by display elements 114–121 and represents the amount of cash taken in since the machine was installed.

II. Cash collection-to-collection display which is presented by display elements 114–119 and which represents the total amount of cash taken in by the machine since the last time the coin hopper was emptied.

III. Maximum cash price which is displayed by display elements 114–116 and which represents the maximum cash value, from $0.05 to $9.95, beyond which maximum value the changer refuses additional coins.

IV. The number of Historical Vends is displayed by display elements 116–120 and represents the total number of items vended per item. Corresponding thereto, the display elements 121–123 display the identity of the vended item by way of the number assigned to such item. The number is displayed by display elements 121 and 122. Elements 123 which is a LED dot matrix display element comprised of a LED display device having dot-like elements arranged in a four column by six row matrix is adapted to display a letter representing the particular item being displayed such as, for example, "M" for motor; "S" for the selection switches; "C" for a control panel switch; and so forth.

V. The number of Vends Collection-to-Collection. The total number of units of each item vended since the last collection is displayed by display elements 116–118. The particular item is identified by display elements 121-123. In the event that a particular dispensing mechanism, such as motor 40, has failed between the last collection and the present collection, display elements 119-121 are illuminated to present the display "ERR" to indicate a failure in the particular dispensing device upon a vend request. The display developed by display elements 116–118 represent the number of vends of said dispensing device before the present failure condition.

Each of the above items capable of being displayed is selected at the option of maintenance personnel by means of the pushbutton control panel 230 comprised of the array of pushbuttons 236-242 and the control/run switch means 246. Each of the buttons 231-236 are adapted to cause the display functions set forth as functions I-V hereinabove. For example, to obtain the Cash Historical display, pushbutton 231 is depressed; to obtain the Cash Display Collection-to-Collection, pushbutton 231 is depressed in combination with forward pushbutton 242; and so forth. In the event that pushbutton 234 is operated, the first item of the array will be displayed. By depressing the forward pushbutton 242, each item will be displayed for a period of the order of 0.70 seconds before displaying status information for the next item. In order to more rapidly change the display from item to item in the forward direction, pushbuttons 242 and 240 are simultaneously depressed whereupon each item is displayed for a period of only 0.20 seconds, enabling an operator to observe the status of the times within the selected category of status information at a more rapid rate.

In the event that it is desired to switch from item to item in the reverse order, pushbutton 241 is depressed causing the items to change at the rate of 0.70 seconds. If it is desired to change from item to item at a faster rate, pushbuttons 240 and 241 are simultaneously depressed causing the display of each item to persist for an interval of only 0.20 seconds before displaying the status of the next item.

By depressing pushbutton 236, it is possible to set or alter the price of an item. Each item is displayed by depressing pushbutton 236 wherein the price is displayed by elements 114–116 and the item having that price is identified by display elements 121–123. By releasing either of the buttons 242 or 241, the display will stop at the item being displayed at the time that the button is released whereupon the price of the item may be changed in increasing $0.05 increments by depressing the increase price button 238. The price will be increased by $0.05 increments at the rate of 0.07 seconds. If it is desired to alter the price at a faster rate, pushbuttons 238 and 240 are depressed causing the price increments to increase at a rate of 0.20 seconds.

If it is desired to decrease the price, the decrease price button 239 is depressed causing the price display to be altered by $0.05 increments at a rate of 0.70 seconds. In the event that it is desired to more rapidly reduce the price of the item, pushbuttons 239 and 240 are simultaneously depressed, causing the $0.05 incremental change to occur at the rate of 0.20 seconds. By releasing the depressed pushbuttons 238 or 239, the last price change displayed will be retained in memory.

Microprocessor 51 is also capable of providing other status information which is obtained by moving Control/Run switch 246 to the left, i.e. to the Control position, and selectively depressing the test switch. This automatically develops a status display mode comprised of five phases which are as as follows:

I. Lamp Test—The microprocessor 51 alternately illuminates the front panel credit display, each of the front panel lamps and the control panel digits.

II. Front Panel Switch Test—Upon a second closure of the test switch, the microprocessor 51 sequentially displays the letter and number of any closed front panel switch. If no switches are closed, display elements 123 and 122 generate the display "S0".

III. Motor Switch Test—Upon a third closure of the test switch, microprocessor 51 steps to Phase III, in which the letter and number of any closed motor switch is displayed by elements 123 and 122. If none of the motor switches are closed, the display "M0" will be presented by display elements 123 and 122.

IV. Control Panel Switch Test—A fourth depression of the Test Switch causes the microprocessor 51 to display at postions 121-123 the letter "C" and a number "1" through "12" identifying any control panel switch which may be stuck in a closed position. In the event that the control panel switches are all open, microprocessor 51 causes a display "C0" to be presented.

As one example of the above phase control operations, the front panel lights are sequentially tested by causing the programmable interface circuit 101 (see FIG. 3*b*) to be selected by microprocessor 51 (see FIG. 3*a*). Microprocessor 51 also generates chip select signal $\overline{CS4}$ and the write $\overline{WR}$ causing gate 132 to select decoder 130. The data bus lines DB0–DB7 are enabled to cause each output line Q0–Q7 of decoder 130 to be enabled on a one-at-a-time basis. Each lamp may remain illuminated for a period sufficient to allow each lamp position to be visually observed thus providing a visual display of the front panel lamps to assure their proper operation.

The control switches are scanned in a similar fashion.

Although it is quite useful to display status information to service and/or collection personnel, it is also quite valuable to simply and accurately present such data in the form of a visually observable or machine readable form such as, for example, a hard copy print out and/or a magnetic record of the status data in the form of a magnetic tape, floppy disc or static memory device such as a random access memory (RAM).

In order to transfer data in a simple, accurate and high speed manner, microprocessor 51 (see FIG. 3*a*) includes a sub-routine which is adapted to bidirectionally communicate with an off-line device provided for data collection. Considering FIGS. 3*a* and 3*b*, microprocessor 51 periodically examines the signal level on line DB0, which changes when the off-line device is aligned with the vending machine LED263 and photoresistor 265. When the level on data bus line DB0 changes, the output of gate 260 applies a signal to input 262*b* of flip-flop 262 causing its Q output 262*c* to go low. This signal is identified as a transmit signal XMIT which is coupled to a light emitting diode 263 causing light emitting diode 263 to be turned off and on to transmit binary data. A light sensitive transistor 265 is coupled to the Data Bus line DB0 and operates to change the level on Data Bus line DB0, responsive to the operation of the off-line unit in a manner to be more fully described. Considering FIG. 13, light emitting element 263 and light sensitive element 265, which is preferably a phototransistor, are positioned behind a protective lens 267 provided at a convenient, accessible location within the interior of vending machine 10 and behind door 11 or on the face of the door as indicated by the dashed block in FIG. 1. The remote unit 270 (see FIG. 14) to be interfaced with the microprocessor 51, is comprised of a main housing 271 which contains a microprocessor 292, memory 298 and associated circuitry as will be described in detail in connection with FIGS. 11 and 12, and further includes a coupler housing 272 containing an LED element 274 and a phototransistor 276, which elements are positioned behind lens 278 shown in FIGS. 13 and 14. A second LED 301 (FIG. 11) positioned behind window 272*a* serves to indicate when the transfer of data is completed, as will be more fully described. The components in coupling housing 272 are connected to the electronic control system in main housing 271 through cable 279. Microprocessor 292 may be an INTEL Type integrated circuit. While a two-piece housing is shown in FIG. 14, a single housing could also be employed. In addition, a storage media, such as a tape or cassette could be relied upon to record data obtained.

LED 263 in vending machine 10 is normally maintained energized so that it is constantly transmitting light. By aligning lens 278 with lens 267 so that the exterior surface of lens 278 rests upon the exterior surface of lens 267, the light constantly emitted by LED 263 is picked up by phototransistor 276. Noting, for example, FIG. 11, the receipt of light from LED 263 causes phototransistor 276 to conduct. The conduction of phototransistor 276 develops a voltage drop across resistor R15 sufficient to cause transistor 284 to conduct. Capacitor C20 which is normally fully discharged, is caused to rapidly charge through the circuit path comprised of the emitter-collector path of transistor 284 and diode D20. When the positive terminal of capacitor C20 reaches a predetermined threshold level, transistor 286 is caused to conduct. The collector electrode of transistor 286 is brought substantially to ground potential causing a voltage drop to be developed across resistor R20 sufficient to cause transistor 288 to conduct. The conduction of transistor 288 couples the battery supply 290 to terminal +CONT which is coupled to the cathode of diode D21 and to the power terminals Vcc and Vdd of microprocessor 292. The +CONT terminal is also coupled through resistors R23 and R24 to the inputs $\overline{SS}$ and $\overline{INT}$ of microprocessor 292 to remove the signal level causing microprocessor 292 to advance through program steps in a "single step" mode and to disable the microprocessor Interrupt.

When the battery source 290 is coupled to microprocessor 292, its reset input $\overline{RST}$ is initially maintained low near ground potential due to capacitor C23 which is coupled between the $\overline{RST}$ input and ground. This low input causes the program counter (not shown) in microprocessor 292 to be set to program step "0" at which time microprocessor 292 performs certain "houskeeping" functions such as, clearing random access memory device 296 and 298 which are substantially identical to the random access memory devices 66 and 68 shown in FIG. 3*a*.

When transistor 286 is turned on, it also couples a low level signal to the chip enable inputs $\overline{CE1}$ of random access memories 296 and 298 coupled thereto through bus 299, thereby enabling random access memory devices 296 and 298 to be written into.

Microprocessor 292 ultimately steps to that step of its program which causes a low level signal to be developed at output port P2-0 to turn on transistor 296. The conduction of transistor 296 causes LED 274 to be turned on and simultaneously causes LED 301 to be turned on. LED 301 is positioned behind window 272*a* in coupler housing 272 and is illuminated to indicate that a communications cycle is presently in progress.

The energization of LED 274 causes light to be passed to phototransistor 265 through the lenses 278 and 267 (see FIG. 13). The light picked up by phototransistor 265 is coupled through buffer 303 to data bus line DB0. Microprocessor 51 periodically scans data bus line DB0 to look for a transmit request signal and, upon noting the transition level present on Data Bus line DB0, acknowledges this condition as a "ready to receive" signal derived from microprocessor 292 of the off-line unit 270. As a result, microprocessor 51 enters into a data transfer subroutine in which data is transmitted in serial fashion to off-line unit 270 in conventional teletype fashion wherein each data word is comprised of a one millisecond start bit, 8 data bits each of one millisecond duration and a one millisecond stop bit. The start bit is low and the stop bit is high while the data bits may be either high or low depending upon their binary state.

The first byte transmitted by microprocessor 51 comprises an 8 bit byte representing, in binary fashion, the number of status words to be transmitted from microprocessor 51 to microprocessor 292. This byte is stored in the working memory of microprocessor 292 and is compared against a byte counter of microprocessor 292 in order to establish when transfer of all of the status words is complete.

After transmission of the data byte representing the number of status words to be transmitted, microprocessor 51 transmits each status word over the transmit line XMIT. This is accomplished by transmitting each start bit, eight data bits and a stop bit to the D input of type-D bistable flip-flop 262 and applying a clock pulse to the clock input whereupon the $\overline{Q}$ output 262*c* of flip-flop 262 follows the level present at the D input upon receipt of each clock pulse. The binary 1 and binary 0 levels are transmitted in the form of turning on and turning off LED 263 for one millisecond intervals. These signals are received by phototransistor 276 which functions to control the conductivity of transistors 276 and 284 as the light from LED 263 (FIG. 3*a*) is respectively cut off and turned on. The signal levels are applied from the collector of transistor 284 to input port P1-0 of microprocessor 292. The serially transmitted data is converted into parallel form by microprocessor 292. Although the level at collector transistor 284 is caused to drop, possibly for periods as long as 9 milliseconds, the capacitance of capacitor $\overline{C20}$ and the reverse polarity connection of diode D20 prevents capacitor $\overline{C20}$ from discharging to a level sufficient to turn off transistors 286 and 288. The use of the circuitry described assures the delivery of sharp pulse levels to input P1-0 of microprocessor 292. In the event that a malfunction occurs, capacitor C20 will discharge to turn off the transistors 286 and 288. When the collector of transistor 286 thus goes high, RAMS 296 and 298 are deselected thereby protecting the data transferred to random access memories 296 and 298.

Each byte transmitted in serial form to microprocessor 292 is converted to parallel form. Microprocessor 292 picks each address location in memories 296, 298 in succession, applies the binary word representing said address location to octal latch 320, and develops an output signal at its output $\overline{ALE}$ to enable transistor 322 to apply a clock pulse to clock input CK of octal latch 320 latching the address word therein. Thereafter, microprocessor 292 applies the status word to be stored in memory 296, 298 to its data bus lines DB0-DB7, lines DB0-DB3 being written into random access memory 296 and lines DB4-DB7 being written into input line I0–I3 of random access memory 298. Microprocessor 292 develops a write pulse at its write output $\overline{WR}$ which is applied to the read/write terminal R/W of both random access memories 296 and 298. The random access memories 296 and 298 are capable of storing four bit bytes, collectively forming a 256 by eight memory capacity.

After a status word is written into memories 296 and 298, the next status word is transmitted to microprocessor 292 in serial fashion, is converted by microprocessor 292 in parallel fashion and is written into the next memory location. Microprocessor 292 employs one of its working memory locations as a counter. By incrementing the count in said counter by one each time a status word is written into random access memories 296–298. This count is compared against the count originally received from the vending machine microprocessor 51 each time it is incremented. As soon as these counts are equal, microprocessor 292 removes the high level from its output P2-0 causing transistor 297 to be turned off and simultaneously causing LED 274 and 301 to be deenergized. By observing the window 272*a* provided in coupling housing 272 shown in FIG. 14, the operator is made aware of the fact that data transfer from vending machine 10 to the off-line unit 270 is completed when the LED 301 behind window 272*a* is turned off. Even assuming a transfer of data equivalent to the full capacity of memories 296–298, such data transfer is completed in less than 3 seconds.

Status data may also be transferred from the vending machine 10 to an off-line unit utilizing a printer, for example, of the type shown in FIG. 12.

In the off-line unit 350 shown in FIG. 12, microprocessor 380 is normally powered due to the power requirements of the printer 460 controlled thereby. When it is desired to use the off-line unit, switch 55 is closed causing the power supply unit 370 to develop regulated 5 volt and 24 volt DC outputs.

Microprocessor 380 is thus turned on and enters into an initialization program where it performs normal housekeeping functions including the clearing and resetting of the microprocessor working memory and registers (not shown).

When light sensitive element 351 receives light from LED 263 provided in the vending machine (FIG. 13), a signal is applied to input port P0-0. The microprocessor 380 generates a signal at its output port P-0 which turns on transistor 384 causing light emitting diode 386 (similar to light emitting diode 274 of FIG. 13) to transmit a "ready to receive" signal to the vending machine which is picked up by phototransistor 265.

In a manner described hereinabove, the vending machine microprocessor 51 periodically examines Data Bus line DB0 and upon recognizing a level change in this data bus line, interprets the signal transition as a "ready to receive" signal which causes microprocessor 51 to transmit data words in serial fashion which constitute a low start bit of one millisecond duration; eight data bits each of one millisecond duration and a high level stop bit of one millisecond duration. The signals are applied to input port P0-0 of microprocessor 380 which converts the data into parallel form. The parallel data byte is then applied to a memory (not shown) provided in microprocessor 380 which is preferably of the read only memory type for converting each data word into seven bit dot pattern bytes, five such dot pattern bytes collectively forming a five by seven dot matrix character.

The characters are formed by printer 460 which sequentially prints each of the dot column patterns, five such dot column patterns collectively forming a single character. The particular dot column pattern to be printed is determined by the print signal transmitted from the printer line position circuit (not shown) to the print sync input T0 of microprocessor 380. Upon the occurrence of each print signal, microprocessor 380 selects the next seven bit dot column byte from the character generator read only memory for application to the seven print wires of the dot matrix printer (not shown) coupled to output lines PW1–PW7. As soon as the printing of a character is completed, microprocessor 380 provides blanking signals to the print wires to provide a space between each character.

The printer 460 is designed to have its printing element (not shown) scan across an entire line regardless of the fact that the characters may or may not be printed at any particular column position. The printer 460, as is conventional, is provided with an end of print sensing device (not shown) which, when the printing element reaches the right-hand margin, generates an end of line signal which automatically develops a carriage return and line feed signal causing the printer 460 to advance the paper web 461 to be advanced through a distance of one line and causing the printer 460 to return the printing element to the left-hand margin in readiness to initiate printing of the next line. The end of line signal is applied to the line sync input for application to input port P0-1 which prevents microprocessor 380 from initiating printing of the next character until the line sync signal terminates at which time microprocessor 380 is thus advised that the printer 460 has advanced the paper web to the next line and the printing element is returned to the left-hand margin in readiness for printing the next character. The printing element is preferably a print head of the dot matrix type having seven reciprocating print wires (not shown). The signals for energizing the wires are derived from lines PW1-PW7.

In the off-line unit 350 of FIG. 12, printing is terminated simply by terminating transmission of data from microprocessor 51 to the microprocessor 380 of off-line unit 350.

While the actual operational details of the processing and modes of control exercised by the microprocessor 51 will be best appreciated upon an examination of the exemplary, annotated program therefor as attached hereto as the Appendix, a general appreciation for the modes of operation of the instant invention and the manner in which the same are implemented under program control may be obtained from FIG. 15 which illustrates system operations in terms of a generalized flow diagram. It will be understood, however, that the actual details of the program per se will be ascertained by a review of the Appendix and that many variations and modifications of the specific program set forth will be available to those of ordinary skill in the art depending upon the preferences of the program and the design objectives thereof.

FIG. 15 shows a generalized flow diagram 400 of the program routines and sub-routines performed by microprocessor 51 to control the operations of vending machine 10. The various routines of the vending machine microprocessor 51 will now be described in conjunction with the aforesaid flow diagram 400 and making reference to one or more of the FIGS. 1-14.

A hardware reset of microprocessor 51 occurs when Zener diode $\overline{ZD1}$ of FIG. 6 detects the presence of less than 7 volts DC, causing transistor Q1 to be cut off and developing a power down signal PWR DWN which is applied to trigger input 54*a* of one-shot multivibrator 54 shown in FIG. 3*a*. Output 54*c* of one-shot multivibrator 54 will thus go high for the 60 millisecond duty cycle of one-shot multivibrator 54 while the output thereof on conductor 54*b* goes low. The high on conductor 54*c* causes transistor Q2 to conduct, to discharge the capacitor $C_T$ and apply a signal to the reset input terminal RST which resets microprocessor 51, causing the program counter (not shown) provided in microprocessor 51 to be automatically advanced to a predetermined count, Microprocessor 51 remains in the reset state until the rest signal is removed at the end 60 millisecond duty cycle of one-shot 54 and a recharging of capacitor $C_T$ occurs.

In the event that the undervoltage condition persists for more than 60 milliseconds, the delay period of one-shot multivibrator 54, the capacitor $C_T$ will not charge and the microprocessor remains reset. When the one-shot 54 is triggered, the Q output thereof connected to conductor 54*b* immediately goes low. This output is applied to the not interrupt intput $\overline{INT}$ of microprocessor 51 to force the program counter to address 3 as an interrupt. This is the first program step of an interrupt service routine and automatically deselects the random access memories 66 and 68, preventing an erroneous selection thereof during an undervoltage condition to thereby immediately protect valuable information previously stored in random access memory units 66 and 68. The battery supply 71 provides standby power to RAM's 66 and 68.

When the voltage level applied to Zener diode $\overline{ZD1}$ exceeds 7 volts and the capacitor $C_T$ charges, the reset input signal applied to the reset input $\overline{RST}$ of microprocessor 51 is removed and the program counter may advance to the first program step for the initialization sub-routine. This is accomplished by advancing the program counter to a predetermined program step after which the remaining steps are called out of PROMs 57 and 58 for the purpose of performing the aforesaid housekeeping functions including clearing certain memory locations in RAMs 66 and 68 and setting up the I/O ports of microprocessor 51.

After initialization is complete, microprocessor 51 enters into the Idle loop 403. Microprocessor 51 remains in the Idle loop unless it is processing and continues to examine certain hardware and circuitry within the vending machine 10 to ascertain if any servicing or control is required. The said machine hardware and circuitry is periodically examined until they require microprocessor attention at which time microprocessor 51 enters into the appropriate sub-routine to attend to the matter at hand.

Having once entered into the Idle loop, the first phase of the sub-routine causes the microprocessor 51 to service the changer device shown in FIG. 5. In this sub-routine of the Idle loop, microprocessor 51 selects I/O port 73 shown in FIG. 3*a* to determine whether the coin mechanism requires servicing. At this time the I/O port 73 shown in FIG. 3*a* is selected to interface with the hanger mechanism. In the event that an electronic changer is employed, the microprocessor looks for an interrupt signal. In the event that a mechanical type changer is employed, for example, changer 80 as shown in FIG. 5 of the application, switches 93, 94 and 95 are examined to detect the fact that coins have recently been deposited. This is accomplished by placing a signal upon common line 96 and examining each of the lines 97-99 to establish if any switch closures are present, thereby establishing what coins may have recently been deposited. For the next phase 405, in the event that coins have been deposited, the signals representing the denomination of these coins by virtue of the closed switches, causes microprocessor 51 to add the denomination of the coin just deposited to the present count, which count is stored in a predetermined location in memory. The count is also displayed on the front panel of vending machine 10 by LED display elements 111-113 to advise the user of the count. The stored count continues to be updated as additional coins are deposited. Each time the last coin denomination is added to the present count, this count is compared against the maximum amount acceptable by the machine, said amount being stored in another location in memory whereupon, when this amount is reached or exceeded, microprocessor 51 deenergizes the coin return eject mechanism coils 81 and 82 and energizes coil 84. The deenergization of coils 81 and 82 prevents further coins inserted into the mechanism to be evaluated. Energization of coil 84, by application to a signal to line 85, causes a pin (not shown) in the mechanism to be moved to a deflect position causing any further coins inserted into the coin slot 17*a* (see FIG. 1) to be deflected away from the coin evaluation slot and coin inventory tubs or hopper coin hopper (not shown for purposes of simplicity) and into the coin return hopper 17*c*. The disposition of coins in the individual coin inventory tubes (not shown) or the coin hopper cash box is also here controlled and if coins are placed in the coin return tubes the inventory count therefor is updated. Microprocessor 51 operates programmable interface circuit 101 which selects decoder 107 and segment display driver circuit 125 to operate the front panel cash display comprised of segmented elements 111-113 shown in FIG. 10 and in FIG. 1 to display the amount of money which has been deposited into the vending machine 10.

Phase 405 of the Idle loop represents the deenergization of the coin return eject mechanism coils 82 and 83.

In the event that no coins are deposited when the coin changer mechanism 80 is examined, microprocessor 51 automatically steps to the next phase 406 of Idle loop 403 whereupon when at least the smallest amount of cash suitable for purchasing the least expensive item has been deposited, the program illuminates the MAKE SELECTION lamp by selecting decoder circuit 130 shown in FIG. 3*b*. This phase includes a comparison of the cash deposited amount against the amount of the least expensive item capable of being dispensed, which amount is stored in a predetermined location in memory, and if the amount deposited into the coin changer is equal to or greater than this amount, microprocessor 51 causes the MAKE SELECTION lamp to be illuminated. Although not shown for purposes of simplicity, the illumination of the MAKE SELECTION lamp is accomplished in a manner similar to that in which the motors 49 described hereinabove are selectively energized. More particularly, an opto-isolator ciruit is employed, which opto-isolator circuit comprises a light emitting diode LED similar to that shown in FIG. 8*a*. The LED is illuminated, causing the conduction of a light sensitive triac for turning on the MAKE SELECTION lamp. This electrical isolation circuit enables low level signals to be utilized for control while utilizing signals of greater power for operating motors, lamps and the like.

The next phase 407 of the Idle loop 403 comprises a group of program steps entered into for the purpose of updating machine displays which are called for in response to the last previous action taken such as the GUM SOLD OUT lamp, the EXACT CHANGE lamp and the credit display. As was previously described, the credit display is operated in a multiplexed fashion while the other front panel display lamps are continually lit. The GUM SOLD OUT lamp is illuminated when an examination of the SOLD OUT switches for the associated gum vending position has closed. The exact change lamp is illuminated when the vending machine 10 no longer contains coins sufficient for providing change in the coin tubes. The credit display is illuminated based upon the number of coins deposited in the machine by the user or what remains after a selection operation has occurred.

The next phase 408 of idle loop 403 constitutes a test of the T0 pin which results when one of the selection switches in switch array 15 (see FIG. 1) is depressed by someone operating vending machine 10. The switches are scanned by the programmable interface circuit 101 in the manner previously described. When a switch closure is present, programmable interface circuit 101 detects this condition and develops an interrupt request signal at its output IRQ, which signal is applied to the T0 input of microprocessor 51 shown in FIG. 3*a*. The T0 input is tested during phase 408 of the idle routine. In the event that a switch closure has not taken place, the level at the T0 input of microprocessor 51 will be low causing microprocessor 51 to step to the next phase of the Idle loop which tests the door switch (not shown) of the vending machine door 11 (see FIG. 1). In the event that door 11 is closed, microprocessor 51 returns to the initial step of the Idle loop 403 as represented by lines 409*a* and 409*b*. The Idle loop continually repeats itself every 2.5 milliseconds, examining each of the circuits described hereinabove to ascertain if any action is necessitated.

In the event that the vending machine front door 11 is open during the test door switch phase 409 of the Idle loop 403, a door open signal causes microprocessor 51 to jump to step 410 in the stored program to ascertain if a peripheral (i.e. off-line) device is present. In accordance with the description set forth hereinabove, the Data Bus line DB0 is examined to ascertain the presence of a level transition. In the event that an off-line device is present, microprocessor 51 branches to the transmit data to peripheral sub-routine 411 whereupon all the data stored in memory is transferred to the off-line device in the manner described hereinabove. Microprocessor 51 then leaves sub-routine 411 and enters into the initialization sub-routine 402 discussed hereinabove.

In the event that a peripheral unit, such as unit 270 (FIG. 14) is not present, microprocessor 51 branches to the test control switch program step 412 whereupon the control switch 246 shown in FIG. 9 is examined. In the event that the test control switch 246 is in the run position, indicative of the fact that normal operation of the vending machine 10 is requested, microprocessor 51 returns to the initial program step of the Idle loop 403 as represented by lines 412*a* and 409*b*.

In the event that the test control switch 246 of FIG. 10 is in the control position (i.e. ON), microprocessor 51 jumps to the control mode loop as represented by lines 412*b* and 412*c*, which Control Mode Loop will be described hereinbelow in greater detail.

As was mentioned hereinabove, programmable interface device 101 continually scans the selection switches 15 and presents an interrupt request signal IRQ which is applied to the T0 input of microprocessor 51 when a switch closure is detected. In the event that the level to the T0 input is high, microprocessor 51 branches to the vend cycle sub-routine through line 408*a*. During the vend cycle sub-routine, the switches are scanned in the manner indicated by block 414 to ascertain which switch has been operated. At program step 416, the sold out switches are examined to establish if the item has been sold out. In the event that the item has been sold out, microprocessor 51 returns to the Idle loop 403 as represented by lines 416*a* and 417 and updates displays at phase 407 of Idle loop 403.

In the event that the requested item is not sold out, microprocessor 51 advances to program step 418 wherein the price of the item which has been requested to be vended is called out of its memory location to ascertain its price and the price of the item is compared against the amount of money which has been deposited into vending machine 10, as displayed on the front panel, to ascertain whether the amount deposited is equal to or greater than the price of the item which has been requested to be vended. In the event that the amount deposited into vending machine 10 is less than the price of the item, microprocessor 51 immediately returns to the Idle routine 403 through lines 418*a*, 419 and 417, at which time the lamp displays are updated during phase 407 of the Idle loop 403 when the Idle loop reaches phase 407. In the worst case, this would be no greater than 2.4 milliseconds after microprocessor 51 returns to the Idle loop.

In the event that the amount deposited in vending machine 10 is equal to or greater than the cost price of the item which was requested to be vended, microprocessor 51 advances to program sub-routine 420 during which the item is vended, accountability is updated and error conditions, if present, are updated. These steps are performed in the following manner:

Microprocessor 51 generates the selection signal which selects the decoder 105. Programmable interface circuit 101 continually scans both of the decoders 103 and 105 shown in FIG. 3*b*. However, only decoder 105 is operating.

When a switch closure is detected (at lines RLϕ–RL7) device 101 stores the identity of the switch in array 14 and simultaneously generates an interrupt request signal IRQ.

Microprocessor 51 acknowledges this signal by requesting that programmable device 101 transmit through Data Bus lines DBϕ–DB7 the identity of the closed selector switch in array 14. Microprocessor 51 after comparing the cost of the item to be vended with the amount deposited, then places a control word at the I/O ports P1-ϕ through P1-7. This word is applied to the code inputs A, B, C and select input SEL of decoders 67, 69. Only one line of the eight output lines Oϕ–O7 of each of the decoders 67, 69 is energized to energize the LED of only that motor drive circuit MD lcoated at the intersection of the column (COL) and row (ROW) conductors provided in the matrix array of FIG. 7. If desired, in the case where DC motors are employed to drive the dispensing means such as the helix drives 38 of FIG. 2, the opto-isolator circuits may be eliminated and the column (COL) and row (ROW) conductors may be directly connected across the DC motor. Microprocessor 51 also powers the motor power lines which provide the AC and DC power required for operating AC or DC motors, respectively. This selection is made by turning on appropriate LED devices of opto-isolator circuits similar to those shown in FIGS. 8*a* and 8*b* in order to provide the AC and DC power through the associated common power lines.

Thereafter, microprocessor 51 selects decoder 103 while device 101 scans all switches in the entire switch array of the motor switches 210 shown in FIGS. 4 and 9 to determine if any of the motor switches are closed, indicating that their associated cams have not been returned to the start position. In the event that any such switches close indicating that the associated motor is either on or has returned to other than the proper start position, microprocessor 51 derives the identity of the closed switch 210 from programmable device 101 and stores a malfunction status signal in the memory location assigned to the malfunctioning motor. In the event that a malfunction status code was previously stored for the selected motor, microprocessor 51 examines the memory location assigned to such motor at the time that the switch selection signal has been identified. In the event that a malfunction status code was previously stored for that particular dispensing motor, microprocessor 51 jumps to the Idle loop and updates the front displays during Idle loop phase 407 which, in the present instance, consists of illumination of the MAKE NEW SELECTION lamp (not shown for purposes of simplicity), which is selected through decoder 130 (see FIG. 3*b*). In the event that no malfunction status code is present for the selected dispensing motor and further in the event that no switch closures are present due to any malfunctions, the motor of the selected dispensing device is turned on by microprocessor 51 which generates a chip select signal to select decoder 103 shown in FIG. 3*b* causing the motor drive circuit MD for the selected motor to be energized by illuminating its associated LED. The energization of the motor drive MD is delayed at least until a zero crossing condition is present in order to delay the turn on of an AC motor until the AC waveform crosses through zero voltage. This capability is provided to prevent premature burn out of the motors and motor drive circuits. FIG. 6 shows the zero crossing detector circuit in which the full wave bridge 63 provides a full wave rectified signal at output line 61*c* shown in FIG. 6, which signal is applied through buffer circuit 61*d* of microprocessor 51 which serves to delay advancement to the next program step, preventing completion of the present program step, until the zero crossing condition has been detected, whereupon microprocessor 51 is then free to advance to the next program step in this sub-routine.

Microprocessor 51 tests for switch closures at all sixty-four motor positions approximately 0.60 seconds after a switch closure condition is requested since the motor drive circuit has been selected. The motor which is energized causes the cam associated therewith to begin rotation to close the associated monitor switch 210 shown in FIG. 9. In the event that the motor switch 210 associated with the selected motor is not closed, a malfunction status signal is entered into the memory location assigned to the malfunctioning motor, and microprocessor 51 is caused to return to the Idle loop at which time, during phase portion 407 the vending machine displays are updated and, more specifically, the MAKE NEW SELECTION lamp is illuminated.

In the event that the motor switch 210 for the selected motor is closed, microprocessor 51 tests for a switch open condition at that position three seconds after turn on of the aforementioned motor. The associated motor is automatically turned off when cam 209 returns to its start position opening switch 210. In the event that there has been a malfunction, the motor will either be jammed in the on position or will occupy a position other than the normal start position when it is stopped whereupon switch 210 will be closed indicating a malfunction condition. Such a malfunction status code word will be inserted into the memory location assigned to the malfunctioning motor and microprocessor 51 will again return to the Idle loop 403 to update the vending machine display.

In the event that the switch being tested is open after three seconds, when the switch opens the motor is turned off during the next zero crossing.

If a switch is closed when testing for an open condition, an error bit is entered into the memory location in RAM 66 or 68 assigned to the malfunctioning motor and microprocessor 51 returns to the Idle loop 403 to update the vending machine displays. The malfunction status code position for the motor is examined when its selection switch 15 is depressed to ascertain the presence of a malfunction condition. In the event that a malfunction condition is present, microprocessor 51 returns to the Idle loop 403 as was described hereinabove updating the front panel displays and thereby preventing an operator from using a malfunctioning dispensing device. This technique allows the vending machine to remain in service even in the presence of a malfunctioning device (or devices) since the malfunctioning device (or devices) is automatically prevented from being operated when selected while all other dispensing devices are operable in their normal fashion.

In the event that the sub-routine 420 terminates without detecting the presence of any malfunctioning conditions, microprocessor 51 returns to the Idle loop 403 as represented by lines 420*a*, 419 and 417.

As was previously described, when the control switch 246 shown in FIG. 10, which switch is mounted within the interior of vending machine 10, is operated to the control position, the presence of this condition is tested during phase 412 of the Idle loop causing microprocessor 51 to enter into the control mode loop routine as represented by lines 412*b* and 412*c*.

At this time, microprocessor 51 tests the door switch to ascertain whether the door is open or closed. In the event that an operator has erroneously allowed the test control switch 412 to remain in the control position thinking that he had returned switch 246 to the run position and closed the vending machine door 11, the sub-routine initially tests the door switch. In the event that the door switch is closed, indicating that the vending machine door has been closed and locked, microprocessor 51 returns to the initialization sub-routine 402 as represented by lines 421*a*, 422 and 423. This technique prevents the vending machine from being accidentally or erroneously shut down due to an oversight on the part of maintenance personnel inadvertently forgetting to return switch 246 to the run position.

In the event that the door switch is open when tested at program step 421, microprocessor 51 advances to program step 424 to detect for the presence of a peripheral or off-line device by examining Data Bus line DBO as was previously described. In the event that a peripheral or off-line device is present, the program branches to the transmit data to peripheral sub-routine 411 which was previously described hereinabove.

In the event that no peripheral or off-line device 270 (FIG. 4) is present or in the event that data has been transferred to the peripheral unit and the off-line unit has been removed, microprocessor 51 advances to program step 425 at which time the control switch 246 is again tested. In the event that the control switch is now in the run position, microprocessor 51 returns to the initialization sub-routine 402 as represented by lines 425*a*, 422 and 423.

In the event that the control switch is in the control position, microprocessor 51 advances to program step 426 to determine if the test switch 243 (FIG. 10) has been selected. Selection of test switch 243 which is one of the switches in the control switch array coupled to buffers 141-148 (FIG. 3*b*), causes microprocessor 51 to step to the test door switch sub-routine 427 as indicated by arrow 426*a*. At this time, microprocessor 51 tests the door switch to determine if it is open or closed. If closed, this indicates that the test switch 243 was inadvertently turned on and thereafter the front door 11 of the vending machine 10 was closed. This program routine automatically returns the vending machine 10 to normal operation even though maintenance personnel have erroneously depressed the test switch 243. In the event that the door switch indicates that the door 11 of vending machine 10 is open, microprocessor 51 advances to the test control switch program step 428. In the event that the test control switch 246 is on, microprocessor 51 enters into the execute test mode subroutine 429 which monitors and counts the number of times the test switch 243 has been depressed and performs the following operations:

Initial operation of the test switch 243 causes microprocessor 51 to select decoder 130 as shown in FIG. 3*b*. Each lamp and digit indicator provided vending machine door 11 is illuminated for one second and then extinguished for one second and illuminated for one second and so forth. This flashing sequence will continue until the test switch is again depressed.

The next time that test switch 243 is depressed, microprocessor 51 advances to the next program step during which all 60 front selection panel switches are examined. In the event that any of the front panel control switches are closed due to a malfunction, the microprocessor sequentially displays the letter and number of any closed front panel switch. Thus, the programmable interface circuit 101 is caused to scan all of the front panel control switches in the array to ascertain switch closures. If any of the switches in the array are closed, LED device 123 will display the letter of the switch while display elements 122 and 121 display the number of the malfunctioning switch in the array shown in FIG. 10*a*. In the event that all of the front panel control switches are open, display elements 123 and 122 will display a value "SO" indicating that all selection switches are open. If more than one switch has malfunctioned the designation of the lowest number switch will be displayed first. Each of the selection switches may then be individually tested by depressing the selection switch. If the switch is operating normally, the display will then be changed to display the number of the selection switch so depressed. For example, if the fourth control switch is depressed, display elements 123, 122 and 121 will display "A4". Any one or all of the switches may be tested during this mode to assure that they are closed when depressed.

Once maintenance personnel have been satisfied that all selection switches are operating properly, test switch 243 may again be depressed. When this subsequent depression of the test switch 243 is detected and counted in the monitor portion of the routine, the execute test mode portion of routine 429 will enter into the motor switch test at which time the programmable interface circuit 101 is caused to scan all of the motor switches 210 (FIG. 9) to look for any switch closures. In the event that all of the motor switches are open, display positions 123, 122 and 121 generate a display "MOO". In the event that any of the motor switches have malfunctioned and are closed, display elements 123, 122 and 121 generate and display the number associated with the switch which has malfunctioned. The number displayed will be the same number assigned to the selection switch associated with malfunctioning motor. In the event that more than one motor has malfunctioned, the lowest numbered malfunctioning motor will be displayed until the condition is cleared. Clearing of the malfunctioning condition is performed by manually rotating the helix drive 38 (FIG. 2) associated with the malfunctioning motor 40 to determine whether the helix drive 38 and malfunctioning motor 40 and associated cam may be moved to its normal start position. In the event that the malfunction condition for that motor has been cleared, the display elements 123, 122 and 121 will then display the letter "A" followed by the designating number of the next lowest malfunctioning motor. Each successive malfunctioning motor will be displayed in a similar manner as soon as the next lower numbered malfunctioning motor condition has been cleared.

In the event that all motors are functioning properly, it is further possible to perform a test to be assured that the switches 210 are in proper operation by manually turning each helix drive 38 to be assured that its associated switch closes by the rotation of the cam associated therewith and then reopens when the cam associated with the motor is reset to the start position. As each helix drive 38 is rotated, its associated cam 208 (see FIG. 9) will cause closure of its associated motor switch 210 causing the display elements 123, 122 and 121 to display the number representing the motor presently under manual test. As few or as many of the helix drives 38 may be tested as is desired.

The test mode is advanced to the next sub-routine by again depressing test switch 243 causing microprocessor 51 to select the control switches by enabling the buffers 141–148 shown in FIG. 3*b*. The proper operation of each control switch is determined by depressing each control switch. A switch closure is coupled through the associated buffer and one line of the data bus DB0-DB7. Microprocessor 51 converts the enabled Data Bus line into display information presented by display elements 123, 122 and 121 wherein the letter "C" followed by the switch number is displayed when the associated switch is depressed, in the event that the switches are functioning properly. Any one, more than one, or all of the control switches may be tested at this time.

While exemplary test mode features which are viewed as highly advantageous have been described in conjunction with the test mode routines represented by the block 429, it will be apparent to those of ordinary skill in the art that additional test mode features may also be included and initiated within the test mode loop by further depressions of the test switch 243. Thus, each time the test switch 243 is operated, it is detected and counted in association with the program steps associated with block 429 and thereafter the test routine associated with that depression of the test switch 243 is executed. The test mode loop is initially entered, as indicated by arrow 426*a*, by a depression of the test switch 243 and after the test routine is executed, the number of times the test switch 243 has been depressed is tested to ascertain if the same equals the value N, in the manner indicated by step 430. The test is conducted by comparing the value of the count in the counter incremented each time the test switch is depressed in step 429 with the value N where N corresponds to the number of different test routines executable in association with block 429. When the number of times the test switch 243 has been depressed does not equal N, as indicated by the arrow 430*a*, the program loops back to the beginning of the test mode loop for further test sequences and will only exit this loop under these conditions if the door is closed or the test control switch is turned off in the manner indicated by steps 427 and 428. In this manner, further depressions of the test switch may be counted and further test routines executed.

When the test switch count corresponds to the value established for N, as indicated by the arrow 430*b* microprocessor 51 exits the test mode loop and branches to the normal control mode which displays information in accordance with the operation of the function switches of the function switch array 230 shown in FIG. 10. Entering into the process control mode 431, microprocessor 51 controls the generation of a display in one or more of the display elements 114–123 shown in FIG. 10 based upon the selection of the function switches in switch array 230. For example, in order to obtain a display of the Cash History, button 231 is depressed whereupon a display comprised of elements 114–121 displays the Total Cash taken in by the machine since it was installed at the site by depressing pushbutton 231 and the forward function pushbutton 242, display elements 114–119 display the Total Cash taken in since the last collection.

Similarly actuating the inventory pushbutton 232 and selectively actuating the right function pushbutton 241 causes a display of the number of coins in the coin return tubes on an individual basis. More particularly, when the inventory pushbutton 232 is depressed, elements 123 and 122 display NR (Nickel Reserve) respectively while elements 114–116 display a 3 digit number corresponding to the number of nickels in the nickel reserve tube. If the reverse function pushbutton 241 is additionally depressed, elements 123 and 122 display dR (Dime Reserve) respectively while elements 114–116 display a 3 digit number corresponding to the number of dimes in the dime reserve tube. The next depression of the reverse function pushbutton 241 causes elements 123 and 122 to display QR (Quarter Reserve) while elements 114–116 display a 3 digit number corresponding to the number of quarters in the quarter reserve tube and a following depression of the reverse function pushbutton 241 will cause elements 123 and 124 to display DR (Dollar Reserve) while elements 114–116 display a 3 digit number corresponding to the number of dollar coins in the dollar reserve tube. If coins are added to any of the coin reserve tubes, the number of coins in the respective one of the tubes is displayed in the manner aforesaid, and the up pushbutton 238 is depressed to increment the display and appropriate registers in memory to include the amount added. Conversely, if coins are to be withdrawn, the number of coins in a given tube are displayed and thereafter the down pushbutton 239 is depressed. Under these conditions, a depression of the down pushbutton 239 decrements the display and memory and ejects coins from the tube selected.

Depressing pushbutton 233 causes display elements 114–116 to display a three digit number representative of the maximum cash capable of being accepted by vending machine 10, which value may be any value in $0.05 increments from $0.05 to $9.95. The cash value displayed may be altered by operating the "up" button 238 or "down" button 239 causing the Maximum Cash Value to change in $0.05 increments said increments being changed at the rate of every 0.70 seconds. In order to change the $0.05 increments at a faster rate in the positive direction, pushbuttons 238 and 240 are depressed causing the $0.05 increments to change at a rate of 0.20 seconds. By releasing the buttons 238 and 240, further incremental changes are terminated.

The Maximum Cash Value may be decreased in $0.05 increments by pressing pushbutton 239, changing the increments at the rate of 0.70 seconds. Depressing buttons 239 and 240 changes the increments in the negative direction at the rate of 0.2 seconds. The Maximum Cash Value is stored in memory 66, 68 and is used by microprocessor 51 to limit the receipt of cash by comparing the cash deposited against the stored maximum value. Depressing pushbutton 233 with the forward function pushbutton 242 will similarly cause the value of any remaining credits to be displayed.

By depressing the Vends Historical pushbutton 234, the number of vends per dispensing device are displayed in display elements 116–120. The identity of each dispensing device is represented by display elements 121–123, displaying the letter and number of the particular dispensing device. Similarly, a depression of the Vends Collection-To-Collection pushbutton 235 will cause elements 121–123 to display the letter and number representing the particular dispensing device and elements 116–120 to display the number of vends for that device since the last collection. In order to display the number of Historical Vends or Vends Collection-To-Collection for the next dispensing device, either pushbutton 242 or pushbutton 241 is depressed. By depressing pushbutton 242, the displays are advanced from one dispensing device to another in a "forward" direction. By depressing pushbutton 241, appropriate vend information per device is displayed wherein each dispensing device is selected for display in reverse order.

Vend history on either basis together with a display identifying the particular dispensing device is changed at a rate of 0.70 seconds. In the event that it is desired to cause the displays to be changed at a more rapid rate, either button 242 and button 240 or button 241 and button 240 are depressed in combination causing the display to change at the rate of 0.20 seconds.

In the event that any dispensing device has malfunctioned, the Vends-Collection-To-Collection display will further generate the display "ERR" at display elements 121–119 to indicate that a malfunction has occurred at a given device. Display elements 123 and 122 represent the particular dispensing device and display elements 118–116 represent the number of vends of said dispensing device before the occurrence of the failure or malfunction.

Prices for all items are displayed and/or altered by depressing the price function SW 236. The current price for the first item will be displayed in display elements 114–116 and the item letter and number in display elements 123–121. To alter the price, the up 238, down 239 and fast 240 switches are utilized in a manner previously described. The item and its associated price display are advanced using the forward 242, reverse 241 and fast 240 switches as previously described.

Microprocessor 51 may be removed from the process control mode associated with block 431 when the Control Mode loop is completed whereupon microprocessor 51 branches to program step 421 in the manner indicated by arrow 431*a* and 412*c*. If the door switch for door 11 is closed, the program is caused to return to the initialization sub-routine 402 through lines 421*a*, 422 and 423. Microprocessor 51 then repeats the initialization routine clearing all registers, memories, etc. which are "unprotected" and again enters into the Idle loop 403.

Although the description has been set forth herein for a food or snack vending machine, it should be understood that the present invention may be used with equal success with all types of vending machines of various categories such as coffee vending machines and vending machines for vending other foodstuffs, the only difference between the latter vending machines and the vending machine 10 described herein being control over different functions. For example, whereas the present description sets forth the manner in which motors are energized to dispense a package, bag or box of foodstuffs, other types of motors or solenoid operated valve devices may be activated in a similar fashion to dispense powdered coffee; hot water; cream and sugar, for example, in the event that the microprocessor 51 of the present invention is being utilized in a coffee vending machine. Obvious selection changes may be made by selectively energizing or deenergizing those motor devices for dispensing sugar and cream in the event that it is desired to dispense black coffee, coffee with cream and no sugar, black coffee with extra sugar, and so forth. The motor control devices may be utilized to control motors for driving devices other than helix drives, the particular type of dispensing mechanism being a mere matter of choice depending upon the particular vending application.

A latitude of modification, change an substitution is intended in the foregoing disclosure and, in some instances, some features of the invention will be employed without a corresponding use of other features. Accordingly, it is appropriate that the appended claims be construed broadly in a manner consistent with the spirit and scope of the invention herein.

APPENDIX

```
ASM48 MAXMAT.V2 PAGEWIDTH (72) XREF

ISIS-II MCS-48/UPI-41 MACRO ASSEMBLER, V2.0                PAGE    1

 LOC  OBJ          SEQ.        SOURCE STATEMENT

                     1
                     2 ;
                     3 ;
                     4 ;
                     5 ;
                     6 ;
                     7 ;
                     8 ;
                     9
                    10
                    11 ;  MAXI-MAT FRONT VIEW SNACK VENDING MACHINE
                    12 ;  CONTROLS UP TO SIXTY ITEMS
                    13 ;  WITH ACCOUNTABILITY FOR MONEY AND PRODUCT
                    14
                    15
                    16
                    17 ;  DATE OF ASSEMBLY--8/23/79--
                    18
                    19 ;      FOR
                    20 ;  COFFEE-MAT CORP.
```

```
                 ;  251 SO. 31ST STREET
                 ;  KENNILWORTH, N.J.
                 ;  201-241-8400


                 ;       BY
                 ;  T.E. SHUREN & R.E. MEYER

                 $EJECT


                 ;        ************************
                 ;        *                      *
                 ;        *  SYSTEM  EQUATES     *
                 ;        *                      *
                 ;        ************************

                 ;  8279 EQUATES

000F             NKEYC   EQU     00FH    ;P2 DATA FOR SELECT SWITCHES
                                         ;DECODER & COMMAND MODE
008F             MTRSMC  EQU     08FH    ;P2 DATA FOR MOTOR SWITCHES
                                         ;DECODER & COMMAND MODE
000A             NKMODE  EQU     0AH     ;8279 N-KEY MODE COMMAND
000C             SMMODE  EQU     0CH     ;8279 SENSOR MATRIX
                                         ;MODE COMMAND


                 ;OTHER PORT EQUATES

003F             XRAM    EQU     3FH     ;CHIP SELECT EXTERNAL RAM
                                         ;& NKEY DECODER
002F             PERIF   EQU     2FH     ;CHIP SEL PERIPHERAL


                 ;  INTERNAL RAM EQUATES

0020             TMSWR1  EQU     20H     ;TEMP. MOTOR SWITCH REG #1
0029             TDECR1  EQU     29H     ;TEMP. DECIMAL REG #1
002D             TCSHR1  EQU     2DH     ;TEMP CASH REG #1
0031             TBINR1  EQU     31H


003E             LTREG   EQU     3EH     ;GUM SOLD OUT & COIN EMPTY
003F             LPRICE  EQU     3FH     ;LOWEST PRICE IN MAHINE REG


                 ;EXTERNAL RAM EQUATES

0001             SERNO   EQU     001H    ;SERIAL NUMBER LOCATION
0010             PRICE1  EQU     010H    ;PRICE OF ITEM #1
0011             NOVCC1  EQU     011H    ;NO. OF VENDS COL. TO COL.
0012             NOVH1   EQU     012H    ;NO.OF VENDS HISTORICAL
000C             NRESRV  EQU     00CH    ;NICKEL RESERVE REG.
000D             DRESRV  EQU     00DH    ;DIME      "     "
000E             QRESRV  EQU     00EH    ;QUARTER   "     "
000F             DLRSVR  EQU     00FH    ;DOLLAR RESERVE REG.
0008             MAXCSH  EQU     008H    ;MAXIMUM CASH DISPLAY
000B             CASHTV  EQU     00BH    ;TOTAL CASH THIS VEND
0006             CASHCC  EQU     006H    ;TOTAL CASH COL TO COL
0003             CASHH   EQU     003H    ;TOTAL CASH HISTORICAL
0009             FRPLYC  EQU     009H    ;NO. OF FREE VENDS COL TO COL
0000             RAMVER  EQU     000H    ;VALID RAM VERIFICATION


                 ;ASSEMBLE DIRECTIVES

0001             ELTYPE  EQU     1       ;SEMI-INTELEGENT CHANGER
0000             QUARTR  EQU     0       ;NOT A QUARTER MACHINE
```

```
                 93
                 94
                 95 ;MISCELANIOUS VALUES
                 96
0037             97 GUMSW1  EQU     55D
                 98
                 99
                100
                101 $EJECT
                102
                103
                104
                105 ;  START OF SYSTEM CODE
                106
0000            107        ORG     00H
                108
0000 C5         109 BEGIN:  SEL     RB0
0001 0407       110        JMP     SETUP   ;GOTO COLD START SET UP
                111
                112
0003            113        ORG     03H
                114
0003 15         115 INTR:   DIS     I
0004 35         116        DIS     TCNTI
0005 0465       117        JMP     PWRDWN  ;GOTO POWER DOWN ROUTINE
                118
                119
                120
                121 ;  SET UP ROUTINE
                122
                123 ;  SET P1=0FFH
                124 ;  SET P4=F,P5=F,P6=0,P7=E
                125 ;  CLEAR INTERNAL RAM
                126 ;  TEST EXTERNAL RAM FOR VALID DATA
                127 ;  IF NOT VALID  WAIT FOR CONTROL MODE
                128 ;  SET 8279 CLOCK RATE =ALE/4 , CLEAR ALL ,
                129 ;  GOTO PIDLE
                130
                131
0007 89FF       132 SETUP:  ORL     P1,#0FFH
                133
0009 230F       134        MOV     A,#0FH
000B 3C         135        MOVD    P4,A
000C 3D         136        MOVD    P5,A
000D 230E       137        MOV     A,#0EH
000F 3F         138        MOVD    P7,A
0010 27         139        CLR     A
0011 3E         140        MOVD    P6,A
                141
                142
0012 27         143 CLRRAM: CLR     A        ;THIS ROUTINE CLEARS ALL
0013 B83F       144        MOV     R0,#3FH ;OF RAM EXCEPT R0
                145
0015 A0         146 LOOP1:  MOV     @R0,A
0016 E815       147        DJNZ    R0,LOOP1
                148
                149
                150 ;SET SERIAL NUMBER
0018 14B6       151        CALL    CS3
001A B801       152        MOV     R0,#SERNO
001C 2301       153        MOV     A,#01H
001E 90         154        MOVX    @R0,A
001F 27         155        CLR     A
0020 18         156        INC     R0
0021 90         157        MOVX    @R0,A
                158
                159 ;  TEST EXTERNAL RAM FOR DATA VALIDITY
                160 ;  LOCATION RAMVER=055H
                161 ;  IF TRUE, CONTINUE - IF NOT, WAIT FOR CONTROL
                162 ;  MODE
                163
0022 B800       164 TEXRAM: MOV     R0,#RAMVER      ;EXT. ADDRESS
```

```
0024 80          MOVX    A,@R0
0025 03AA        ADD     A,#0AAH ;TO DETERMINE VALIDITY
0027 17          INC     A
0028 C637        JZ      ST8279  ;EQUAL (VALID) GOTO
                                 ;SET 8279 PARAMETERS

;CLR XRAM
002A B8FF  CXRAM:  MOV   R0,#0FFH
002C 27          CLR     A

002D 90    LOOP2:  MOVX  @R0,A
002E E82D        DJNZ    R0,LOOP2

0030 14C5  EXIT1:  CALL  CS7     ;GET CONTROL SWITCH PORT
0032 08          INS     A,BUS
0033 F230        JB7     EXIT1
0035 64E9        JMP     CONTRL


;SET 8279 PARAMETERS

0037 9A8F  ST8279: ANL   P2,#8FH ;CHIP SEL 0

0039 2324        MOV     A,#24H  ;PROGRAM CLOCK / BY 4
003B 02          OUTL    BUS,A

003C 23C1        MOV     A,#0C1H ;CLEAR ALL
003E 02          OUTL    BUS,A



;DETERMINE LOWEST PRICE AND SAVE IN LPRICE

003F 14B6        CALL    CS3
V 0041 B800      MOV     R0,#PRICE1 +240D        ;TOP OF XRAM
(    0)

                                         ; PRICE BYTES + 4
0043 B93F        MOV     R1,#LPRICE
0045 B1FF        MOV     @R1,#0FFH

0047 C8    LPLOOP: DEC   R0
0048 C8          DEC     R0
0049 C8          DEC     R0
004A C8          DEC     R0
004B 80          MOVX    A,@R0
004C C653        JZ      ZTEST
004E 37          CPL     A
004F 61          ADD     A,@R1
0050 17          INC     A
0051 F661        JC      SAVNEW  ;OLD > NEW, SAVE NEW

0053 F8    ZTEST:  MOV   A,R0
0054 37          CPL     A
0055 0310        ADD     A,#PRICE1       ;IF R0 =PRICE1
0057 17          INC     A       ;ALL PRICES HAVE BEEN CHECKED
0058 9647        JNZ     LPLOOP

                 IF      ELTYPE
005A 34D2        CALL    GETWD   ;CLEAR ELECTRONIC CHANGER
                 ENDIF


005C 8665        JNI     PWRDWN
005E 05          EN      I
005F 04CA        JMP     PIDLE

0061 80    SAVNEW: MOVX  A,@R0
0062 A1          MOV     @R1,A
0063 0453        JMP     ZTEST


$EJECT
```

```
                 236
                 237
                 238 ;POWER DOWN ROUTINE
                 239 ;DESELECT EXTERNAL RAM
                 240 ;CLEAR PORT 1
                 241 ;WAIT FOR HARDWARE RESET
                 242
0065 14C5        243 PWRDWN: CALL    CS7
0067 89FF        244         ORL     P1,#0FFH
                 245
0069 0469        246 RESET:  JMP     RESET
                 247
                 248
                 249
                 250
                 251 ;INTERUPT TEST
                 252
006B 8603        253 INTTST: JNI     INTR    ;IF INT PENDING DO IT
006D 05          254         EN      I       ;IF NOT ENABLE & RETURN
006E 83          255         RET
                 256
                 257 $EJECT
                 258
                 259
                 260 ;IF FREE PLAY- JUST TURN CREM OFF
                 261 ;TEST FOR CASH THIS VEND => MAX CASH ALLOWABLE
                 262 ; MAX CASH CAN ACTUALLY BE MAX CASH VALUE +
                 263 ; HIGHEST DENOMINATION COIN - ONE NICKEL
                 264 ;IF EQUAL OR OVER DISABLE CREM COIL
                 265
006F B4ED        266 MAXTST: CALL    FPTST   ;IF FREE PLAY F1=1
0071 7687        267         JF1     CRMOFF  ;IF NOT F1=0
0073 14B6        268         CALL    CS3
0075 B80B        269         MOV     R0,#CASHTV
0077 B908        270         MOV     R1,#MAXCSH      ;MAX CASH REG ADDRESS
                 271
0079 80          272         MOVX    A,@R0   ;GET CASH THIS VEND
007A AA          273         MOV     R2,A    ;SAVE IN R2
                 274
007B 81          275         MOVX    A,@R1   ;GET MAX CASH VALUE
007C 37          276         CPL     A
007D 6A          277         ADD     A,R2
007E 17          278         INC     A
                 279
007F F687        280         JC      CRMOFF  ;CASH IN MACHINE > MAX CASH
0081 C687        281         JZ      CRMOFF  ;  "   "   "     =  "   "
                 282
                 283         IF      ELTYPE
0083 23F7        284 CRMON:  MOV     A,#08H NOT
0085 9D          285         ANLD    P5,A
0086 83          286         RET
                 287
0087 2308        288 CRMOFF: MOV     A,#08H
0089 8D          289         ORLD    P5,A
008A 83          290         RET
                 291         ELSE
                 292
                 293 CRMON:  MOV     A,#08H
                 294         ORLD    P5,A
                 295         RET
                 296 CRMOFF: MOV     A,#08H NOT
                 297         ANLD    P5,A
                 298         RET
                 299
                 300         ENDIF
                 301
                 302
                 303 ;CONVERT ROUTINE
                 304 ;SET UP TBINREG'S FOR BINARY TO DECIMAL CONVERSION
                 305 ;AND DO IT
                 306
008B 14B6        307 CNVRT:  CALL    CS3
```

```
008D FD          308          MOV     A,R5
008E A8          309          MOV     R0,A     ;XRAM ADDRESS IN R0
008F 80          310          MOVX    A,@R0
0090 B931        311 CNVRT1:  MOV     R1,#TBINR1
0092 A1          312          MOV     @R1,A            ;SAVE
                 313
0093 FF          314          MOV     A,R7     ;TEST COMMAND REG TO DETERMINE
0094 52A0        315          JB2     DBYTE    ;1,2 OR 3 BYTE VALUE
0096 B2A0        316          JB5     DBYTE
                 317
0098 19          318 SBYTE:   INC     R1
0099 B100        319          MOV     @R1,#00H         ;SINGLE BYTE VALUE ZERO
009B 19          320 SBYTE1:  INC     R1               ;NEXT TWO BYTES
009C B100        321          MOV     @R1,#00H
009E 6463        322          JMP     BINDEC   ;BINARY TO DECIMAL CONVERSION
                 323
00A0 18          324 DBYTE:   INC     R0       ;DOUBLE BYTE, GET NEXT VALUE
00A1 80          325          MOVX    A,@R0
00A2 19          326          INC     R1
00A3 A1          327          MOV     @R1,A
00A4 FF          328          MOV     A,R7
00A5 529B        329          JB2     SBYTE1
00A7 B6AB        330          JF0     TBYTE
00A9 049B        331          JMP     SBYTE1   ;
                 332
00AB 18          333 TBYTE:   INC     R0       ;TRIPLE BYTE, GET THE LAST VALUE
00AC 80          334          MOVX    A,@R0
00AD 19          335          INC     R1
00AE A1          336          MOV     @R1,A
00AF 6463        337          JMP     BINDEC
                 338
                 339
                 340
                 341 ;CHIP SEL ROUTINES
                 342
00B1 9A8F        343 CS2:     ANL     P2,#8FH
00B3 8A20        344          ORL     P2,#20H
00B5 83          345          RET
                 346
00B6 9A8F        347 CS3:     ANL     P2,#8FH
00B8 8A30        348          ORL     P2,#30H
00BA 83          349          RET
                 350
00BB 9A8F        351 CS5:     ANL     P2,#8FH
00BD 8A50        352          ORL     P2,#50H
00BF 83          353          RET
                 354
00C0 9A8F        355 CS6:     ANL     P2,#8FH
00C2 8A60        356          ORL     P2,#60H
00C4 83          357          RET
                 358
00C5 9A8F        359 CS7:     ANL     P2,#8FH
00C7 8A70        360          ORL     P2,#70H
00C9 83          361          RET
                 362
                 363 $EJECT
                 364
                 365
                 366
                 367 ;PRE IDLE SETS THE 8279 TO NKEY MODE
                 368
                 369
                 370
00CA 85          371 PIDLE:   CLR     F0
00CB A5          372          CLR     F1
00CC 7400        373          CALL    NKYMDE
00CE 9ACF        374          ANL     P2,#0CFH
00D0 23C2        375          MOV     A,#0C2H ;CLEAR FIFO COMMAND
00D2 02          376          OUTL    BUS,A
00D3 23FC        377          MOV     A,#03H NOT
00D5 7426        378          CALL    WAIT
00D7 23C0        379          MOV     A,#0C0H ;CANCEL CLEAR
00D9 02          380          OUTL    BUS,A
```

```
00DA 8A10          381          ORL     P2,#10H
                   382
                   383
                   384 ;  IDLE ROUTINE
                   385 ;  THE PROGRAM IS HERE UNLESS IT IS PROCESSING
                   386 ;  A SWITCH
                   387 ;
                   388 ;SERVICE THE CHANGER
                   389 ;UPDATE THE MAKE SELECTION LIGHT
                   390 ;UPDATE THE CREDIT DISPLAY
                   391 ;CONTROL THE C.R.E.M. COIL
                   392 ;UPDATE THE GUM SOLD OUT LIGHTS
                   393 ;  TEST THE TO PIN FOR THE 8279 INTERUPT REQUEST
                   394 ;  TEST FOR CONTROL MODE
                   395 ;  OTHERWISE LOOP
                   396
                   397
00DC 3440          398 IDLE:    CALL    CHNGER
00DE 146F          399          CALL    MAXTST  ;CONTROL THE C.R.E.M. COIL
00E0 742E          400          CALL    LOWPRC  ;CONTROL THE MAKE SEL LIGHT
00E2 54C4          401          CALL    CSHDSP  ;DISPLAY NEW CASH VALUE
00E4 74B9          402          CALL    GUMSO   ;CONTROL THE GUM SOLD OUT LIGHTS
00E6 74C7          403          CALL    LTOUT   ;OUTPUT LTREG TO HARDWARE
00E8 36FD          404          JTO     MPJRD   ;IF TO=1 GO READ SELECTION SW
                   405
00EA 14C0          406          CALL    CS6     ;SEL CONTROL SW BANK
00EC 08            407          INS     A,BUS
00ED 37            408          CPL     A
00EE F2DC          409          JB7     IDLE    ;IF DOOR CLOSED -- LOOP
00F0 F4A2          410          CALL    RDYTST  ;IF DOOR OPEN CHECK FOR PERIF
00F2 12F6          411          JB0     CONTST
00F4 E4C0          412          JMP     DUMP
00F6 14C5          413 CONTST:  CALL    CS7
00F8 08            414          INS     A,BUS
00F9 F2DC          415          JB7     IDLE    ;IF NOT CONTROL --IDLE
                   416
00FB 64E9          417 MPJCON:  JMP     CONTRL
00FD 2400          418 MPJRD:   JMP     READSW
                   419
                   420
                   421
                   422
                   423
                   424
                   425 $EJECT
                   426
0100               427          ORG     100H
                   428
                   429
                   430 ;READ SWITCH ROUTNE
                   431
                   432 ;  READ THE SWITCH FROM THE 8279. DETERMINE THE
                   433 ;  SWITCH GROUP (IE. CHANGE OR SELECTION ) AND
                   434 ;  PROCESS APPROPRIATLY.
                   435
                   436
                   437 ;IT IS ASSUMED THA THE 8279 IS IN N-KEY SCAN
                   438 ;MODE AND IS READY TO BE READ EXCEPT FOR CHIP
                   439 ;SELECT.
                   440
0100 9A8F          441 READSW:  ANL     P2,#8FH
0102 8A10          442          ORL     P2,#10H ;CHIP SEL 1
0104 08            443          INS     A,BUS
0105 AF            444          MOV     R7,A    ;SAVE
0106 23C4          445          MOV     A,#NOT 3BH      ;COMPLEMENT OF THE
                   446                                  ;HIGHEST SEL. SW.
0108 6F            447          ADD     A,R7
0109 17            448          INC     A       ;COMPARE FUNCTION
010A E60E          449          JNC     SELSW
010C 04CA          450          JMP     PIDLE   ;THIS MUST BE AN ILLEGAL SWITCH
                   451
                   452
                   453 ;SELECT SWITCH ROUTINE
```

```
                 454 ;
                 455 ;DATA EXPECTED,
                 456 ;              R7 = SWITCH NUMBER
                 457 ;KILL THE MAKE SELECTION LIGHT
                 458 ;KILL THE C.R.E.M. COIL AND WAIT 500MS FOR ANY
                 459 ;ADDITIONAL COINS
                 460 ;CHECK FOR ENOUGH MONEY--GOOD-CONTINUE
                 461 ;                       --BAD-EXIT
                 462
010E 744E        463 SELSW:  CALL    MSCOFF  ;MAKE SEL LIGHT & CREM OFF
                 464                         ;& WAIT .5 SEC.
                 465
                 466
                 467 ;GET GUM SOLD OUT SWITCHES AND COMPARE WITH SELECTION
                 468 ;NUMBER IF THIS ITEM IS SOLD OUT -- EXIT
                 469
                 470
0110 23C9        471         MOV     A,#36H NOT      ;2'S COMPLEMENT OF 37H
0112 6F          472         ADD     A,R7            ;SUB 37 FROM SW #
0113 E622        473         JNC     SELSW1          ;CARRY=GUM SW
0115 17          474         INC     A       ;TEST FOR SOLD OUT
0116 A9          475         MOV     R1,A
0117 27          476         CLR     A
0118 F7          477 ROTLFT: RLC     A
0119 E918        478         DJNZ    R1,ROTLFT
                 479
011B A9          480         MOV     R1,A    ;SAVE LINEAR INFO
011C 14BB        481         CALL    CS5     ;GET GUM SOLD OUT SWITCHES
011E 08          482         INS     A,BUS
011F 59          483         ANL     A,R1
0120 963C        484         JNZ     EXIT2   ;SOLD OUT --EXIT
                 485
0122 B4ED        486 SELSW1: CALL    FPTST   ;TEST FOR FREE PLAY
0124 763E        487         JF1     MPJ2
                 488
                 489
                 490
                 491 ;TEST FOR PRICE <= TOTAL COINS IN THE MACHINE
                 492
0126 14B6        493 SELSW3: CALL    CS3
0128 FF          494         MOV     A,R7    ;BIAS
0129 E7          495         RL      A
012A E7          496         RL      A       ;TIMES FOUR
012B 0310        497         ADD     A,#PRICE1       ;PLUS BOTTOM ADDRESS
012D A8          498         MOV     R0,A    ;SAVE IN R0
012E B90B        499         MOV     R1,#CASHTV      ;ADDRESS OF CASHTV
                 500                                 ;REGISTER
0130 81          501         MOVX    A,@R1   ;GET CASHTV REG.
0131 AA          502         MOV     R2,A    ;SAVE IN R2
                 503
0132 80          504         MOVX    A,@R0   ;GET PRICE
0133 C63C        505         JZ      EXIT2   ;ZERO PRICE DO NOT VEND
0135 37          506         CPL     A
0136 6A          507         ADD     A,R2
0137 17          508         INC     A       ;COMPARE FUNTION
                 509
0138 C63E        510         JZ      MPJ2    ;CASH = PRICE ,CONTINUE
013A F63E        511         JC      MPJ2    ;CASH > PRICE ,CONTINUE
                 512
013C 04DC        513 EXIT2:  JMP     IDLE
                 514
                 515
013E 4400        516 MPJ2:   JMP     MOTOR
                 517
                 518 $EJECT
                 519
                 520
                 521
                 522
                 523
                 524
                 525
                 526
```

```
                527
                528          IF       ELTYPE   ;IF ELECTRONIC CHANGER
                529
                530 ;THIS PROGRAM IS INTENDED TO INTERFACE THE "MARS"
                531 ;SEMI-INTELEGENT CHANGER
                532
0140 0C         533 CHNGER: MOVD     A,P4     ;TEST FOR INT REQ
0141 3244       534         JB1      CONT     ;IF YES GO GET DATA WORD
0143 83         535         RET
                536
0144 34D2       537 CONT:   CALL     GETWD
                538
                539 ;CONTROL THE EXACT CHANGE LIGHT
0146 F9         540         MOV      A,R1
0147 D252       541 XCTST:  JB6      XCLON
0149 B252       542 XCTST1: JB5      XCLON
014B 9252       543         JB4      XCLON
                544
014D F0         545 XCLOFF: MOV      A,@R0
014E 53BF       546         ANL      A,#40H NOT
0150 2455       547         JMP      XCSAV
                548
0152 F0         549 XCLON:  MOV      A,@R0
0153 4340       550         ORL      A,#40H
0155 A0         551 XCSAV:  MOV      @R0,A
                552
                553
0156 F9         554 TSTECN: MOV      A,R1
0157 725F       555         JB3      ELCOIN   ;IF TRUE PROCESS VALID COIN
0159 F9         556 TSTEER: MOV      A,R1
015A F28A       557         JB7      ELCHNG   ;IF TRUE GO GIVE CHANGE
015C 27         558 ELTDNE: CLR      A
015D 3D         559         MOVD     P5,A     ;INHIBIT LOW
015E 83         560         RET
                561
015F 14B6       562 ELCOIN: CALL     CS3
0161 5303       563         ANL      A,#03H
0163 030C       564         ADD      A,#NRESRV        ;CONTROL THE RESERVE
0165 A8         565         MOV      R0,A             ;REGISTERS
0166 F9         566         MOV      A,R1
0167 5275       567         JB2      ADRSVR           ;IF ON ADD 1 TO RESERVE
0169 5303       568         ANL      A,#03H           ;IF OFF SET RESERVE TO
016B 0371       569         ADD      A,#RESRV LOW     ;MAXIMUM VALUES
016D A3         570         MOVP     A,@A             ;VALUE IN ACC.
016E 90         571         MOVX     @R0,A            ;RESERVES=MAXIMUM
016F 2478       572         JMP      ADECN
                573
0171 4B         574 RESRV:  DB       75D,101D,60D,00D
0172 65
0173 3C
0174 00
                575
                576
0175 80         577 ADRSVR: MOVX     A,@R0
0176 17         578         INC      A
0177 90         579         MOVX     @R0,A            ;RESERVES INCREMENTED
                580
0178 F9         581 ADECN:  MOV      A,R1
0179 5303       582         ANL      A,#03H
017B 0386       583         ADD      A,#ECNVAL LOW
017D B80B       584         MOV      R0,#CASHTV
017F A3         585         MOVP     A,@A             ;GET COIN VALUE FROM
0180 AA         586         MOV      R2,A             ;ROM & SAVE IN R2
0181 80         587         MOVX     A,@R0            ;GET CASH
0182 6A         588         ADD      A,R2             ;ADD IN COIN
0183 90         589         MOVX     @R0,A            ;STORE
0184 2459       590         JMP      TSTEER
                591
0186 01         592 ECNVAL: DB       01D,02D,05D,20D
0187 02
0188 05
0189 14
```

```
018A 54C4   ELCHNG: CALL    CSHDSP   ;UPDATE CASH DISPLAY
018C D5             SEL     RB1
018D B80B           MOV     R0,#CASHTV

018F B90E   QTR:    MOV     R1,#QRESRV       ;RESERVE REG ADDRESS
0191 BA04           MOV     R2,#04H          ;P6 BIT
0193 BB05           MOV     R3,#05H          ;DENOMINATION IN BINAR
0195 34AA           CALL    CHNGE1

0197 B90D   DIME:   MOV     R1,#DRESRV
0199 BA02           MOV     R2,#02H
019B BB02           MOV     R3,#02H
019D 34AA           CALL    CHNGE1

019F B90C   NICK:   MOV     R1,#NRESRV
01A1 BA01           MOV     R2,#01H
01A3 BB01           MOV     R3,#01H
01A5 34AA           CALL    CHNGE1
01A7 C5     EXITR:  SEL     RB0
01A8 046B   REXIT:  JMP     INTTST


01AA 14B6   CHNGE1: CALL    CS3
01AC 15             DIS     I

01AD 80             MOVX    A,@R0    ;GET CASH
01AE AC             MOV     R4,A     ;TEMP SAVE
01AF FB             MOV     A,R3     ;COIN DENOMINATION
01B0 37             CPL     A
01B1 17             INC     A        ;TWO'S CPL
01B2 6C             ADD     A,R4     ;SUBTRACT COIN FROM CASH
01B3 E6A8           JNC     REXIT
01B5 AC             MOV     R4,A     ;SAVE UPDATED CASH FOR FUTURE

01B6 81             MOVX    A,@R1    ;GET RESERVE REG
01B7 C6A8           JZ      REXIT    ;IF EMPTY TRY NEXT COIN
01B9 07             DEC     A
01BA 91             MOVX    @R1,A    ;SAVE RESERVE - 1


01BB FC     ELCON:  MOV     A,R4     ;GET CASH-COIN
01BC 90             MOVX    @R0,A    ;STORE IN CASHTV

01BD 34C8           CALL    COINON
01BF 23E1           MOV     A,#30D NOT
01C1 7426           CALL    WAIT     ;250 MS OFF TIME
01C3 C7             MOV     A,PSW
01C4 07             DEC     A
01C5 D7             MOV     PSW,A    ;DEC STACK POINTER
01C6 248A           JMP     ELCHNG

01C8 FA     COINON: MOV     A,R2     ;GET P6 BIT
01C9 3E             MOVD    P6,A     ;SOLENOID ON
01CA 23E1           MOV     A,#30D NOT
01CC 7426           CALL    WAIT     ;FOR 250 MS
01CE 2300           MOV     A,#00H
01D0 3E             MOVD    P6,A     ;SOLENOID OFF
01D1 83             RET

;GET DATA WORD
;FROM THE MARS CHANGER & RETURN IT IN R1

01D2 0C     GETWD:  MOVD    A,P4     ;WAIT FOR NEGATIVE EDGE
01D3 32D2           JB1     GETWD
01D5 2302           MOV     A,#02H   ;INHIBIT LINE HIGH
01D7 3D             MOVD    P5,A     ;INHIBIT HIGH - CLOCK LOW

01D8 B900           MOV     R1,#00H ;CLEAR TEP STORAGE
```

```
01DA BA08          MOV     R2,#08H ;8 CHAR TO SHIFT

01DC FA     NXTBIT: MOV    A,R2
01DD 07            DEC     A
01DE AB            MOV     R3,A    ;NUMBER OF SHFTS IN R3
01DF 2301          MOV     A,#01H
01E1 8D            ORLD    P5,A    ;CLOCK HIGH
01E2 00            NOP             ;JUST LET IT SETTLE
01E3 0C            MOVD    A,P4    ;GET BIT
01E4 5301          ANL     A,#01H  ;MASK UNWANTED
01E6 E7     RLACC: RL      A
01E7 EBE6          DJNZ    R3,RLACC;SHIFT LEFT R3 TIMES
01E9 49            ORL     A,R1    ;COMBINE WITH PREV. BITS
01EA A9            MOV     R1,A
01EB 34F6          CALL    TDLYX   ;CLOCK RATE WAIT
01ED 23FE          MOV     A,#01H NOT
01EF 9D            ANLD    P5,A    ;CLOCK LOW
01F0 34F6          CALL    TDLYX
01F2 EADC          DJNZ    R2,NXTBIT

01F4 245C          JMP     ELTDNE

01F6 BC14   TDLYX: MOV     R4,#20D ;100US TDLY
01F8 E4B2          JMP     TDLY



                   ELSE


;CHNGER ROUTINE
;DUMB SWITCH TYPE (COINCO)

CHNGER: CALL       COIN

;CONTROL THE EXACT CHANGE LIGHT

XCHNGE: SEL        RB1
        MOV        R0,#LTREG
        MOV        A,R6    ;GET PRESENT SWITCHES
        CPL        A

        IF         QUARTR
        JB6        XCLON
        ENDIF

XCTST1: JB5        XCLON
        JB4        XCLON

XCLOFF: MOV        A,@R0
        ANL        A,#40H NOT
        JMP        XCSAV

XCLON:  MOV        A,@R0
        ORL        A,#40H
XCSAV:  MOV        @R0,A


CHGTST: MOV        A,R6
        CPL        A
        JB7        EXITR   ;IF NO CHANGE REQUEST--EXIT

        MOV        A,@R0   ;GET LTREG TO TEST XC LIGHT
        JB6        EXITR   ;EXACT CHANGE ON --JUST EXIT

        CALL       MSCOFF  ;TURN OFF MAKE SEL AND C.R.E.M.
```

```
CHANGE:  CALL    SWSCN    ;UPDATE COIN EMPTY SW READS
         CALL    CSHDSP   ;UPDATE CASH DISPLAY
         SEL     RB1
         MOV     R0,#CASHTV
         IF      QUARTR

QTR:     MOV     R1,#QRESRV       ;RESERVE REG ADDRESS
         MOV     R2,#04H          ;P6 BIT
         MOV     R3,#05H          ;DENOMINATION IN BINARY
         CALL    CHNGE1

         ENDIF

DIME:    MOV     R1,#DRESRV
         MOV     R2,#02H
         MOV     R3,#02H
         CALL    CHNGE1

NICK:    MOV     R1,#NRESRV
         MOV     R2,#01H
         MOV     R3,#01H
         CALL    CHNGE1

EXITR:   SEL     RB0
REXIT:   JMP     INTTST



CHNGE1:  CALL    CS3
         DIS     I

         MOVX    A,@R0    ;GET CASH
         MOV     R4,A     ;TEMP SAVE
         MOV     A,R3     ;COIN DENOMINATION
         CPL     A
         INC     A        ;TWO'S CPL
         ADD     A,R4     ;SUBTRACT COIN FROM CASH
         JNC     REXIT
         MOV     R4,A     ;SAVE UPDATED CASH FOR FUTURE

         MOV     A,R6     ;TEST FOR BELOW MINIMUMS
         SWAP    A
         ANL     A,R2     ;ZERO=BELOW MINS
         JZ      DECRSV

FILRSV:  MOV     A,#08D
         MOVX    @R1,A
         JMP     CHNGON

DECRSV:  MOVX    A,@R1
         DEC     A
         JZ      REXIT    ;NOT ENOUGH COINS--EXIT
         MOVX    @R1,A

CHNGON:  MOV     A,R4     ;GET CASH MINUS COIN
         MOVX    @R0,A    ;SAVE IN CASHTV

         CALL    COINON
         MOV     A,PSW
         DEC     A
         MOV     PSW,A    ;DEC THE STACK POINTER

         JMP     CHANGE

COINON:  MOV     A,R2
         MOVD    P6,A     ;CHANGE ON
         MOV     A,#48D NOT       ;FOR 400MS
         CALL    WAIT
         CLR     A
         MOVD    P6,A     ;CHANGE OFF
         MOV     A,#42D NOT       ;350 MS
         JMP     WAIT
```

```
805
806
807
808
809 ;SWITCH SCAN
810 ;UTILIZES R5',R6' & R7' FOR SWITCH DEBOUNCE AND
811 ;STUCK SWITCH LOCKOUT
812 ;FLAG ZERO IS USED AS THE SCAN POINTER
813
814 SWSCN:  MOV     A,#07H
815         ORLD    P5,A
816         MOV     A,#01H NOT
817         ANLD    P5,A
818         MOVD    A,P4     ;GET COIN SWITCHES
819         MOV     R1,A     ;TEMP SAVE
820         MOV     A,#07H
821         ORLD    P5,A
822         MOV     A,#02H NOT
823         ANLD    P5,A
824         MOVD    A,P4     ;GET COIN EMPTY & CHANGE SWITCHES
825         SWAP    A
826         ORL     A,R1
827         CPL     A
828
829         JF0     SCN2
830         CPL     F0
831
832         MOV     R7,A     ;SAVE FIRST SCAN
833         RET
834
835 SCN2:   CPL     F0
836         ANL     A,R7     ;COMBINE 1ST & 2ND SCANS
837         MOV     R6,A     ;SAVE
838
839         MOV     A,R5     ;GET STUCK SW REG
840         CPL     A
841         ANL     A,R6     ;ACC. =CLOSED SW - STUCK SW
842         ANL     A,#0FH   ;JUST COIN SW FOR R3
843         MOV     R3,A
844         MOV     A,R6     ;GET CLOSED SWITCHES
845         MOV     R5,A     ;SAVE AS STUCK SWITCHES
846         RET
847
848
849
850 COIN:   SEL     RB1
851 DCOIN:  CALL    SWSCN
852         JF0     EXITR    ;IF FIRST SCAN JUST RETURN
853
854
855 ADCOIN: MOV     R0,#CONVAL LOW
856         MOV     R1,#00H ;TEMP CASH REG
857         MOV     R2,#04  ;4 BITS(COINS) TO TEST FOR
858
859 GTCNBT: MOV     A,R3     ;GET COIN BITS
860         JB0     ADDVAL
861
862 RRR3:   MOV     A,R3
863         RR      A
864         MOV     R3,A
865         INC     R0       ;POINT @ NEXT VALUE
866         DJNZ    R2,GTCNBT
867
868 ADDXRM: DIS     I        ;ADD TEMP CASH REG TO XRAM CAS
869         MOV     R0,#CASHTV
870         CALL    CS3
871         MOVX    A,@R0
872         ADD     A,R1
873         MOVX    @R0,A
874         SEL     RB0
875         JMP     INTTST
876
```

```
                 877
                 878
                 879 ADDVAL: MOV     A,R0
                 880         MOVP    A,@A
                 881         ADD     A,R1
                 882         MOV     R1,A
                 883         JMP     RRR3
                 884
                 885
                 886 CONVAL: DB      01D
                 887         DB      02D
                 888         DB      05D
                 889         DB      20D
                 890
                 891         ENDIF
                 892
                 893
                 894
0200             895         ORG     200H
                 896
                 897
                 898 ;MOTOR OUTPUT ROUTINE
                 899
                 900 ;TEST STUCK MOTOR RAM FOR PREVIOUSLY FAILED
                 901 ;TEST SWITCH FOR PRESENTLY OPEN
                 902 ;TURN ON MASTER POWER
                 903 ;TURN ON MOTOR --TEST FOR ITS SWITCH WITHIN
                 904 ;.6 SEC.--TEST FOR NO OTHER SWITCH CHANGES
                 905
                 906 ;DO ACCOUNTING--IF FREE PLAY, COUNT VENDS ONLY
                 907 ;
                 908 ;TEST FOR THIS SWITCH TO OPENN WITHIN 2.6 SEC.
                 909 ;TURN OFF MASTER POWER
                 910 ;TEST FOR ADDITIONAL CHANGES
                 911 ;TURN OFF MOTOR
                 912 ;
                 913 ;
                 914 ;MOTOR ERROR ROUTINE SETS BIT IN STUCK MOTOR RAM
                 915 ;DATA EXPECTED,
                 916 ;                R7 = MOTOR NUMBER
                 917
                 918
                 919
0200 FF          920 MOTOR:  MOV     A,R7     ;GET THE SW #
0201 77          921         RR      A
0202 77          922         RR      A
0203 77          923         RR      A        ;GET COLUMN BITS
0204 5307        924         ANL     A,#07H   ;MASK UNWANTED BITS
0206 AD          925         MOV     R5,A     ;ADDRESS BIAS SAVED IN R5
                 926
0207 FF          927         MOV     A,R7     ;GET SW # AGAIN
0208 5307        928         ANL     A,#07H   ;MASK ALL BUT ROW BITS
020A 17          929         INC     A
                 930
020B A9          931         MOV     R1,A     ;SAVE IN R1
020C 27          932         CLR     A
020D 97          933         CLR     C
020E A7          934         CPL     C        ;CARRY BIT SET
                 935
020F F7          936 LOOP9:  RLC     A        ;THIS CONVERTS THE BINARY
0210 E90F        937         DJNZ    R1,LOOP9;IN R1 TO LINEAR IN THE ACC.
                 938
                 939
0212 AE          940         MOV     R6,A     ;BIT LOCATION SAVED IN R6
                 941
                 942 ;TEST FOR MOTOR PREVIOUSLY FAILED
                 943
0213 54BA        944         CALL    STUPXR
0215 F29E        945         JB7     EXIT5            ;ERROR BIT SET-EXIT
                 946
                 947
                 948 ;SET 8279 TO SENSOR MATRIX MOTOR SWITCH SCAN
                 949
0217 7408        950         CALL    MTRMDE   ;GO SET 8279 MODE
                 951
                 952
```

```
                 953 ;GET PRESENT SWITCH STATUS
                 954
0219 B820        955          MOV     R0,#TMSWR1       ;TEMPORARY MOTOR
                 956                                   ;SWITCH REG. #1
021B B908        957          MOV     R1,#08           ;# OF READS
                 958
021D 08          959 LOOP4:   INS     A,BUS            ;GET DATA
021E A0          960          MOV     @R0,A            ;SAVE IT
021F 18          961          INC     R0
0220 E91D        962          DJNZ    R1,LOOP4
                 963
                 964 ;TEST FOR SWITCH OPEN
                 965
0222 2320        966          MOV     A,#TMSWR1
0224 6D          967          ADD     A,R5     ;ADD BIAS TO ADDRESS
0225 A8          968          MOV     R0,A
                 969
0226 F0          970          MOV     A,@R0
0227 5E          971          ANL     A,R6     ;AND SW STATUS WITH SW BIT
                 972
0228 96A2        973          JNZ     MOTERR   ;SW IS NOT OPEN SET ERROR BIT
                 974
                 975
                 976 ;ACTIVATE MASTER POWER & MOTOR ROW & COLUMN
                 977
022A 562A        978 ZCROS1:  JT1     ZCROS1   ;WAIT HERE TILL LOW
022C 462C        979 EDGE1:   JNT1    EDGE1    ;WAIT FOR LEADING EDGE
022E FF          980          MOV     A,R7     ;SELECTION #
022F 39          981          OUTL    P1,A
                 982
                 983 ;TEST FOR THIS MOTOR SW TO BE CLOSED WITHIN .6 SECONDS
                 984
0230 23B7        985          MOV     A,#72D NOT       ;72 * 8.3MS=.6 SEC
0232 B4D5        986          CALL    CMOUT1
0234 08          987 READ1:   INS     A,BUS    ;READ IT
0235 5E          988          ANL     A,R6     ;COMP WITH CORRECT BIT
0236 16A2        989          JTF     MOTERR   ;TIMEOUT ERROR
0238 C634        990          JZ      READ1    ;NOT ON YET--TRY AGAIN
                 991
                 992
                 993
                 994 ;SET BIT IN TEMPORARY MOTOR SWITCH RAM
                 995
023A 65          996 SETBIT:  STOP    TCNT
                 997
023B 2320        998          MOV     A,#TMSWR1
023D 6D          999          ADD     A,R5     ;ADD BIAS TO ADDRESS
023E A8         1000          MOV     R0,A
                1001
023F FE         1002          MOV     A,R6     ;GET THE BIT
0240 40         1003          ORL     A,@R0    ;COMBINE
0241 A0         1004          MOV     @R0,A    ;STORE IT
                1005
                1006                           ;WAIT .3 SEC
0242 54E3       1007          CALL    CMSTTR   ;TEST FOR ADDITIONAL SW CHANGES
                1008
                1009
                1010
                1011 ;ACCOUNTING
                1012
0244 B4ED       1013 EXIT4:   CALL    FPTST    ;TEST FOR FREE PLAY
0246 14B6       1014          CALL    CS3
0248 15         1015          DIS     I        ;DIS I FOR EX RAM ACCESS
0249 766A       1016          JF1     VACCFP   ;IF FREE PLAY--JUST COUNT VENDS
024B FF         1017          MOV     A,R7     ;BIAS
024C E7         1018          RL      A
024D E7         1019          RL      A        ;TIMES FOUR
024E 0310       1020          ADD     A,#PRICE1
0250 A8         1021          MOV     R0,A
0251 80         1022          MOVX    A,@R0    ;GET PRICE THIS ITEM
                1023
0252 AB         1024          MOV     R3,A     ;SAVE PRICE FOR FUTURE USE
                1025
```

```
                 ;SUBTRACT PRICE FROM CASH IN MACHINE

0253 37                  CPL     A
0254 17                  INC     A
0255 AA                  MOV     R2,A     ;SAVE TWO'S COMPLEMENT
0256 B80B                MOV     R0,#CASHTV
0258 80                  MOVX    A,@R0
0259 6A                  ADD     A,R2     ;SUBTRACT
025A 90                  MOVX    @R0,A

                 ;ADD PRICE TO TOTAL CASH REGISTERS

025B B806                MOV     R0,#CASHCC
025D 54B1                CALL    ADDCSH

025F B803                MOV     R0,#CASHH
0261 54B1                CALL    ADDCSH
0263 18                  INC     R0
0264 80                  MOVX    A,@R0
0265 1300                ADDC    A,#00H
0267 90                  MOVX    @R0,A

0268 4470                JMP     VACCH    ;GO DO VEND ACC. HISTORICAL


                 ;COUNT FREE PLAY VENDS

026A B809        VACCFP: MOV      R0,#FRPLYC
026C 54AF                CALL    ADDCOM
026E 4478                JMP     VACCC

                 ;COUNT HIST VENDS

0270 FF          VACCH:  MOV      A,R7
0271 E7                  RL      A
0272 E7                  RL      A        ;BIAS TIMES FOUR
0273 0312                ADD     A,#NOVH1
0275 A8                  MOV     R0,A
0276 54AF                CALL    ADDCOM

                 ;COUNT COLECTION TO COL. VENDS

0278 FF          VACCC:  MOV      A,R7
0279 E7                  RL      A
027A E7                  RL      A        ;BIAS TIMES FOUR
027B 0311                ADD     A,#NOVCC1
027D A8                  MOV     R0,A
027E 80                  MOVX    A,@R0    ;GET THE VALUE
027F 17                  INC     A
0280 90                  MOVX    @R0,A    ;PUT IT BACK
0281 146B                CALL    INTTST   ;EN INT IF NONE PENDING


                 ;TEST FOR SWITCH TO OPEN WITHIN 2.6 SECONDS

0283 BC02        SWCOM1: MOV      R4,#02H
0285 235F        SWCOM2: MOV      A,#0A0H NOT      ;160 * 8.3MS=1.3 SEC.
0287 B4D5                CALL    CMOUT1
0289 08          READ2:  INS      A,BUS
028A 5E                  ANL     A,R6     ;COMPARE WITH CORRECT BIT
028B 16A0                JTF     DECR4    ;TIMES UP--ERROR
028D 9689                JNZ     READ2


028F 65          RSETBT: STOP     TCNT
0290 2320                MOV     A,#TMSWR1
0292 6D                  ADD     A,R5     ;ADD IN BIAS ADDRESS
0293 A8                  MOV     R0,A

0294 FE                  MOV     A,R6     ;SWITCH BIT
0295 37                  CPL     A
```

```
0296 50          1098          ANL     A,@R0    ;SWITCH BIT OFF
0297 A0          1099          MOV     @R0,A
                 1100
                 1101 ;TURN OFF MASTER POWER
                 1102
0298 8940        1103 MOTOFF:  ORL     P1,#40H ;MASTER POWER OFF
                 1104
                 1105
                 1106 ;IF ANY SWITCHES CHANGE STATE WITHIN .3 SECONDS
                 1107 ;ASSUME A BAD CIRCUIT AND SHUT DOWN
                 1108
                 1109
029A 54E3        1110          CALL    CMSTTR  ;TEST FOR ANY NEW CHANGES
                 1111
                 1112 ;TURN OFF THE MOTOR
                 1113
029C 89C0        1114 MTOFF:   ORL     P1,#0C0H;DISABLES THE DECODERS
                 1115
                 1116
029E 04CA        1117 EXIT5:   JMP     PIDLE   ;ALL DONE GO TWIDDLE YOUR
                 1118                          ;THUMBS
02A0 EC85        1119 DECR4:   DJNZ    R4,SWCOM2
                 1120
02A2 54BA        1121 MOTERR:  CALL    STUPXR
02A4 4380        1122          ORL     A,#80H  ;OR IN THE ERR BIT
02A6 90          1123          MOVX    @R0,A   ;SAVE IT
                 1124
02A7 89C0        1125          ORL     P1,#0C0H        ;MOTORS OFF
02A9 449E        1126          JMP     EXIT5   ;OTHERWISE NORMAL MOTOR
                 1127
02AB 89C0        1128 SHTDWN:  ORL     P1,#0C0H        ;MOTORS OFF
02AD 0430        1129          JMP     EXIT1   ;GO WAIT FOR CONTROL MODE
                 1130
                 1131
                 1132
02AF BB01        1133 ADDCOM:  MOV     R3,#01H ;FOR VEND ACCOUNTING
02B1 80          1134 ADDCSH:  MOVX    A,@R0
02B2 6B          1135          ADD     A,R3
02B3 90          1136          MOVX    @R0,A
02B4 18          1137          INC     R0
02B5 80          1138          MOVX    A,@R0
02B6 1300        1139          ADDC    A,#00H
02B8 90          1140          MOVX    @R0,A
02B9 83          1141          RET
                 1142
                 1143
                 1144 ;SET UP EXTERNAL RAM FOR ERROR CONDITIONS
                 1145
02BA 14B6        1146 STUPXR:  CALL    CS3
02BC FF          1147          MOV     A,R7
02BD E7          1148          RL      A
02BE E7          1149          RL      A       ;BIAS TIMES FOUR
02BF 0311        1150          ADD     A,#NOVCC1
02C1 A8          1151          MOV     R0,A
02C2 80          1152          MOVX    A,@R0
02C3 83          1153          RET
                 1154
                 1155
                 1156
                 1157
                 1158 $EJECT
                 1159
                 1160 ;CASH DISPLAY ROUTINE
                 1161 ;GET CASHTV-- CONVERT TO DECIMAL-- CONVERT TO CASH
                 1162 ;OUTPUT TO 8279
                 1163
02C4 14B6        1164 CSHDSP:  CALL    CS3
02C6 B80B        1165          MOV     R0,#CASHTV
02C8 80          1166          MOVX    A,@R0
02C9 B931        1167          MOV     R1,#TBINR1
02CB A1          1168          MOV     @R1,A
02CC 19          1169          INC     R1
02CD B100        1170          MOV     @R1,#00H
```

```
02CF 19          1171          INC     R1
02D0 B100        1172          MOV     @R1,#00H
                 1173
02D2 7463        1174          CALL    BINDEC
02D4 749C        1175          CALL    DECCSH
                 1176
02D6 B82E        1177          MOV     R0,#TCSHR1 +1
02D8 23B0        1178          MOV     A,#0B0H ;BLANK FOURTH DIGIT
02DA 40          1179          ORL     A,@R0
02DB A0          1180          MOV     @R0,A
02DC C8          1181          DEC     R0
02DD B902        1182          MOV     R1,#02H
02DF 2390        1183          MOV     A,#90H          ;SET FOR OUTPUT
                 1184
02E1 E420        1185          JMP     NUMOT1
                 1186
                 1187
                 1188 $EJECT
                 1189
                 1190 ;COMPARE MOTOR SWITCHES WITH THE TEMP MOTOR SWITCH
                 1191 ;REGISTERS. IF THEY COMPARE, RETURN. IF NOT GO TO
                 1192 ;SHUT DOWN
                 1193
                 1194
02E3 7424        1195 CMSTTR: CALL    WAIT1
02E5 7408        1196          CALL    MTRMDE
                 1197
02E7 B820        1198          MOV     R0,#TMSWR1
02E9 B908        1199          MOV     R1,#08H
                 1200
02EB 08          1201 LOOP7:   INS     A,BUS
02EC 37          1202          CPL     A
02ED 60          1203          ADD     A,@R0
02EE 17          1204          INC     A
02EF 96F5        1205          JNZ     ERR1
02F1 18          1206          INC     R0
02F2 E9EB        1207          DJNZ    R1,LOOP7
02F4 83          1208          RET
                 1209
02F5 27          1210 ERR1:    CLR     A
02F6 D7          1211          MOV     PSW,A
02F7 44AB        1212          JMP     SHTDWN
                 1213
                 1214
                 1215 $EJECT
                 1216
                 1217
                 1218
0300             1219          ORG     300H
                 1220
                 1221
                 1222
                 1223
                 1224
                 1225
                 1226 ;SET UP ROUTINES FOR THE TWO 8279 MODES
                 1227
                 1228
0300 230F        1229 NKYMDE: MOV      A,#NKEYC
0302 B80A        1230          MOV     R0,#NKMODE
0304 B9E0        1231          MOV     R1,#0E0H        ;CANCEL END INT
0306 640E        1232          JMP     STMODE
                 1233
0308 238F        1234 MTRMDE: MOV      A,#MTRSMC
030A B80C        1235          MOV     R0,#SMMODE
030C B9F0        1236          MOV     R1,#0F0H        ;END INT COMMAND
                 1237
                 1238 ;SET 8279 MODE
                 1239 ;DATA EXPECTED,
                 1240 ;                ACC.= P2 INFO FOR DECODER SELECT AND
                 1241 ;                      COMMAND MODE
                 1242 ;                R1  = 8279 COMMAND WORD
                 1243 ;THIS ROUTINE SETS THE MODE, WAITS 15MS FOR 8279
```

```
                 ;INITIALIZATION, THEN SETS MODE TO READ FIFO FROM
                 ;00H WITH AUTO INC.
030E 3A          STMODE: OUTL    P2,A     ;SET COMMAND MODE
030F F9                  MOV     A,R1     ;GET END INT COMMAND
0310 02                  OUTL    BUS,A    ;XMIT COMMAND
0311 F8                  MOV     A,R0     ;GET MODE COMMAND
0312 02                  OUTL    BUS,A
0313 23F8                MOV     A,#07H NOT       ;7 * 8.3MS =58.33MS
0315 62                  MOV     T,A
0316 45                  STRT    CNT
0317 F9                  MOV     A,R1
0318 02          MDLOOP: OUTL    BUS,A    ;KEEP IRQ RESET FOR 58 MS
0319 161D                JTF     DONE3
031B 6418                JMP     MDLOOP
031D 65          DONE3:  STOP    TCNT
031E 2350                MOV     A,#50H   ;READ FIFO WITH AUTO INC.
0320 02                  OUTL    BUS,A    ;XMIT COMMAND
0321 8A10                ORL     P2,#10H  ;MAKE INTO DATA MODE
0323 83                  RET
                 $EJECT
                 ;WAIT ROUTINE
                 ;DATA EXPECTED,
                 ;                ACC. =THE COMPLEMENT OF THE NUMBER
                 ;                      OF COUNTS DESIRED
                 ;THE WAIT TIME IS 8.3333 MS TIMES "NUMBER"
0324 23DB        WAIT1:  MOV     A,#36D NOT
0326 62          WAIT:   MOV     T,A      ;SET COUNTER
0327 45                  STRT    CNT
0328 162C        FLGTST: JTF     DONE     ;IF FLAG IS SET WAIT TIME
                                          ;IS COMPLETE
032A 6428                JMP     FLGTST   ;OTHERWISE TEST AGAIN
032C 65          DONE:   STOP    TCNT
032D 83                  RET
                 $EJECT
                 ;IF FREE PLAY JUST LIGHT THE MAKE SEL LIGHT
                 ;TEST IF CASH THIS VEND > = LOWEST PRICE IN MACHINE
                 ;IF YES LIGHT THE MAKE SELECTION LIGHT & RET
                 ;IF NO EXTINGUISH THE MAKE SEL LIGHT
032E B4ED        LOWPRC: CALL    FPTST    ;FREE PLAY TST
0330 7647                JF1     MAKSEL   ;IF FREE PLAY--LIGHT THE LIGHT
0332 14B6                CALL    CS3
0334 B80B                MOV     R0,#CASHTV       ;ADDRESS OF CASH
                                          ;THIS VEND REGISTER
0336 B93F                MOV     R1,#LPRICE       ;ADDRESS OF LOWEST PRICE
                                          ;IN THE MACHINE REGISTER
0338 80                  MOVX    A,@R0    ;GET THE VALUE
0339 37                  CPL     A
033A 61                  ADD     A,@R1
033B 17                  INC     A        ;COMPARE FUNCTION
033C C647                JZ      MAKSEL   ;CASH = LOW PRICE OR
033E E647                JNC     MAKSEL   ;CASH > LOW PRICE
                                          ;GO LIGHT THE MAKE SELECT-
                                          ;ION LIGHT
0340 B83E        MSOFF:  MOV     R0,#LTREG        ;TURN OFF THE MAKE SEL
0342 23DF                MOV     A,#20H NOT       ;LIGHT IN RAM
0344 50                  ANL     A,@R0
```

```
0345 A0          1316          MOV     @R0,A
                 1317
0346 83          1318          RET
                 1319
0347 B83E        1320 MAKSEL:  MOV     R0,#LTREG
0349 2320        1321          MOV     A,#20H
034B 40          1322          ORL     A,@R0
034C A0          1323          MOV     @R0,A
034D 83          1324          RET
                 1325
                 1326 $EJECT
                 1327
                 1328
                 1329
                 1330 ;TURN MAKE SELECTION LIGHT AND C.R.E.M. COIL OFF
                 1331 ;THEN WATCH FOR ADDITIONAL COINS FOR .5 SECONDS
                 1332
034E 7440        1333 MSCOFF:  CALL    MSOFF    ;TURN OFF MAKE SEL BIT
0350 74C7        1334          CALL    LTOUT    ;TURN OFF THE LIGHT
                 1335
0352 1487        1336          CALL    CRMOFF
                 1337
0354 23C3        1338          MOV     A,#60D NOT
0356 62          1339          MOV     T,A
0357 45          1340          STRT    CNT
0358 85          1341          CLR     F0
                 1342          IF      ELTYPE
0359 3440        1343 CNCALL:  CALL    CHNGER
                 1344          ELSE
                 1345 CNCALL:  CALL    COIN
                 1346          ENDIF
035B 54C4        1347          CALL    CSHDSP
035D 1661        1348          JTF     DONE10
035F 6459        1349          JMP     CNCALL
                 1350
0361 65          1351 DONE10:  STOP    TCNT
0362 83          1352          RET
                 1353
                 1354
                 1355 $EJECT
                 1356
                 1357
                 1358
                 1359 ;BINARY TO BINARY CODED DECIMAL CONVERSION ROUTINE
                 1360
                 1361 ;BINARY VALUE IS EXPECTED IN TEMP. BINARY REG.S 1-3
                 1362 ;BCD VALUE IS STORED IN TDECR1 THRU TDECR4
                 1363 ;
                 1364 ;THE TEMPORARY DECIMAL REGISTERS ARE CLEARED BEFORE CONV
                      SION
                 1365
                 1366
0363 D5          1367 BINDEC:  SEL     RB1
                 1368
0364 B82D        1369          MOV     R0,#TDECR1 + 4
0366 B904        1370          MOV     R1,#04H          ;# OF REG TO CLEAR
0368 27          1371          CLR     A
0369 C8          1372 CLRLOP:  DEC     R0
036A A0          1373          MOV     @R0,A
036B E969        1374          DJNZ    R1,CLRLOP
                 1375
                 1376
                 1377
036D 97          1378 BNDEC1:  CLR     C
036E B829        1379          MOV     R0,#TDECR1
0370 B931        1380          MOV     R1,#TBINR1
0372 BA90        1381          MOV     R2,#FBYTE1 LOW
0374 BB03        1382          MOV     R3,#03H          ;# OF BINARY REGISTERS
0376 BC04        1383          MOV     R4,#04H
                 1384
0378 F1          1385 TSTBIN:  MOV     A,@R1            ;GET THE BINARY VALUE
0379 C688        1386          JZ      NXTBYT
037B 07          1387          DEC     A
```

```
037C A1          1388          MOV     @R1,A
                 1389
                 1390
037D FA          1391 MBADD:   MOV     A,R2
037E A3          1392          MOVP    A,@A
037F 70          1393          ADDC    A,@R0          ;ADD TO DECIMAL REG
0380 57          1394          DA      A
0381 A0          1395          MOV     @R0,A          ;SAVE IT
0382 18          1396          INC     R0
0383 1A          1397          INC     R2
0384 EC7D        1398          DJNZ    R4,MBADD
                 1399
0386 646D        1400          JMP     BNDEC1
                 1401
0388 19          1402 NXTBYT:  INC     R1
0389 2304        1403          MOV     A,#04H
038B 6A          1404          ADD     A,R2
038C AA          1405          MOV     R2,A
038D EB78        1406          DJNZ    R3,TSTBIN
                 1407
038F 93          1408 DONE2:   RETR
                 1410
0390 01          1411 FBYTE1:  DB      01H,00H,00H,00H
0391 00
0392 00
0393 00
0394 56          1412          DB      56H,02H,00H,00H
0395 02
0396 00
0397 00
0398 36          1413          DB      36H,55H,06H,00H
0399 55
039A 06
039B 00
                 1414
                 1415
                 1416
                 1417
                 1418 $EJECT
                 1419
                 1420
                 1421
                 1422
                 1423 ;DECIMAL TO CASH CONVERSION ROUTINE
                 1424 ;MULTIPLY TEMP DEC REG TIMES A NICKEL
                 1425
039C BB05        1426 DECCSH:  MOV     R3,#05H ;ADD FIVE TIMES
                 1427
039E B931        1428          MOV     R1,#TCSHR1 + 4
03A0 BA04        1429          MOV     R2,#04D        ;4 REG TO CLEAR
03A2 27          1430          CLR     A
                 1431
03A3 C9          1432 CLRLP1:  DEC     R1
03A4 A1          1433          MOV     @R1,A
03A5 EAA3        1434          DJNZ    R2,CLRLP1
                 1435
03A7 B829        1436 ADSTUP:  MOV     R0,#TDECR1     ;SET UP FOR ADD
03A9 B92D        1437          MOV     R1,#TCSHR1
03AB BA04        1438          MOV     R2,#04D        ;4 BYTE ADD
03AD 97          1439          CLR     C
                 1440
03AE F0          1441 ADLOP1:  MOV     A,@R0          ;GET THE DECIMAL
03AF 71          1442          ADDC    A,@R1          ;ADD TO CASH
03B0 57          1443          DA      A
03B1 A1          1444          MOV     @R1,A          ;SAVE IT
03B2 18          1445          INC     R0
03B3 19          1446          INC     R1
03B4 EAAE        1447          DJNZ    R2,ADLOP1
                 1448
03B6 EBA7        1449          DJNZ    R3,ADSTUP
                 1450
03B8 83          1451          RET
                 1452
                 1453 $EJECT
```

```
                 1454
                 1455
                 1456
                 1457
                 1458
                 1459
                 1460 ; GUM SOLD OUT
                 1461 ; READ THE GUM SOLD OUT SWITCHES & STORE IN LTREG
                 1462
03B9 14BB        1463 GUMSO:  CALL    CS5      ;SEL GUM SOLD OUT SW BANK
03BB 08          1464         INS     A,BUS
03BC 531F        1465         ANL     A,#1FH   ;MASK EXTRANEOUS BITS OFF
03BE A9          1466         MOV     R1,A
03BF B83E        1467         MOV     R0,#LTREG
03C1 F0          1468         MOV     A,@R0
03C2 53E0        1469         ANL     A,#0E0H ;GUM LIGHTS OFF
03C4 49          1470         ORL     A,R1     ;LIGHTS ON FOR CLOSED SWITCHES
03C5 A0          1471         MOV     @R0,A    ;SAVE IT
03C6 83          1472         RET
                 1473
                 1474
                 1475 ;TRANSFER LTREG TO THE HARDWARE
                 1476
03C7 9A8F        1477 LTOUT:  ANL     P2,#8FH
03C9 8A40        1478         ORL     P2,#40H ;CHIP SEL 4
03CB B83E        1479         MOV     R0,#LTREG
03CD F0          1480         MOV     A,@R0
03CE 02          1481         OUTL    BUS,A
03CF 83          1482         RET
                 1483
                 1484
                 1485
                 1486 ;FREE PLAY DISPLAY ROUTINE
                 1487 ;PART OF CONTROL
                 1488
03D0 BD09        1489 FRPLY:  MOV     R5,#FRPLYC
03D2 BC5D        1490         MOV     R4,#5DH          ;5D = FP
                 1491
03D4 BF04        1492         MOV     R7,#04H ;CHANGE COMMAND REG. TO USE
03D6 148B        1493         CALL    CNVRT   ;CNVRT THEN
03D8 BF02        1494         MOV     R7,#02H ;RESTORE IT
03DA 84AE        1495         JMP     HVND2
                 1496
                 1497 ;CLR VALUE ROUTINE
                 1498
03DC 90          1499 CLRVAL: MOVX    @R0,A
03DD 18          1500         INC     R0
03DE 90          1501 CLRVL1: MOVX    @R0,A
03DF 18          1502         INC     R0
03E0 90          1503         MOVX    @R0,A
                 1504
03E1 91          1505 MOVOO:  MOVX    @R1,A
03E2 19          1506         INC     R1
03E3 19          1507         INC     R1
03E4 19          1508         INC     R1
03E5 19          1509         INC     R1
03E6 EAE1        1510         DJNZ    R2,MOVOO
03E8 83          1511         RET
                 1512 $EJECT
                 1513
                 1514
                 1515
                 1516 ;        ***********************
                 1517 ;        *                     *
                 1518 ;        *   CONTROL MODE      *
                 1519 ;        *                     *
                 1520 ;        ***********************
                 1521
                 1522
                 1523
                 1524 ;CONTROL MODE
                 1525 ;RESETS EXTERNAL RAM VALIDITY TEST VALUES
                 1526 ;MONITOR CONTROL SWITCHES TO DISPLAY/MODIFY
```

```
                 ;ACCOUNTING VALUES
03E9 14B6        CONTRL: CALL    CS3      ;CHIP SEL. EX. RAM
03EB B800                MOV     R0,#RAMVER
03ED 2355                MOV     A,#55H
03EF 90                  MOVX    @R0,A
03F0 BF00                MOV     R7,#00H  ;CLEAR R7 BEFOR ENTERING
                                          ;CONTROL MODE
03F2 1487                CALL    CRMOFF
03F4 8400                JMP     PCMODE
0400                     ORG     400H
                 ;TEST FOR "STILL IN CONTROL MODE"
                 ;IF YES MONITOR CONTROL SWITCHES
                 ;A COMMAND SWITCH, SETS R0 TO FIRST XRAM ADDRESS
                 ;                  SETS STATUS BIT IN R7
                 ;                 GET DATA FROM XRAM INTO
                 ;                 R2, R3 & R4 AND DISPLAY
                 ;          PRICE-----------A1 VALUE
                 ;          MAX CASH--------M_ VALUE
                 ;          # VENDS COL.----A1 VALUE
                 ;          # VENDS HIST.---A1 VALUE
                 ;          CASH COL.-------C_ VALUE
                 ;          CASH HIST.------H_ VALUE
                 ;TEST THE SLOW/FAST SWITCH AND WAIT
                 ;                    .2 SECONDS FOR FAST
                 ;                    .7 SECONDS FOR SLOW
                 ;CHECK CLEAR SWITCH
                 ;CHECK PRICE UP AND DOWN
                 ;CHECK ITEM # LEFT AND RIGHT
0400 BC2A        PCMODE: MOV     R4,#2AH  ;CODE FOR C_
0402 F400                CALL    ALPOUT
0404 14C0        CMODE:  CALL    CS6      ;IF DOOR SW IS CLOSED--EXIT
0406 08                  INS     A,BUS
0407 37                  CPL     A
0408 F26D                JB7     EXIT20
040A F4A2                CALL    RDYTST   ;TEST FOR PERIF
040C 1210                JB0     CONTIN
040E E4C0                JMP     DUMP     ;
0410 14C5        CONTIN: CALL    CS7
0412 08                  INS     A,BUS
0413 F26D                JB7     EXIT20   ;IF NOT CONTROL MODE-EXIT
0415 37                  CPL     A
0416 D2FB                JB6     MPJTST   ;TEST ROUTINE ENTRY JMP
0418 14C5                CALL    CS7
041A 08                  INS     A,BUS    ;
041B 37                  CPL     A
041C 533F                ANL     A,#3FH   ;MASK OFF CONTRL & TEST
041E C637                JZ      TSTR7    ;IF ZERO TST FOR PREVIOUS
                                          ;COMMAND SWITCH CLOSURE
0420 AF                  MOV     R7,A     ;SAVE NEW COMMAND SWITCH
0421 85          JBLST:  CLR     F0       ;MAX CASH/CREDITS DISPLAY
0422 95                  CPL     F0       ;& COL/HIST CASH DISPLAY
0423 A5                  CLR     F1       ;FOR FREE PLAY VENDS/VEND COL
```

```
0424 BC00          MOV     R4,#00H
0426 14B6          CALL    CS3
0428 FF            MOV     A,R7      ;GET COMMAND DATA
0429 126F          JB0     PRICE
042B 3283          JB1     CVEND
042D 52AA          JB2     HVEND
042F 92BE          JB4     INVEN
0431 72B2  JBLSTA: JB3     MCASH
0433 B2C4          JB5     HCCASH
0435 8404          JMP     CMODE     ;HOW DID I GET HERE??????

0437 FF    TSTR7:  MOV     A,R7      ;TEST FOR OLD COMMAND MODE
0438 C600          JZ      PCMODE

043A 14C0          CALL    CS6
043C 08            INS     A,BUS     ;
043D 37            CPL     A
043E 533F          ANL     A,#3FH
0440 C662          JZ      JBLST1    ;NO COMMAND--DISPLAY OLD
                                     ;MODE IF ANY

0442 AE            MOV     R6,A      ;SAVE IT

0443 7249          JB3     FAST
0445 23C3          MOV     A,#60D NOT        ;.5 SEC.
0447 7426          CALL    WAIT
0449 23E7  FAST:   MOV     A,#24D NOT        ;.2 SEC.
044B 7426          CALL    WAIT

044D 14B6          CALL    CS3

044F FE    NXTTSK: MOV     A,R6
0450 14B6          CALL    CS3
0452 12FD          JB0     CLEAR
0454 32D4          JB1     VALCOM
0456 52D4          JB2     VALCOM
0458 925E          JB4     MPJ4      ;DECITM
045A B260          JB5     MPJ5      ;INCITM
045C 8404          JMP     CMODE

045E A427  MPJ4:   JMP     DECITM
0460 A400  MPJ5:   JMP     INCITM

0462 FF    JBLST1: MOV     A,R7      ;GET COMMAND REG
0463 1271          JB0     PRCE1     ;GO OUTPUT ITEM & PRICE
0465 3285          JB1     CVND1     ;GO OUTPUT ITEM & # OF VENDS
0467 52AC          JB2     HVND1     ; "
0469 92C2          JB4     INVEN1

046B 8431          JMP     JBLSTA

046D 0400  EXIT20: JMP     00H       ;COLD START

046F BD10  PRICE:  MOV     R5,#PRICE1        ;XRAM POINTER

0471 148B  PRCE1:  CALL    CNVRT     ;SET UP & CONVERT BIN TO DEC
0473 749C  PRCE2:  CALL    DECCSH

0475 B830          MOV     R0,#TCSHR1 +3     ;TCSHR4
0477 B0BB          MOV     @R0,#0BBH         ;BLANK TOP TWO DIGITS

0479 B82D  PRCE3:  MOV     R0,#TCSHR1
047B 2393  PRCE4:  MOV     A,#93H            ;WRITE FROM 03H

047D F41E          CALL    NUMOUT            ;OUTPUT CSH REG.S

047F F400          CALL    ALPOUT            ;R4 CONTAINS INFO
```

```
                                                    ';FOR ALPHA OUTPUT

0481 8404                JMP     CMODE


0483 BD11        CVEND:  MOV     R5,#NOVCC1          ;XRAM POINTER

0485 14B6        CVND1:  CALL    CS3
0487 76F9                JF1     MPJFP
0489 FD                  MOV     A,R5
048A A8                  MOV     R0,A
048B 80                  MOVX    A,@R0
048C 537F                ANL     A,#7FH  ;STRIP ERR BIT FOR # DISPLAY
048E 1490                CALL    CNVRT1
0490 B82B        CVND2:  MOV     R0,#TDECR1 +2
0492 FD                  MOV     A,R5    ;TEST VALUE FOR > 128 &
0493 A9                  MOV     R1,A    ;DISPLAY ERR IF TRUE
0494 81                  MOVX    A,@R1
0495 F2A1                JB7     ERRSET
0497 F0          CVND3:  MOV     A,@R0   ;BLANK THE MSD
0498 43B0                ORL     A,#0B0H ;"B" = BLANK DIGIT
049A A0                  MOV     @R0,A

049B B828        CVND4:  MOV     R0,#TDECR1 -1   ;BLANK BOTTOM TWO DIGITS
049D B0BB                MOV     @R0,#0BBH

049F 847B                JMP     PRCE4

04A1 B0CD        ERRSET: MOV     @R0,#0CDH       ;LETTERS "ER"
04A3 C8                  DEC     R0
04A4 F0                  MOV     A,@R0
04A5 43D0                ORL     A,#0D0H ;LETTER "R"
04A7 A0                  MOV     @R0,A
04A8 849B                JMP     CVND4


04AA BD12        HVEND:  MOV     R5,#NOVH1           ;XRAM POINTER

04AC 148B        HVND1:  CALL    CNVRT
04AE B82B        HVND2:  MOV     R0,#TDECR1 +2
04B0 8497                JMP     CVND3

04B2 BD08        MCASH:  MOV     R5,#MAXCSH
04B4 BC8E                MOV     R4,#8EH             ;8AH MEANS MC
04B6 B671                JF0     PRCE1   ;IF F0=1 DO MCASH

04B8 BD0B                MOV     R5,#CASHTV
04BA BC2C                MOV     R4,#2CH             ;2CH MEANS CR
04BC 8471                JMP     PRCE1


04BE BD0C        INVEN:  MOV     R5,#NRESRV
04C0 BCBC                MOV     R4,#0BCH                    ;NR

04C2 84AC        INVEN1: JMP     HVND1

04C4 BD03        HCCASH: MOV     R5,#CASHH
04C6 BC7E                MOV     R4,#7EH             ;7AH MEANS HC
04C8 B6CE                JF0     HCCSH1
04CA BD06                MOV     R5,#CASHCC
04CC BC2E                MOV     R4,#2EH             ;2AH MEANS CC

04CE 148B        HCCSH1: CALL    CNVRT
04D0 749C                CALL    DECCSH

04D2 8479                JMP     PRCE3
```

```
04D4 FD          VALCOM: MOV     A,R5
04D5 A8                  MOV     R0,A
04D6 FF                  MOV     A,R7
04D7 12DF                JB0     R6TST    ;PRICE
04D9 72DF                JB3     R6TST    ;MAXCSH AND CREDITS
04DB 92F7                JB4     MPJINV
04DD 8404                JMP     CMODE

04DF FE          R6TST:  MOV     A,R6
04E0 32E6                JB1     INCVAL

04E2 80          DECVAL: MOVX    A,@R0
04E3 07                  DEC     A
04E4 84E8                JMP     INCVAL + 2
04E6 80          INCVAL: MOVX    A,@R0
04E7 17                  INC     A
04E8 90                  MOVX    @R0,A

                 TSTOUF:                  ;OVER OR UNDERFLOW TEST
04E9 0338                ADD     A,#0C7H NOT
04EB C6F4                JZ      SET00
04ED E662                JNC     JBLST1
04EF FE                  MOV     A,R6     ;UP/DOWN TEST
04F0 32F4                JB1     SET00

04F2 23C7        SET995: MOV     A,#0C7H ;$9.95
04F4 90          SET00:  MOVX    @R0,A
04F5 8462                JMP     JBLST1


04F7 E480        MPJINV: JMP     INVRET
04F9 64D0        MPJFP:  JMP     FRPLY
04FB C400        MPJTST: JMP     TEST
04FD A47D        CLEAR:  JMP     TSTCLR

                 $EJECT

0500                     ORG     500H

0500 85          INCITM: CLR     F0       ;FOR MAXCASH/FREEPLAY
0501 FF                  MOV     A,R7     ;GET COMMAND REG
0502 925B                JB4     INCINV   ;INCREMENT INVENTORY ITEM
0504 761D                JF1     CLRF1    ;IF F1=1 CLR IT & DISP 1ST VAL
0506 FD                  MOV     A,R5
0507 0304                ADD     A,#04D
0509 AD                  MOV     R5,A

050A FC                  MOV     A,R4     ;ADJUST R4 FOR NEXT ITEM #
050B 0301                ADD     A,#01H
050D 57                  DA      A
050E AC                  MOV     R4,A

050F 03AA                ADD     A,#55H NOT       ;#55 IS G1 NOT F6
0511 17                  INC     A        ;COMPARE FUNCTION
0512 C623                JZ      SETG1    ;GO SET 60D FOR G1
0514 FC                  MOV     A,R4     ; 65H IS OVERRANGE SET 00
0515 039A                ADD     A,#65H NOT
0517 17                  INC     A        ;COMPARE FUNCTION
0518 9625                JNZ     MJLST1   ;OUTPUT NEW DATA
051A FF                  MOV     A,R7     ;TST FOR CVEND/FREE PLAY VEND
051B 3220                JB1     SETF1
051D A5          CLRF1:  CLR     F1
051E 8421        MJLST:  JMP     JBLST    ;GO SET 1ST VALUES

0520 B5          SETF1:  CPL     F1
0521 8462                JMP     JBLST1

0523 BC60        SETG1:  MOV     R4,#60H
0525 8462        MJLST1: JMP     JBLST1
```

```
0527 85          DECITM: CLR     F0
0528 95                  CPL     F0        ;FOR MAXCASH/FREEPLAY
0529 FF                  MOV     A,R7      ;GET COMMAND REG
052A 9269                JB4     DECINV    ;IF BIT 4 GO DEC INVENTORY ITEM
052C 7654                JF1     CF1SG5    ;IF F1=1 CLR IT & SET G5
052E FD                  MOV     A,R5
052F 03FC                ADD     A,#0FCH ;TWO'S CPL OF 4
0531 AD                  MOV     R5,A      ;"SUB"

0532 FC                  MOV     A,R4      ;ADJUST THE ALPHA POINTER
0533 0399                ADD     A,#99H    ;SUBTRACT ONE
0535 57                  DA      A
0536 AC                  MOV     R4,A

                                           ;CHECK FOR 59H IF YES SET
0537 03A6                ADD     A,#59H NOT        ;54D (ITEM # F5)
0539 17                  INC     A
053A C644                JZ      SETF5
053C FC                  MOV     A,R4      ;CHECK FOR 99H IF YES SET
053D 0366                ADD     A,#99H NOT        ;64H (ITEM # G5)
053F 17                  INC     A
0540 C648                JZ      FPCHK1    ;GO SET FREE PLAY OR G5

0542 8462                JMP     JBLST1

0544 BC54       SETF5:   MOV     R4,#54H
0546 8462                JMP     JBLST1

0548 FF         FPCHK1:  MOV     A,R7      ;TEST FOR CVEND/FREE PLAY VEND
0549 3220                JB1     SETF1
054B A5                  CLR     F1
054C BC64       SETG5:   MOV     R4,#64H
054E 23F0                MOV     A,#240D
0550 6D         ADDR5:   ADD     A,R5
0551 AD                  MOV     R5,A
0552 8462                JMP     JBLST1
0554 A5         CF1SG5:  CLR     F1
0555 BC64                MOV     R4,#64H
0557 BDFD                MOV     R5,#NOVCC1 +236D
0559 8462                JMP     JBLST1


055B FD         INCINV:  MOV     A,R5
055C 17                  INC     A
055D AD                  MOV     R5,A      ;ADDRESS INCREMENTED
055E FC                  MOV     A,R4
055F 0310                ADD     A,#10H
0561 AC                  MOV     R4,A      ;LETTERS CHANGED

0562 0303                ADD     A,#0FCH NOT       ;OVERFLO 1ST
0564 17                  INC     A
0565 C61E                JZ      MJLST
0567 8462                JMP     JBLST1    ;NEW VALUE

0569 FD         DECINV:  MOV     A,R5
056A 07                  DEC     A
056B AD                  MOV     R5,A      ;ADDRESS DECREMENTED
056C FC                  MOV     A,R4
056D 03F0                ADD     A,#0F0H ;SUBTRACT 10H
056F AC                  MOV     R4,A
0570 0353                ADD     A,#0ACH NOT       ;UNDERFLO TEST
0572 17                  INC     A
0573 C677                JZ      SETTOP
0575 8462                JMP     JBLST1
0577 BD0F       SETTOP:  MOV     R5,#NRESRV +3
0579 BCEC                MOV     R4,#0ECH
057B 8462                JMP     JBLST1
```

```
                1888
                1889
                1890 ;CLEAR ROUTINES
                1891 ;COL TO COL CLEAR REQUIRES CASH COL TO COL THEN
                1892 ;CLEAR SWITCH FOR 5 SECONDS
                1893 ;HISTORICAL CLEAR REQUIRES CASH HISTORICAL THEN
                1894 ;CLEAR THEN A 6 DIGIT CODE. THIS CODE IS PRESENTLY
                1895 ;FOUND IN ROM
                1896
057D FF         1897 TSTCLR: MOV     A,R7
057E 32CB       1898         JB1     CLRERR  ;MOTOR ERROR BIT CLEAR
0580 B284       1899         JB5     TESTFO
0582 8404       1900 MPJCMD: JMP     CMODE
0584 B69A       1901 TESTFO: JFO     CLRHST
                1902
                1903
0586 B4E0       1904 CLRCOL: CALL    BLKDSP          ;BLANKS DISPLAY &
                1905
0588 27         1906 CLRCCV: CLR     A
0589 14B6       1907         CALL    CS3
058B B809       1908         MOV     R0,#FRPLYC
058D 90         1909         MOVX    @R0,A   ;CLEARING FREE PLAY VENDS
058E 18         1910         INC     R0
058F 90         1911         MOVX    @R0,A
0590 B806       1912         MOV     R0,#CASHCC
0592 B911       1913         MOV     R1,#NOVCC1
0594 BA3C       1914         MOV     R2,#60D
0596 74DE       1915         CALL    CLRVL1
0598 8462       1916         JMP     JBLST1
                1917
059A B4E0       1918 CLRHST: CALL    BLKDSP
                1919
059C BC01       1920         MOV     R4,#01H ;CLEAR SWITCH
059E BA06       1921         MOV     R2,#06H ;SIX KEY CODE
05A0 BB21       1922 TIMSET: MOV     R3,#33D ;2.1 SECOND TIMEOUT
05A2 14C0       1923 READ:   CALL    CS6
05A4 23F7       1924         MOV     A,#08H NOT
05A6 7426       1925         CALL    WAIT
05A8 08         1926         INS     A,BUS
05A9 37         1927         CPL     A
                1928
05AA C6C0       1929         JZ      ZEROR4
05AC 37         1930         CPL     A
05AD 6C         1931         ADD     A,R4
05AE 17         1932         INC     A
05AF C6A0       1933         JZ      TIMSET  ;IF SAME SW SET TIME AGAIN
05B1 08         1934         INS     A,BUS
05B2 37         1935         CPL     A
05B3 AC         1936         MOV     R4,A    ;SAVE NEW SW #
                1937
05B4 23C4       1938         MOV     A,#LOW CODE6 -1
05B6 6A         1939         ADD     A,R2    ;ADD BIAS TO CODE ADDRESS
05B7 A3         1940         MOVP    A,@A
05B8 6C         1941         ADD     A,R4
05B9 17         1942         INC     A       ;COMPARE FUNCTION
05BA 96C3       1943         JNZ     EXIT7
                1944
05BC EAA0       1945         DJNZ    R2,TIMSET
                1946
05BE C4C3       1947         JMP     CLRHV
                1948
05C0 AC         1949 ZEROR4: MOV     R4,A
05C1 EBA2       1950         DJNZ    R3,READ
05C3 8462       1951 EXIT7:  JMP     JBLST1
                1952
05C5 FD         1953 CODE6:  DB      02H NOT
05C6 FD         1954         DB      02H NOT
05C7 FB         1955         DB      04H NOT
05C8 F7         1956         DB      08H NOT
05C9 EF         1957         DB      10H NOT
05CA DF         1958         DB      20H NOT
                1959
```

```
                 1960
                 1961 ;CLEAR ERROR , CLEAR THE MOTOR ERROR BIT FROM XRAM
                 1962
05CB 14D6        1963 CLRERR: CALL    CS3
05CD FD          1964         MOV     A,R5
05CE A8          1965         MOV     R0,A
05CF 80          1966         MOVX    A,@R0    ;GET DATA
05D0 537F        1967         ANL     A,#7FH   ;STRIP ERROR BIT
05D2 90          1968         MOVX    @R0,A
05D3 8462        1969         JMP     JBLST1
                 1970
                 1971
                 1972 ;8279 COMMAND OUTPUT COMMON
                 1973
05D5 62          1974 CMOUT1: MOV     T,A
05D6 45          1975         STRT    CNT
05D7 FD          1976         MOV     A,R5     ;GET COLUMN INFO
05D8 4340        1977         ORL     A,#40H   ;8279 READ @R5 ADDRESS
                 1978
05DA 9A8F        1979 COMOUT: ANL     P2,#08FH
05DC 02          1980         OUTL    BUS,A
05DD 8A10        1981         ORL     P2,#10H
05DF 83          1982         RET
                 1983
                 1984 ;BLANK DISPLAY ROUTINE
                 1985
05E0 2393        1986 BLKDSP: MOV     A,#93H   ;8279 COMMAND WORD
05E2 B904        1987         MOV     R1,#04H
05E4 B82D        1988         MOV     R0,#TDECR1 +4
05E6 C8          1989 BLKDP1: DEC     R0
05E7 B0BB        1990         MOV     @R0,#0BBH
05E9 E9E6        1991         DJNZ    R1,BLKDP1
05EB E41E        1992         JMP     NUMOUT
                 1993
                 1994
                 1995
                 1996 ;FREE PLAY TEST
                 1997 ;IF FREE PLAY IS CLOSED FOR 128 CONSECUTIVE TESTS
                 1998 ;SET FLAG 1
                 1999
                 2000
                 2001
05ED A5          2002 FPTST:  CLR     F1
05EE 14C0        2003         CALL    CS6
05F0 B880        2004         MOV     R0,#128D
05F2 08          2005         INS     A,BUS
05F3 D2F8        2006 TSTFP:  JB6     NOTFP    ;IF B6=1 NO FREE PLAY
05F5 E8F3        2007         DJNZ    R0,TSTFP
05F7 B5          2008         CPL     F1
                 2009
05F8 83          2010 NOTFP:  RET
                 2011
                 2012
                 2013 $EJECT
0600             2014         ORG     600H
                 2015
                 2016 ;MAXI MAT TEST ROUTINE
                 2017 ;THE TESTS ARE DIVIDED INTO FOUR SECTIONS
                 2018 ;THE FIRST SECTION, LAMP TEST, IS ENTERED UPON THE FIRST
                 2019 ;DEPRESION OF THE TEST SWITCH. EACH SUBSEQUENT DEPRESION
                 2020 ;OF THE TEST SWITCH ADVANCES THE TEST MODE TO THE NEXT
                 2021 ;SECTION.
                 2022 ;LAMP TEST, ILLUMINATE AND EXTINGUISH ALL LAMPS AND
                 2023 ;           L.E.D.'S AT A 2 CYCLE RATE.
                 2024 ;
                 2025 ;FRONT PANEL SWITCH TEST,
                 2026 ;           CHECK ALL FRONT PANEL SWITCHES FOR "OPEN"
                 2027 ;           DISPLAY THE ALPHA-NUMERIC DESIGNATION FOR
                 2028 ;           ANY CLOSED SWITCH.
                 2029 ;
                 2030 ;MOTOR SWITCH TEST,
                 2031 ;           SAME AS ABOVE FOR THE MOTOR SWITCHES
                 2032 ;
```

```
                 ;MISCELLANIOUS SWITCH TEST,
                 ;            OUTPUT THE GUM SOLD OUT SWITCH STATUS TO
                 ;            THE GUM SOLD OUT LAMPS.
                 ;            OUTPUT COIN EMPTY SWITCH STATUS ON
                 ;            THE CONTROL READOUTS.
                 ;
                 ;CONTROL SWITCH TEST,
                 ;            DISPLAY "C       01" THRU "C       12"
                 ;            TO INDICATE ANY STUCK CONTROL SWITCH
                 ;TEST ROUTINE ENTRY POINT
0600 BF01        TEST:   MOV     R7,#01H ;JUMP BIT REGISTER
0602 85                  CLR     F0
0603 95                  CPL     F0
                 ;TEST THE TEST SWITCH
                 ;TO CHANGE MODES THE TEST SWITCH MUST HAVE BEEN PREVIOUSL
                 ;OPEN (F0 RESET) THEN BE CLOSED FOR AT LEAST 8.33MS.
0604 14C0        TSTTSW: CALL    CS6     ;DOOR SW TEST, IF CLOSED EXIT
0606 08                  INS     A,BUS
0607 37                  CPL     A
0608 F22F                JB7     EXIT21
060A 14C5                CALL    CS7
060C 08                  INS     A,BUS
060D F22F                JB7     EXIT21  ;IF NOT CONTRL MODE EXIT TEST
060F D231                JB6     SWOPEN  ;IF BIT 2=1 THE SWITCH IS OFF
0611 B620                JF0     MDELST  ;SWITCH WAS PREVIOUSLY ON
                                         ;GO TO MODE JB LIST
0613 95                  CPL     F0
0614 23FD        SWCLSD: MOV     A,#02H NOT      ;2 * 8.33MS
0616 7426                CALL    WAIT
0618 14C5                CALL    CS7
061A 08                  INS     A,BUS
061B D231                JB6     SWOPEN
061D FF          CHMODE: MOV     A,R7
061E E7                  RL      A       ;NEXT TEST MODE
061F AF                  MOV     R7,A
                 MDELST:
0620 FF                  MOV     A,R7
0621 1234                JB0     LMPTST  ;LAMP TEST
0623 324F                JB1     CLRLMP  ;CLEAR LAMP TEST
0625 5253                JB2     FPSTST  ;FRONT PANEL SWITCH TEST
0627 728B                JB3     MSWTST  ;MOTOR SWITCH TEST
0629 9291                JB4     CSWTST  ;CONTROL SWITCH TEST
062B 2380                MOV     A,#7FH NOT
062D 7426                CALL    WAIT
062F 0400        EXIT21: JMP     BEGIN   ;GO BACK TO COLD START
0631 85          SWOPEN: CLR     F0
0632 C420                JMP     MDELST
                 ;LAMP TEST ROUTINE
0634 B5          LMPTST: CPL     F1
0635 9A0F                ANL     P2,#0FH ;8279 COMMAND SELECT
0637 7648                JF1     LMPT2
```

```
0639 23DC        2106          MOV     A,#0DCH ;FILL DISPLAY RAM WITH ONE'S
063B 02          2107          OUTL    BUS,A
                 2108
063C 27          2109          CLR     A
063D B83E        2110 LMPCOM:  MOV     R0,#LTREG
063F A0          2111          MOV     @R0,A
0640 74C7        2112          CALL    LTOUT
                 2113
0642 23C3        2114 WAIT2:   MOV     A,#60D NOT       ;.5 SECONDS
0644 7426        2115          CALL    WAIT
0646 C404        2116          JMP     TSTTSW
                 2117
0648 23D0        2118 LMPT2:   MOV     A,#0D0H ;FILL DISPLAY RAM WITH ZERO'S
064A 02          2119          OUTL    BUS,A
                 2120
064B 23FF        2121          MOV     A,#0FFH
064D C43D        2122          JMP     LMPCOM
                 2123
064F 761D        2124 CLRLMP:  JF1     CHMODE
0651 C434        2125          JMP     LMPTST
                 2126
                 2127
                 2128
                 2129 ;FRONT PANEL SWITCH TEST
                 2130
0653 BDA9        2131 FPSTST:  MOV     R5,#0A9H         ;CODE FOR SO
0655 230F        2132          MOV     A,#NKEYC         ;N-KEY DECODER &
                 2133
0657 740A        2134 TSTSW:   CALL    MTRMDE +2        ;SET 8279 MODE
                 2135
0659 BC00        2136 A1SET:   MOV     R4,#00H          ;R4=00 YIELDS "A1"
065B BA08        2137          MOV     R2,#08           ;# OF READS
                 2138
065D BB08        2139 LOOP11:  MOV     R3,#08           ;# OF BITS PER READ
065F 08          2140          INS     A,BUS            ;GET DATA
0660 1287        2141 LOOP12:  JB0     DISPLY           ;DISPLAY SW # VIA
                 2142                                   ;ALPHA OUT ROUTINE
0662 77          2143          RR      A
0663 A9          2144          MOV     R1,A             ;TEMP. SAVE
                 2145
0664 FC          2146          MOV     A,R4             ;GET DISPLAY REGISTER
0665 0301        2147          ADD     A,#01H
0667 57          2148          DA      A
0668 AC          2149          MOV     R4,A             ;INC, DA, & SAVE
                 2150
0669 03AA        2151          ADD     A,#55H NOT       ;G1 COMPARE
066B 17          2152          INC     A
066C C67F        2153          JZ      G1SET
066E FC          2154          MOV     A,R4
066F 039A        2155          ADD     A,#65H NOT       ;X1 COMPARE
0671 17          2156          INC     A
0672 C683        2157          JZ      X1SET
                 2158
0674 F9          2159 NXTTST:  MOV     A,R1
0675 EB60        2160          DJNZ    R3,LOOP12
0677 EA5D        2161          DJNZ    R2,LOOP11
0679 FD          2162          MOV     A,R5
067A AC          2163          MOV     R4,A
067B F400        2164          CALL    ALPOUT
                 2165
067D C404        2166          JMP     TSTTSW
                 2167
067F BC60        2168 G1SET:   MOV     R4,#60H
0681 C474        2169          JMP     NXTTST
                 2170
0683 BC90        2171 X1SET:   MOV     R4,#90H
0685 C474        2172          JMP     NXTTST
                 2173
                 2174
0687 F400        2175 DISPLY:  CALL    ALPOUT
0689 C404        2176          JMP     TSTTSW
                 2177
                 2178
```

```
                 ;MOTOR SWITCH TEST ROUTINE
                 
068B BD89        MSWTST: MOV     R5,#89H ;CODE FOR MO
068D 7408                CALL    MTRMDE
068F C459                JMP     A1SET
                 
                 
                 
                 
                 
                 
                 
                 
                 ;CONTROL SWITCH TEST ROUTINE
                 
0691 BC2A        CSWTST: MOV     R4,#2AH ;CODE FOR "C_" USED BY ALPOUT
                 
0693 14C0                CALL    CS6
                 
0695 B82C                MOV     R0,#TDECR1 +3   ;BLANK THE TOP THREE
0697 23BB                MOV     A,#0BBH         ;BYTES
0699 A0                  MOV     @R0,A
069A C8                  DEC     R0
069B A0                  MOV     @R0,A
069C C8                  DEC     R0
069D A0                  MOV     @R0,A
069E C8                  DEC     R0
                 
069F B902                MOV     R1,#02H ;TWO BYTES OF CONTROL SWITCHES
06A1 BA01                MOV     R2,#01H ;SW # COUNTER
                 
06A3 BB06        LOOPA:  MOV     R3,#06H ;6 BITS PER BYTE
06A5 08                  INS     A,BUS
06A6 37                  CPL     A
06A7 12B7        LOOPB:  JB0     CEOUT
06A9 77                  RR      A
06AA AD                  MOV     R5,A
06AB FA                  MOV     A,R2
06AC 0301                ADD     A,#01H
06AE 57                  DA      A
06AF AA                  MOV     R2,A
06B0 FD                  MOV     A,R5
06B1 EBA7                DJNZ    R3,LOOPB
06B3 E9BF                DJNZ    R1,NXTRD
                 
06B5 BA00                MOV     R2,#00H ;OUTPUT 0 FOR ALL SWITCHES OPEN
                 
                 
06B7 FA          CEOUT:  MOV     A,R2
06B8 A0                  MOV     @R0,A
06B9 2393                MOV     A,#93H
06BB F41E                CALL    NUMOUT
06BD C487                JMP     DISPLY
                 
                 
                 
06BF 14C5        NXTRD:  CALL    CS7
06C1 C4A3                JMP     LOOPA
                 
                 
06C3 B803        CLRHV:  MOV     R0,#CASHH
06C5 B912                MOV     R1,#NOVH1
06C7 BA3C                MOV     R2,#60D
06C9 27                  CLR     A
06CA 14B6                CALL    CS3
06CC 74DC                CALL    CLRVAL
06CE B913                MOV     R1,#NOVH1 +1
06D0 BA3C                MOV     R2,#60D
06D2 74E1                CALL    MOV00
06D4 8462                JMP     JBLST1
                 
                 
                 $EJECT
```

```
0700                ORG     700H

                ;ALPHA DISPLAY
                ;DECODE R4 TO DETERMINE ITEM LETER AND NUMBER
                ;OR LETER CODE  FOR NON ITEM FUNCTIONS
                ;LOWER 4 BITS OF R4 = ITEM # 0-9=1-10  A=BLANK
                ; B=BLANK  C=ALPHA E
                ;UPPER 4 BITS OF R4 =LETTER CODE 0=A,1=B,2=C,3=D
                ; 4=E,5=F,6=G,7=H,8=M,9=X

0700 239B       ALPOUT: MOV     A,#9BH  ;8279 WRITE FROM ADDRESS BH
0702 B4DA               CALL    COMOUT  ;8279 COMMAND OUTPUT COMMON

0704 FC                 MOV     A,R4
0705 530F               ANL     A,#0FH
0707 17                 INC     A       ;SET TO OUTPUT NUMERIC
0708 0334       OUTNUM: ADD     A,#NUMO LOW     ;ADD R4 (BIAS) TO
070A A3                 MOVP    A,@A    ;DB LST & GET THE VALUE
070B 02                 OUTL    BUS,A   ;OUTPUT TO 8279

070C B904               MOV     R1,#04H ;SET UP FOR ALPHA OUTPUT
070E FC                 MOV     A,R4
070F 47                 SWAP    A
0710 530F               ANL     A,#0FH  ;MASK FOR ALPHA CHARACTER
0712 E7                 RL      A
0713 E7                 RL      A       ;TIMES FOUR
0714 0344               ADD     A,#ALPHA1 LOW   ;ADD BIAS TO DB
0716 A8                 MOV     R0,A    ;LIST ADDRESS & SAVE IN R0

0717 A3         ALLOOP: MOVP    A,@A    ;GET DATA
0718 02                 OUTL    BUS,A
0719 18                 INC     R0
071A F8                 MOV     A,R0
071B E917               DJNZ    R1,ALLOOP

071D 83                 RET



                ;NUMBER OUTPUT ROUTINE
                ;EXPECTED DATA,
                ;               ACC.=8279 WRITE COMMAND WITH ADDRESS
                ;               R0 =RAM ADDRESS OF DATA BEING SENT

                ;GET BCD DATA FROM RAM (R0),CONVERT TO 7-SEGMENT
                ;AND OUTPUT TO THE 8279
                ;BCD 0-9 = 0-9,  A=BLANK, B=BLANK, C=ALPHA E

071E B904       NUMOUT: MOV     R1,#04H ;4 BYTES, 8 DIGITS
0720 B4DA       NUMOT1: CALL    COMOUT  ;8279 COMMAND OUTPUT COMMON

0722 F0         NUMLOP: MOV     A,@R0   ;GET FIRST TWO DIGITS BCD
0723 F42D               CALL    OUT1    ;GO OUTPUT FIRST HALF
0725 F0                 MOV     A,@R0
0726 47                 SWAP    A
0727 F42D               CALL    OUT1    ;GO OUTPUT SECOND HALF
0729 18                 INC     R0
072A E922               DJNZ    R1,NUMLOP

072C 83                 RET


072D 530F       OUT1:   ANL     A,#0FH  ;KILL UNWANTED INFO
072F 0334               ADD     A,#NUMO LOW     ;DB LST ADDRESS
0731 A3                 MOVP    A,@A
0732 02                 OUTL    BUS,A
0733 83                 RET
```

```
0734 F3          2323 NUMO:   DB      0F3H     ;7-SEGMENT NUMERAL 0
0735 60          2324         DB      060H     ;                  1
0736 B5          2325         DB      0B5H     ;                  2
0737 F4          2326         DB      0F4H     ;                  3
0738 66          2327         DB      066H     ;                  4
0739 D6          2328         DB      0D6H     ;                  5
073A D7          2329         DB      0D7H     ;                  6
073B 70          2330         DB      070H     ;                  7
073C F7          2331         DB      0F7H     ;                  8
073D 76          2332         DB      076H     ;                  9
073E F3          2333         DB      0F3H     ;                  0
073F 00          2334         DB      000H     ;          BLANK
0740 97          2335         DB      097H     ;          LETTER  E
0741 05          2336         DB      005H     ;          LETTER R
0742 37          2337         DB      037H     ;            "     P
0743 85          2338         DB      085H     ;            "     C
                 2339
0744 E3          2340 ALPHA1: DB      0E3H,090H,090H,0E3H      ;DOT MATRIX
0745 90
0746 90
0747 E3
0748 A1          2341         DB      0A1H,052H,052H,0F3H      ;
0749 52
074A 52
074B F3
074C 21          2342         DB      021H,012H,012H,0E1H      ;
074D 12
074E 12
074F E1
0750 E1          2343         DB      0E1H,012H,012H,0F3H      ;
0751 12
0752 12
0753 F3
0754 12          2344         DB      012H,052H,052H,0F3H      ;
0755 52
0756 52
0757 F3
0758 10          2345         DB      010H,050H,050H,0F3H      ;
0759 50
075A 50
075B F3
075C A1          2346         DB      0A1H,092H,012H,0E1H      ;          G
075D 92
075E 12
075F E1
0760 F3          2347         DB      0F3H,040H,040H,0F3H      ;          H
0761 40
0762 40
0763 F3
0764 F3          2348         DB      0F3H,020H,020H,0F3H      ;          M
0765 20
0766 20
0767 F3
0768 33          2349         DB      033H,0C0H,0C0H,033H      ;          X
0769 C0
076A C0
076B 33
076C 21          2350         DB      021H,092H,052H,021H      ;          S
076D 92
076E 52
076F 21
0770 83          2351         DB      083H,040H,040H,0E3H      ;       N
0771 40
0772 40
0773 E3
0774 F3          2352         DB      0F3H,042H,042H,081H      ;       D
0775 42
0776 42
0777 81
0778 E3          2353         DB      0E3H,013H,012H,0E1H      ;       Q
0779 13
077A 12
```

```
077B E1
077C E1          2354          DB      0E1H,012H,012H,0F3H     ;       D
077D 12
077E 12
077F F3
                 2355
                 2356
                 2357 $EJECT
                 2358
                 2359
                 2360 ;INVENTORY OUTPUT ROUTINE
                 2361
0780 14B6        2362 INVRET: CALL    CS3
0782 FD          2363         MOV     A,R5
0783 A8          2364         MOV     R0,A     ;RESERVE REG ADDRESS
0784 FE          2365         MOV     A,R6
0785 329D        2366         JB1     INVUP
0787 80          2367         MOVX    A,@R0
0788 C69B        2368         JZ      EXITI
078A 07          2369         DEC     A
078B 90          2370         MOVX    @R0,A    ;SAVE DECREMENTED NO.
078C FC          2371         MOV     A,R4
078D 47          2372         SWAP    A
078E 0306        2373         ADD     A,#06H
0790 530F        2374         ANL     A,#0FH
0792 AA          2375         MOV     R2,A
0793 2380        2376         MOV     A,#80H
0795 E7          2377 RACCL:  RL      A
0796 EA95        2378         DJNZ    R2,RACCL
0798 AA          2379         MOV     R2,A
0799 34C8        2380         CALL    COINON
079B 8462        2381 EXITI:  JMP     JBLST1
                 2382
                 2383
079D 80          2384 INVUP:  MOVX    A,@R0
079E 17          2385         INC     A
079F 90          2386         MOVX    @R0,A
07A0 8462        2387         JMP     JBLST1
                 2388
                 2389
                 2390
                 2391 ;READY TEST--TEST FOR PRESSENCE OF A PERIFERAL
                 2392 ;IF PRESENT FOR 1 SEC. RETURN WITH BIT 0 RESET
                 2393 ;IF NOT PRESENT RETURN IMEDIATLEY WITH BIT 0 SET
                 2394
07A2 B978        2395 RDYTST: MOV     R1,#120D
07A4 56A4        2396 ZCROS2: JT1     ZCROS2
07A6 46A6        2397 POSEDG: JNT1    POSEDG   ;WAIT FOR POS. EDGE OF PULSE
07A8 14B1        2398         CALL    CS2
07AA 08          2399         INS     A,BUS    ;READ
07AB 12AF        2400         JB0     RET1
07AD E9A4        2401         DJNZ    R1,ZCROS2
07AF 83          2402 RET1:   RET
                 2403
                 2404
                 2405 ;THIS IS A 1 MS TIME DELAY
                 2406
07B0 BCC8        2407 TDLY1:  MOV     R4,#200D
07B2 ECB2        2408 TDLY:   DJNZ    R4,TDLY
07B4 83          2409         RET
                 2410
                 2411 ;READY WAIT-- IF READY  RET
                 2412 ; IF NOT READY WITHIN 2 SEC.S --EXIT TO BEGIN
                 2413
07B5 230F        2414 RDYWT:  MOV     A,#240D NOT
07B7 62          2415         MOV     T,A
07B8 45          2416         STRT    CNT
07B9 03          2417 INPUT:  INS     A,BUS
07BA 16E5        2418         JTF     EXIT00
07BC 12B9        2419         JB0     INPUT
07BE E4DF        2420         JMP     DECR3
                 2421
                 2422
```

```
                 ;THIS IS THE DUMP ROUTINE
                 ;OUTPUTS ONE START BIT (0) EIGHT DATA BITS AND ONE
                 ;STOP BIT (1) PER RAM LOC
                 ;ONLY DUMP IF RECIEVE LED IS ON
                 ;BIT RATE IS 1BIT PER MS OR 1K BAUD

07C0 B800        DUMP:    MOV     R0,#00H ;FIRST XRAM LOC TO OUTPUT
07C2 BB00                 MOV     R3,#00D ;256 BYTES TO XMIT
07C4 FB                   MOV     A,R3
07C5 E4CA                 JMP     FSTOUT  ;XMIT # OF BYTES(00=256)

07C7 14B6        CHAR:    CALL    CS3
07C9 80                   MOVX    A,@R0   ;GET THE DATA
07CA BA09        FSTOUT:  MOV     R2,#09H ;BIT COUNTER
07CC 97                   CLR     C
07CD F7                   RLC     A
07CE 14B1                 CALL    CS2
07D0 02                   OUTL    BUS,A   ;START BIT OUT
07D1 67                   RRC     A       ;DATA SET IN ACC.
07D2 A7                   CPL     C       ;STOP BIT SET IN C

07D3 F4B0        BIT:     CALL    TDLY1
07D5 02                   OUTL    BUS,A   ;BIT OUT
07D6 67                   RRC     A       ;NEXT BIT IN PLACE
07D7 EAD3                 DJNZ    R2,BIT
07D9 18                   INC     R0      ;NEXT BYTE
07DA F4B0                 CALL    TDLY1   ;STOP BIT TIME
07DC 08                   INS     A,BUS   ;CHECK READY LED
07DD 12B5                 JB0     RDYWT
07DF EBC7        DECR3:   DJNZ    R3,CHAR
07E1 08          DISWT:   INS     A,BUS
07E2 37                   CPL     A
07E3 12E1                 JB0     DISWT   ;WAIT FOR DISCONNECT
07E5 0400        EXIT00:  JMP     00H

                          END
```

USER SYMBOLS

| | | | | | | | | | |
|---|---|---|---|---|---|---|---|---|---|
| A1SET | 0659 | ADDCOM | 02AF | ADDCSH | 02B1 | ADDR5 | 0550 | ADECN | 0178 |
| ADLOP1 | 03AE | ADRSVR | 0175 | ADSTUP | 03A7 | ALLOOP | 0717 | ALPHA1 | 0744 |
| ALPOUT | 0700 | BEGIN | 0000 | BINDEC | 0363 | BIT | 07D3 | BLKDP1 | 05E6 |
| BLKDSP | 05E0 | BNDEC1 | 036D | CASHCC | 0006 | CASHH | 0003 | CASHTV | 000B |
| CEOUT | 06B7 | CF1SG5 | 0554 | CHAR | 07C7 | CHMODE | 061D | CHNGE1 | 01AA |
| CHNGER | 0140 | CLEAR | 04FD | CLRCCV | 0588 | CLRCOL | 0586 | CLRERR | 05CB |
| CLRF1 | 051D | CLRHST | 059A | CLRHV | 06C3 | CLRLMP | 064F | CLRLOP | 0369 |
| CLRLP1 | 03A3 | CLRRAM | 0012 | CLRVAL | 03DC | CLRVL1 | 03DE | CMODE | 0404 |
| CMOUT1 | 05D5 | CMSTTR | 02E3 | CNCALL | 0359 | CNVRT | 008B | CNVRT1 | 0090 |
| CODE6 | 05C5 | COINON | 01C8 | COMOUT | 05DA | CONT | 0144 | CONTIN | 0410 |
| CONTRL | 03E9 | CONTST | 00F6 | CRMOFF | 0087 | CRMON | 0083 | CS2 | 00B1 |
| CS3 | 00B6 | CS5 | 00BB | CS6 | 00C0 | CS7 | 00C5 | CSHDSP | 02C4 |
| CSWTST | 0691 | CVEND | 0483 | CVND1 | 0485 | CVND2 | 0490 | CVND3 | 0497 |
| CVND4 | 049B | CXRAM | 002A | DBYTE | 00A0 | DECCSH | 039C | DECINV | 0569 |
| DECITM | 0527 | DECR3 | 07DF | DECR4 | 02A0 | DECVAL | 04E2 | DIME | 0197 |
| DISPLY | 0687 | DISWT | 07E1 | DLRSVR | 000F | DONE | 032C | DONE10 | 0361 |
| DONE2 | 038F | DONE3 | 031D | DRESRV | 000D | DUMP | 07C0 | ECNVAL | 0186 |
| EDGE1 | 022C | ELCHNG | 018A | ELCOIN | 015F | ELCON | 01BB | ELTDNE | 015C |
| ELTYPE | 0001 | ERR1 | 02F5 | ERRSET | 04A1 | EXIT00 | 07E5 | EXIT1 | 0030 |
| EXIT2 | 013C | EXIT20 | 046D | EXIT21 | 062F | EXIT4 | 0244 | EXIT5 | 029E |
| EXIT7 | 05C3 | EXITI | 079B | EXITR | 01A7 | FAST | 0449 | FBYTE1 | 0390 |
| FLGTST | 0328 | FPCHK1 | 0548 | FPSTST | 0653 | FPTST | 05ED | FRPLY | 03D0 |
| FRPLYC | 0009 | FSTOUT | 07CA | G1SET | 067F | GETWD | 01D2 | GUMS0 | 03B9 |
| GUMSW1 | 0037 | HCCASH | 04C4 | HCCSH1 | 04CE | HVEND | 04AA | HVND1 | 04AC |
| HVND2 | 04AE | IDLE | 00DC | INCINV | 055B | INCITM | 0500 | INCVAL | 04E6 |
| INPUT | 07B9 | INTR | 0003 | INTTST | 006B | INVEN | 04BE | INVEN1 | 04C2 |
| INVRET | 0780 | INVUP | 079D | JBLST | 0421 | JBLST1 | 0462 | JBLSTA | 0431 |
| LMPCOM | 063D | LMPT2 | 0648 | LMPTST | 0634 | LOOP1 | 0015 | LOOP11 | 065D |
| LOOP12 | 0660 | LOOP2 | 002D | LOOP4 | 021D | LOOP7 | 02EB | LOOP9 | 020F |
| LOOPA | 06A3 | LOOPB | 06A7 | LOWPRC | 032E | LPLOOP | 0047 | LPRICE | 003F |
| LTOUT | 03C7 | LTREG | 003E | MAKSEL | 0347 | MAXCSH | 0008 | MAXTST | 006F |
| MBADD | 037D | MCASH | 04B2 | MDELST | 0620 | MDLOOP | 0318 | MJLST | 051E |
| MJLST1 | 0525 | MOTERR | 02A2 | MOTOFF | 0298 | MOTOR | 0200 | MOV00 | 03E1 |

| | | | | | | | | | |
|---|---|---|---|---|---|---|---|---|---|
| MPJ2 | 013E | MPJ4 | 045E | MPJ5 | 0460 | MPJCMD | 0582 | MPJCON | 00FB |
| MPJFP | 04F9 | MPJINV | 04F7 | MPJRD | 00FD | MPJTST | 04FB | MSCOFF | 034E |
| MSOFF | 0340 | MSWTST | 068B | MTOFF | 029C | MTRMDE | 0308 | MTRSMC | 008F |
| NICK | 019F | NKEYC | 000F | NKMODE | 000A | NKYMDE | 0300 | NOTFP | 05F8 |
| NOVCC1 | 0011 | NOVH1 | 0012 | NRESRV | 000C | NUMO | 0734 | NUMLOP | 0722 |
| NUMOT1 | 0720 | NUMOUT | 071E | NXTBIT | 01DC | NXTBYT | 0388 | NXTRD | 06BF |
| NXTTSK | 044F | NXTTST | 0674 | OUT1 | 072D | OUTNUM | 0708 | PCMODE | 0400 |
| PERIF | 002F | PIDLE | 00CA | POSEDG | 07A6 | PRCE1 | 0471 | PRCE2 | 0473 |
| PRCE3 | 0479 | PRCE4 | 047B | PRICE | 046F | PRICE1 | 0010 | PWRDWN | 0065 |
| QRESRV | 000E | QTR | 018F | QUARTR | 0000 | R6TST | 04DF | RACCL | 0795 |
| RAMVER | 0000 | RDYTST | 07A2 | RDYWT | 07B5 | READ | 05A2 | READ1 | 0234 |
| READ2 | 0289 | READSW | 0100 | RESET | 0069 | RESRV | 0171 | RET1 | 07AF |
| REXIT | 01A8 | RLACC | 01E6 | RQTLFT | 0118 | RSETBT | 028F | SAVNEW | 0061 |
| SBYTE | 0098 | SBYTE1 | 009B | SELSW | 010E | SELSW1 | 0122 | SELSW3 | 0126 |
| SERNO | 0001 | SETOO | 04F4 | SET995 | 04F2 | SETBIT | 023A | SETF1 | 0520 |
| SETF5 | 0544 | SETG1 | 0523 | SETG5 | 054C | SETTOP | 0577 | SETUP | 0007 |
| SHTDWN | 02AB | SMMODE | 000C | ST8279 | 0037 | STMODE | 030E | STUPXR | 02BA |
| SWCLSD | 0614 | SWCOM1 | 0283 | SWCOM2 | 0285 | SWOPEN | 0631 | TBINR1 | 0031 |
| TBYTE | 00AB | TCSHR1 | 002D | TDECR1 | 0029 | TDLY | 07B2 | TDLY1 | 07B0 |
| TDLYX | 01F6 | TEST | 0600 | TESTFO | 0584 | TEXRAM | 0022 | TIMSET | 05A0 |
| TMSWR1 | 0020 | TSTBIN | 0378 | TSTCLR | 057D | TSTECN | 0156 | TSTEER | 0159 |
| TSTFP | 05F3 | TSTOUF | 04E9 | TSTR7 | 0437 | TSTSW | 0657 | TSTTSW | 0604 |
| VACCC | 0278 | VACCFP | 026A | VACCH | 0270 | VALCOM | 04D4 | WAIT | 0326 |
| WAIT1 | 0324 | WAIT2 | 0642 | X1SET | 0683 | XCLOFF | 014D | XCLON | 0152 |
| XCSAV | 0155 | XCTST | 0147 | XCTST1 | 0149 | XRAM | 003F | ZCROS1 | 022A |
| ZCROS2 | 07A4 | ZEROR4 | 05C0 | ZTEST | 0053 | | | | |

ASSEMBLY COMPLETE, 1 ERROR ( 199)

| | | | | | | | | | |
|---|---|---|---|---|---|---|---|---|---|
| A1SET | 2136# | 2183 | | | | | | | |
| ADDCOM | 1054 | 1064 | 1133# | | | | | | |
| ADDCSH | 1039 | 1042 | 1134# | | | | | | |
| ADDR5 | 1848# | | | | | | | | |
| ADECN | 572 | 581# | | | | | | | |
| ADLOP1 | 1441# | 1447 | | | | | | | |
| ADRSVR | 567 | 577# | | | | | | | |
| ADSTUP | 1436# | 1449 | | | | | | | |
| ALLOOP | 2282# | 2286 | | | | | | | |
| ALPHA1 | 2279 | 2340# | | | | | | | |
| ALPOUT | 1573 | 1670 | 2164 | 2175 | 2263# | | | | |
| BEGIN | 109# | 2092 | | | | | | | |
| BINDEC | 322 | 337 | 1174 | 1367# | | | | | |
| BIT | 2445# | 2448 | | | | | | | |
| BLKDP1 | 1989# | 1991 | | | | | | | |
| BLKDSP | 1904 | 1918 | 1986# | | | | | | |
| BNDEC1 | 1378# | 1400 | | | | | | | |
| CASHCC | 82# | 1038 | 1733 | 1912 | | | | | |
| CASHH | 83# | 1041 | 1730 | 2238 | | | | | |
| CASHTV | 81# | 269 | 499 | 584 | 598 | 1031 | 1165 | 1300 | 1719 |
| CEOUT | 2212 | 2226# | | | | | | | |
| CF1SG5 | 1819 | 1851# | | | | | | | |
| CHAR | 2435# | 2453 | | | | | | | |
| CHMODE | 2077# | 2124 | | | | | | | |
| CHNGE1 | 603 | 608 | 613 | 619# | | | | | |
| CHNGER | 398 | 533# | 1343 | | | | | | |
| CLEAR | 1632 | 1778# | | | | | | | |
| CLRCCV | 1906# | | | | | | | | |
| CLRCOL | 1904# | | | | | | | | |
| CLRERR | 1898 | 1963# | | | | | | | |
| CLRF1 | 1787 | 1806# | | | | | | | |
| CLRHST | 1901 | 1918# | | | | | | | |
| CLRHV | 1947 | 2238# | | | | | | | |
| CLRLMP | 2084 | 2124# | | | | | | | |
| CLRLOP | 1372# | 1374 | | | | | | | |
| CLRLP1 | 1432# | 1434 | | | | | | | |
| CLRRAM | 143# | | | | | | | | |
| CLRVAL | 1499# | 2243 | | | | | | | |
| CLRVL1 | 1501# | 1915 | | | | | | | |
| CMODE | 1575# | 1608 | 1637 | 1673 | 1749 | 1900 | | | |
| CMOUT1 | 986 | 1084 | 1974# | | | | | | |
| CMSTTR | 1007 | 1110 | 1195# | | | | | | |
| CNCALL | 1343# | 1349 | | | | | | | |
| CNVRT | 307# | 1493 | 1657 | 1711 | 1736 | | | | |

| | | | | | | | | | | |
|---|---|---|---|---|---|---|---|---|---|---|
| CNVRT1 | 311# | 1685 | | | | | | | | |
| CODE6 | 1938 | 1953# | | | | | | | | |
| COINON | 640 | 648# | 2380 | | | | | | | |
| COMOUT | 1979# | 2264 | 2303 | | | | | | | |
| CONT | 534 | 537# | | | | | | | | |
| CONTIN | 1580 | 1582# | | | | | | | | |
| CONTRL | 181 | 417 | 1530# | | | | | | | |
| CONTST | 411 | 413# | | | | | | | | |
| CRMOFF | 267 | 280 | 281 | 288# | 1336 | 1538 | | | | |
| CRMON | 284# | | | | | | | | | |
| CS2 | 343# | 2398 | 2440 | | | | | | | |
| CS3 | 151 | 198 | 268 | 307 | 347# | 493 | 562 | 619 | 1014 | 1146 |
| | 1164 | 1299 | 1530 | 1600 | 1628 | 1631 | 1679 | 1907 | 1963 | 2242 |
| | 2362 | 2435 | | | | | | | | |
| CS5 | 351# | 481 | 1463 | | | | | | | |
| CS6 | 355# | 406 | 1575 | 1613 | 1923 | 2003 | 2057 | 2195 | | |
| CS7 | 178 | 243 | 359# | 413 | 1582 | 1588 | 2061 | 2073 | 2234 | |
| CSHDSP | 401 | 596 | 1164# | 1347 | | | | | | |
| CSWTST | 2087 | 2193# | | | | | | | | |
| CVEND | 1603 | 1677# | | | | | | | | |
| CVND1 | 1645 | 1679# | | | | | | | | |
| CVND2 | 1686# | | | | | | | | | |
| CVND3 | 1691# | 1713 | | | | | | | | |
| CVND4 | 1695# | 1705 | | | | | | | | |
| CXRAM | 172# | | | | | | | | | |
| DBYTE | 315 | 316 | 324# | | | | | | | |
| DECCSH | 1175 | 1426# | 1658 | 1737 | | | | | | |
| DECINV | 1818 | 1870# | | | | | | | | |
| DECITM | 1639 | 1815# | | | | | | | | |
| DECR3 | 2420 | 2453# | | | | | | | | |
| DECR4 | 1087 | 1119# | | | | | | | | |
| DECVAL | 1754# | | | | | | | | | |
| DIME | 605# | | | | | | | | | |
| DISPLY | 2141 | 2175# | 2230 | | | | | | | |
| DISWT | 2454# | 2456 | | | | | | | | |
| DLRSVR | 79# | | | | | | | | | |
| DONE | 1282 | 1286# | | | | | | | | |
| DONE10 | 1348 | 1351# | | | | | | | | |
| DONE2 | 1408# | | | | | | | | | |
| DONE3 | 1259 | 1261# | | | | | | | | |
| DRESRV | 77# | 605 | | | | | | | | |
| DUMP | 412 | 1581 | 2430# | | | | | | | |
| ECNVAL | 583 | 592# | | | | | | | | |
| EDGE1 | 979# | 979 | | | | | | | | |
| ELCHNG | 557 | 596# | 646 | | | | | | | |
| ELCOIN | 555 | 562# | | | | | | | | |
| ELCON | 637# | | | | | | | | | |
| ELTONE | 558# | 685 | | | | | | | | |
| ELTYPE | 91# | 221 | 283 | 528 | 1342 | | | | | |
| ERR1 | 1205 | 1210# | | | | | | | | |
| ERRSET | 1690 | 1700# | | | | | | | | |
| EXIT00 | 2418 | 2457# | | | | | | | | |
| EXIT1 | 178# | 180 | 1129 | | | | | | | |
| EXIT2 | 484 | 505 | 513# | | | | | | | |
| EXIT20 | 1578 | 1584 | 1652# | | | | | | | |
| EXIT21 | 2060 | 2063 | 2092# | | | | | | | |
| EXIT4 | 1013# | | | | | | | | | |
| EXIT5 | 945 | 1117# | 1126 | | | | | | | |
| EXIT7 | 1943 | 1951# | | | | | | | | |
| EXITI | 2368 | 2381# | | | | | | | | |
| EXITR | 614# | | | | | | | | | |
| FAST | 1622 | 1625# | | | | | | | | |
| FBYTE1 | 1381 | 1411# | | | | | | | | |
| FLGTST | 1282# | 1284 | | | | | | | | |
| FPCHK1 | 1836 | 1843# | | | | | | | | |
| FPSTST | 2085 | 2131# | | | | | | | | |
| FPTST | 266 | 486 | 1013 | 1296 | 2002# | | | | | |
| FRPLY | 1489# | 1776 | | | | | | | | |
| FRPLYC | 84# | 1053 | 1489 | 1908 | | | | | | |
| FSTOUT | 2433 | 2437# | | | | | | | | |

| | | | | | | | | | | |
|---|---|---|---|---|---|---|---|---|---|---|
| G1SET | 2153 | 2168# | | | | | | | | |
| GETWD | 222 | 537 | 659# | 660 | | | | | | |
| GUMSO | 402 | 1463# | | | | | | | | |
| GUMSW1 | 97# | | | | | | | | | |
| HCCASH | 1607 | 1730# | | | | | | | | |
| HCCSH1 | 1732 | 1736# | | | | | | | | |
| HVEND | 1604 | 1709# | | | | | | | | |
| HVND1 | 1646 | 1711# | 1728 | | | | | | | |
| HVND2 | 1495 | 1712# | | | | | | | | |
| IDLE | 398# | 409 | 415 | 513 | | | | | | |
| INCINV | 1786 | 1858# | | | | | | | | |
| INCITM | 1640 | 1784# | | | | | | | | |
| INCVAL | 1752 | 1756 | 1757# | | | | | | | |
| INPUT | 2417# | 2419 | | | | | | | | |
| INTR | 115# | 253 | | | | | | | | |
| INTTST | 253# | 615 | 1076 | | | | | | | |
| INVEN | 1605 | 1725# | | | | | | | | |
| INVEN1 | 1647 | 1728# | | | | | | | | |
| INVRET | 1775 | 2362# | | | | | | | | |
| INVUP | 2366 | 2384# | | | | | | | | |
| JBLST | 1596# | 1807 | | | | | | | | |
| JBLST1 | 1617 | 1643# | 1764 | 1770 | 1810 | 1813 | 1838 | 1841 | 1850 | 1854 |
| | 1868 | 1879 | 1882 | 1916 | 1951 | 1969 | 2247 | 2381 | 2387 | |
| JBLSTA | 1606# | 1649 | | | | | | | | |
| LMPCOM | 2110# | 2122 | | | | | | | | |
| LMPT2 | 2104 | 2118# | | | | | | | | |
| LMPTST | 2083 | 2102# | 2125 | | | | | | | |
| LOOP1 | 146# | 147 | | | | | | | | |
| LOOP11 | 2139# | 2161 | | | | | | | | |
| LOOP12 | 2141# | 2160 | | | | | | | | |
| LOOP2 | 175# | 176 | | | | | | | | |
| LOOP4 | 959# | 962 | | | | | | | | |
| LOOP7 | 1201# | 1207 | | | | | | | | |
| LOOP9 | 936# | 937 | | | | | | | | |
| LOOPA | 2209# | 2235 | | | | | | | | |
| LOOPB | 2212# | 2220 | | | | | | | | |
| LOWPRC | 400 | 1296# | | | | | | | | |
| LPLOOP | 204# | 219 | | | | | | | | |
| LPRICE | 67# | 201 | 1302 | | | | | | | |
| LTOUT | 403 | 1334 | 1477# | 2112 | | | | | | |
| LTREG | 66# | 1313 | 1320 | 1467 | 1479 | 2110 | | | | |
| MAKSEL | 1297 | 1309 | 1310 | 1320# | | | | | | |
| MAXCSH | 80# | 270 | 1715 | | | | | | | |
| MAXTST | 266# | 399 | | | | | | | | |
| MBADD | 1391# | 1398 | | | | | | | | |
| MCASH | 1606 | 1715# | | | | | | | | |
| MDELST | 2066 | 2081# | 2097 | | | | | | | |
| MDLOOP | 1258# | 1260 | | | | | | | | |
| MJLST | 1807# | 1867 | | | | | | | | |
| MJLST1 | 1803 | 1813# | | | | | | | | |
| MOTERR | 973 | 989 | 1121# | | | | | | | |
| MOTOFF | 1103# | | | | | | | | | |
| MOTOR | 516 | 920# | | | | | | | | |
| MOVOO | 1505# | 1510 | 2246 | | | | | | | |
| MPJ2 | 487 | 510 | 511 | 516# | | | | | | |
| MPJ4 | 1635 | 1639# | | | | | | | | |
| MPJ5 | 1636 | 1640# | | | | | | | | |
| MPJCMD | 1900# | | | | | | | | | |
| MPJCON | 417# | | | | | | | | | |
| MPJFP | 1680 | 1776# | | | | | | | | |
| MPJINV | 1748 | 1775# | | | | | | | | |
| MPJRD | 404 | 418# | | | | | | | | |
| MPJTST | 1586 | 1777# | | | | | | | | |
| MSCOFF | 463 | 1333# | | | | | | | | |
| MSOFF | 1313# | 1333 | | | | | | | | |
| MSWTST | 2086 | 2181# | | | | | | | | |
| MTOFF | 1114# | | | | | | | | | |
| MTRMDE | 950 | 1196 | 1234# | 2134 | 2182 | | | | | |
| MTRSMC | 42# | 1234 | | | | | | | | |
| NICK | 610# | | | | | | | | | |
| NKEYC | 40# | 1229 | 2132 | | | | | | | |
| NKMODE | 44# | 1230 | | | | | | | | |
| NKYMDE | 373 | 1229# | | | | | | | | |

```
NOTFP   2006   2010#
NOVCC1    74#  1071   1150   1677   1853   1913
NOVH1     75#  1062   1709   2239   2244
NRESRV    76#   564    610   1725   1880
NUMO    2269   2317   2323#
NUMLOP  2305#  2311
NUMOT1  1185   2303#
NUMOUT  1668   1992   2229   2302#
NXTBIT   667#   683
NXTBYT  1386   1402#
NXTRD   2221   2234#
NXTTSK  1630#
NXTTST  2159#  2169   2172
OUT1    2306   2309   2316#
OUTNUM  2269#
PCMODE  1539   1572#  1611
PERIF     53#
PIDLE    228    371#   450   1117
POSEDG  2397#  2397
PRCE1   1644   1657#  1717   1721
PRCE2   1658#
PRCE3   1665#  1739
PRCE4   1666#  1698
PRICE   1602   1655#
PRICE1    73#   199    217    497   1020   1655
PWRDWN   117    226    243#
QRESRV    78#   600
QTR      600#
QUARTR    92#
R6TST   1746   1747   1751#
RACCL   2377#  2378
RAMVER    85#   164   1531
RDYTST   410   1579   2395#
RDYWT   2414#  2452
READ    1923#  1950
READ1    987#   990
READ2   1085#  1088
READSW   418    441#
RESET    246#   246
RESRV    569    574#
RET1    2400   2402#
REXIT    615#   628    632
RLACC    675#   676
ROTLFT   477#   478
RSETBT  1091#
SAVNEW   213    230#
SBYTE    318#
SBYTE1   320#   329    331
SELSW    449    463#
SELSW1   473    486#
SELSW3   493#
SERNO     72#   152
SET00   1763   1766   1769#
SET995  1768#
SETBIT   996#
SETF1   1805   1809#  1844
SETF5   1832   1840#
SETG1   1799   1812#
SETG5   1846#
SETTOP  1878   1880#
SETUP    110    132#
SHTDWN  1128#  1212
SMMODE    45#  1235
ST8279   168    186#
STMODE  1232   1248#
STUPXR   944   1121   1146#
SWCLSD  2071#
SWCOM1  1082#
SWCOM2  1083#  1119
SWOPEN  2064   2075   2096#
TBINR1    63#   311   1167   1380
TBYTE    330    333#
```

```
TCSHR1    62#  1177   1428   1437   1661   1665
TDECR1    61#  1369   1379   1436   1686   1695   1712   1988   2197
TDLY     688   2408#  2408
TDLY1   2407#  2445   2450
TDLYX    679    682    687#
TEST    1777   2048#
TESTFO  1899   1901#
TEXRAM   164#
TIMSET  1922#  1933   1945
TMSWR1    60#   955    966    998   1092   1198
TSTBIN  1385#  1406
TSTCLR  1778   1897#
TSTECN   554#
TSTEER   556#   590
TSTFP   2006#  2007
TSTOUF  1761#
TSTR7   1592   1610#
TSTSW   2134#
TSTTSW  2057#  2116   2166   2176
VACCC   1055   1068#
VACCFP  1016   1053#
VACCH   1048   1059#
VALCOM  1633   1634   1743#
WAIT     378    642    651   1279#  1624   1626   1925   2072   2090   2115
WAIT1   1195   1278#
WAIT2   2114#
X1SET   2157   2171#
XCLOFF   545#
XCLON    541    542    543    549#
XCSAV    547    551#
XCTST    541#
XCTST1   542#
XRAM      51#
ZCROS1   978#   978
ZCROS2  2396#  2396   2401
ZEROR4  1929   1949#
ZTEST    209    215#   232

CROSS REFERENCE COMPLETE
```

What is claimed is:

1. Apparatus for vending foodstuffs comprising:

a plurality of dispensing means for dispensing said foodstuffs;

a power source;

an array of selector means, each being electrically isolated from and associated with one of said dispensing means for selecting a foodstuff, each selector means having an operating state and a quiescent state;

scanning means for scanning the said array of selector means to determine which dispensing means has been selected;

means for identifying a malfunctioning condition for each of said plurality of dispensing means, said means for identifying indicating any of said plurality of dispensing means which have previously malfunctioned and including monitoring means associated with each of said plurality of dispensing means for determining whether its associated dispensing means is in an operating or reset position; and control means responsive to said scanning means and said means for identifying for coupling said power source to the selected dispensing means if the same has not previously malfunctioned and causing the selection of said selected dispensing means to be refused if an indication that the same have previously malfunctioned is present, said indication that the same has previously malfunctioned including a determination that a selected dispensing means is in an operating position at the time dispensing is required.

2. The apparatus of claim 1, further comprising memory means having a memory location for each dispensing means; and means for inserting a count into the memory location assigned to a dispensing means when its associated dispensing means is energized.

3. The apparatus of claim 1 wherein each of said selection means includes a light emitting element which is energized upon an actuation of said selection means and means responsive to a selected test condition for repetitively energizing and deenergizing each light emitting element in said array of selector means.

4. The apparatus of claim 1 additionally comprising indicia means and means for defining a select test condition, said means for defining a select test condition being responsive to an enabling thereof and an actuation of a properly operating one of said array of selector means for causing said indicia to display a condition representative of said properly operating one of said array of selector means.

5. The apparatus of claim 1 wherein said means for identifying comprises:

memory means;

means for storing the status of said dispensing means; and display means for displaying the status of information stored in said memory means.

6. The apparatus of claim 1, wherein said control means further comprises motor drive means for each dispensing means, each being comprised of a light emitting element and a light sensitive switch means responsive to illumination of its associated light emitting element for conducting current from said power source to its associated dispensing means.

7. The apparatus of claim 6, further comprising:

a plurality of row and column drive lines, said motor drive means being arranged in a matrix comprised of a plurality of rows and columns, each light emitting element being connected between one of said row lines and one of said column lines; and decoder means responsive to the operative selector means for energizing the row and column drive lines coupled to the light emitting element associated with the selected dispensing means.

8. Apparatus for vending foodstuffs comprising;

a plurality of dispensing means for dispensing said foodstuffs;

a power source;

an array of selector means, each being electrically isolated from and associated with one of said dispensing means for selecting a foodstuff, each selector means having an operating state and a quiescent state;

scanning means for scanning the said array of selector means to determine which dispensing means has been selected;

means for identifying a malfunctioning condition for each of said plurality of dispensing means, said means for identifying indicating any of said plurality of dispensing means which have previously malfunctioned and including monitoring means associated with each of said plurality of dispensing means for ascertaining whether its associated dispensing means is in an operating position or a reset position, second scanning means for scanning said monitoring means to ascertain the position of said associated dispensing means prior to selective energization thereof, and selection control means responsive to said scanning means for preventing operation of a dispensing means selected for operation by its selector means when the associated dispensing means is in an operating position; and control means responsive to said scanning means and said means for identifying for coupling said power source to the selected dispensing means if the same has not previously malfunctioned and causing the selection of said selected dispensing means to be refused if an indication that the same have previously malfunctioned is present.

9. The apparatus of claim 8, further comprising:

memory means for storing status information for each dispensing means; and said selection control including means for inserting status information representing the state of each dispensing means.

10. The apparatus of claim 9, further comprising:

display means; and means responsive to a display request for sequentially displaying the status of each dispensing means.

11. Vending apparatus comprising:

a plurality of dispensing means;

selector means for selecting which of said dispensing means is to be operated;

scanning means for scanning said selector means and being responsive to the selector means which has been operated for energizing the dispensing means associated with the selector means which has been operated;

means responsive to operation of said dispensing means for storing data representing the number of times each dispensing means has been operated;

said means for storing data representing the number of times each dispensing means has been operated including means for storing in first and second register means the number of times each dispensing means has been operated and means for clearing one of said first and second register means for each dispensing means each time a collection is made from said vending apparatus whereupon one of said first and second register means maintains a value corresponding to a total number of operations of said dispensing means and another of said first and second register means maintains a value corresponding to dispensing operations of a dispensing means from collection-to-collection;

manually operable display activator means; and means for displaying said data responsive to operation of said activator means.

12. The apparatus according to claim 11 additionally comprising transmitter means in said vending apparatus, portable receiver means mountable in said vending apparatus and means responsive to a mounting of said portable receiver means in said vending apparatus for enabling said transmitter means for supplying data corresponding to the values stored in said first and second register means to said portable receiver means.

13. A method for operating microprocessor and memory means for a vending apparatus having:

coin receiving means;

a power source;

a plurality of dispensing means;

an array of selector switches for selecting the dispensing means;

an array of drive means, each capable of selectively operating an associated dispensing means;

monitoring means coupled to each dispensing means for representing the operating state of its associated dispensing means;

said method comprising the steps of operating said microprocessor for;

(a) periodically examining the coin receiving means to detect the insertion of coins;

(b) scanning said array of selector switches when coins of a sufficient cash value have been deposited to determine which switch has been operated;

(c) coupling the power source to every drive means;

(d) energizing the drive means associated with the operated selector switch to complete an electrical path between said power source and the dispensing means associated with the energizing drive means;

(e) incrementing a memory location associated with an energized dispensing means to maintain an accumulated count of the number of times the dispensing means has operated; and (f) transferring the status information to an off-line device comprised of a microprocessor operated receiver and a transmitter communicating with a transmitter and receiver operated by the vending apparatus microprocessor, said step of transferring further comprising the steps of;

energizing the vending apparatus transmitter to transmit radiation, aligning the off-line transmitter and receiver with the vending apparatus receiver and transmitter, respectively, energizing the off-line transmitter when said off-line receiver detects said radiation, modulating said vending apparatus transmitter in binary fashion to transmit the status information in a serial fashion, converting the modulated radiation into parallel data words, and storing the parallel data words in said memory.

14. The method of claim 13, further comprising the step of modulating said vending apparatus transmitter to transmit an initial data word representing the number of status words to be transmitted to said off-line device;

means for storing the initial data word in the off-line memory;

means for counting the number of status codes received by said off-line device and comparing the count with the initial data word and for generating an end of transmission signal when the said count compares with said initial data word.

15. A method for operating microprocessor and memory means for a vending apparatus having;

coin receiving means;

a power source;

a plurality of dispensing means;

an array of selector switches for selecting the dispensing means;

an array of drive means, each capable of selectively operating an associated dispensing means;

monitoring means coupled to each dispensing means for representing the operating state of its associated dispensing means;

said method comprising the steps of operating said microprocessor for;

(a) periodically examining the coin receiving means to detect the insertion of coins;

(b) scanning said array of selector switches when coins of a sufficient cash value have been deposited to determine which switch has been operated;

(c) coupling the power source to every drive means;

(d) determining if at least one of said plurality of dispensing means associated with an operated selector switch is in a properly operable condition by scanning all of said monitoring means to ascertain if any dispensing means has erroneously operated prior to energization of one of said drive means; and (e) energizing the drive means associated with the operated selector switch to complete an electrical path between said power source and the dispensing means associated with the energizing drive means if said dispensing means associated with an operated selector switch has been determined to be in a properly operable condition.

16. The method of claim 15, further comprising the step of storing a status code in said memory for the malfunctioning dispensing means.

17. The method of claim 16, further comprising the step of examining the status code of the selected dispensing means for preventing operation of the selected dispensing means in the event that its status code indicates that the dispensing means has malfunctioned.

18. A method for operating microprocessor and memory means for a vending apparatus having;

coin receiving means;

a power source;

a plurality of dispensing means;

an array of selector switches for selecting the dispensing means;

an array of drive means, each capable of selectively operating an associated dispensing means;

monitoring means coupled to each dispensing means for representing the operating state of its associated dispensing means;

said method comprising the steps of operating said microprocessor for;

(a) periodically examining the coin receiving means to detect the insertion of coins;

(b) scanning said array of selector switches when coins of a sufficient cash value have been deposited to determine which switch has been operated;

(c) coupling the power source to every drive means;

(d) determining if at least a one of said plurality of dispensing means associated with an operated selector switch is in a properly operable condition;

(e) energizing the drive means associated with the operated selector switch to complete an electrical path between said power source and the dispensing means associated with the energizing drive means if said dispensing means associated with an operated selector switch has been determined to be in a properly operable condition; and (f) scanning said monitoring means a predetermined time after energization of said drive means to determine if the energized dispensing means is operating properly.

19. The method of claim 18, further comprising the step of storing a status code in said memory for the malfunctioning dispensing means.

20. The method of claim 19, further comprising the step of examining the status code of the selected dispensing means for preventing operation of the selected dispensing means in the event that its status code indicates that the dispensing means has malfunctioned.

21. The method of claim 18, further comprising the step of scanning the monitoring means a predetermined time after the last dispensing means to be energized has been deenergized to determined if the last mentioned dispensing means has stopped at the proper position.

22. The method of claim 21, further comprising the step of storing a status code in said memory for the malfunctioning dispensing means.

23. The method of claim 22, further comprising the step of examining the status code of the dispensing means selected by its associated selector switch for preventing operation of the selected dispensing means in the event that its status code indicates that the dispensing means previously malfunctioned.

24. The method of claim 23, further comprising the step of incrementing a memory location associated with an energized dispensing means to maintain an accumulated count of the number of times each of the dispensing means has operated.

25. The method of claim 24, further comprising the step of displaying the status information stored in said memory means.

26. The method of claim 24, further comprising the step of printing a record of the status information stored in said memory means.

27. Apparatus for vending foodstuffs comprising:

a plurality of dispensing means for dispensing said foodstuffs;

a power source;

an array of selector means, each being electrically isolated from and associated with one of said dispensing means for selecting a foodstuff, each selector means having an operating state and a quiescent state;

scanning means for repetitively scanning said array of selector means;

identifying means responsive to any of said selector means being in the operative state for generating a selection request signal;

control means responsive to a selection request signal for ascertaining from said identifying means which selector means is in the operative state;

condition indicating means for scanning the operative condition of at least said dispensing means associated with said selector means in an operative state and indicating an operating condition thereof; and drive means responsive to said control means and said condition indicating means for coupling said power source to the dispensing means whose selector means has been operated if said dispensing means whose selector means has been operated is not already indicated as in an operating condition by said condition indicating means.

28. Apparatus for vending foodstuffs comprising;

a plurality of dispensing means for dispensing foodstuffs;

a power source;

an array of selector means, each being electrically isolated from and associated with one of said dispensing means for selecting a foodstuff, each selector means having an operating state and a quiescent state;

scanning means for scanning the said array of selector means to determine which dispensing means has been selected;

means for identifying a malfunctioning condition for each of said plurality of dispensing means, said means for identifying indicating any of said plurality of dispensing means which have previously malfunctioned and including memory means for storing status information for each dispensing means, monitoring means for determining the position of each dispensing means which may be either a reset or an operating position, second scanning means for scanning said monitoring means, and means responsive to said second scanning means for inserting a status word in said memory means representing the status of its associated dispensing means; and additionally comprising;

means responsive to each dispensing operation for inserting a count into said memory means at the memory location associated with a dispensing means when said dispensing means is operated; and control means responsive to said scanning means and said means for identifying for coupling said power source to the selected dispensing means if the same has not previously malfunctioned and causing the selection of said selected dispensing means to be refused if an indication that the same have previously malfunctioned is present.

29. Vending apparatus comprising:

a plurality of dispensing means;

selector means for selecting which of said dispensing means is to be operated;

scanning means for scanning said selector means and being responsive to the selector means which has been operated for identifying a dispensing means to be operated;

means for determining operational status of an identified dispensing means;

means for energizing the dispensing means associated with the selector means which has been operated if said means for determining has indicated a satisfactory operating status therefor;

means responsive to operation of said dispensing means for storing data representing the number of times each dispensing means has been operated;

manually operable display activator means; and means for displaying said data responsive to operation of said activator means.

* * * * *

UNITED STATES PATENT AND TRADEMARK OFFICE

CERTIFICATE OF CORRECTION

PATENT NO. : 4,354,613

DATED : October 19, 1982

INVENTOR(S) : DESAI ET AL.

It is certified that error appears in the above-identified patent and that said Letters Patent are hereby corrected as shown below:

Column 1, line 16, "conentional" should read --conventional--.

Column 6, line 43, "goed" should read --goes--.

Column 7, line 50, "CS" should read --$\overline{CS}$--.

Column 15, line 15, "Q" should read --$\overline{Q}$--.

Column 17, line 68, "55" should read --S5--.

Column 19, line 45, "," should read --.--.

Column 20, line 26, "hanger" should read --changer--.

Column 20, line 60, "tubs" should read --tubes--.

Signed and Sealed this

*Eighth* Day of *February 1983*

[SEAL]

*Attest:*

GERALD J. MOSSINGHOFF

*Attesting Officer*

*Commissioner of Patents and Trademarks*